US008869914B2

(12) United States Patent
Zediker et al.

(10) Patent No.: US 8,869,914 B2
(45) **Date of Patent: *Oct. 28, 2014**

(54) HIGH POWER LASER WORKOVER AND COMPLETION TOOLS AND SYSTEMS

(71) Applicant: Foro Energy Inc., Littleton, CO (US)

(72) Inventors: Mark S. Zediker, Castle Rock, CO (US); Charles C. Rinzler, Boston, MA (US); Brian O. Faircloth, Evergreen, CO (US); Yeshaya Koblick, Sharon, MA (US); Joel F. Moxley, Highlands Ranch, CO (US)

(73) Assignee: Foro Energy, Inc., Littleton, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/800,820

(22) Filed: Mar. 13, 2013

(65) Prior Publication Data

US 2014/0060802 A1 Mar. 6, 2014

Related U.S. Application Data

(63) Continuation of application No. 12/544,136, filed on Aug. 19, 2009, now Pat. No. 8,511,401.

(60) Provisional application No. 61/090,384, filed on Aug. 20, 2008, provisional application No. 61/102,730, filed on Oct. 3, 2008, provisional application No. 61/106,472, filed on Oct. 17, 2008, provisional application No. 61/153,271, filed on Feb. 17, 2009.

(51) Int. Cl.
*E21B 7/14* (2006.01)
*E21B 43/00* (2006.01)

(Continued)

(52) U.S. Cl.
CPC ..... *E21B 29/00* (2013.01); *E21B 10/60* (2013.01); *E21B 21/103* (2013.01); *E21B 7/15* (2013.01); *E21B 7/14* (2013.01); *E21B 43/11* (2013.01)
USPC ..... 175/16; 175/11; 175/15; 175/57; 166/65.1; 219/121.7; 219/121.72; 385/100; 372/14

(58) Field of Classification Search
USPC ..... 175/57, 11, 15, 16; 166/65.1; 219/121.7, 121.72; 385/100; 372/4
See application file for complete search history.

(56) References Cited

U.S. PATENT DOCUMENTS 914,636 A 3/1909 Case
2,548,463 A 4/1951 Blood (Continued)

FOREIGN PATENT DOCUMENTS

EP 0 295 045 A2 12/1988
EP 0 515 983 A1 12/1992

(Continued)

OTHER PUBLICATIONS

U.S. Appl. No. 12/543,986, filed Aug. 19, 2013, Moxley et al.

(Continued)

*Primary Examiner* — Jennifer H Gay
(74) *Attorney, Agent, or Firm* — Glen P. Belvis; Steptoe & Johnson LLP

(57) ABSTRACT

Workover and completion systems, devices and methods for utilizing 10 kW or more laser energy transmitted deep into the earth with the suppression of associated nonlinear phenomena. Systems and devices for the laser workover and completion of a borehole in the earth. These systems and devices can deliver high power laser energy down a deep borehole, while maintaining the high power to perform laser workover and completion operations in such boreholes deep within the earth.

25 Claims, 5 Drawing Sheets

(51) Int. Cl.

| | |
|---|---|
| ***B23K 26/00*** | (2014.01) |
| ***G02B 6/44*** | (2006.01) |
| ***H01S 3/30*** | (2006.01) |
| ***E21B 10/60*** | (2006.01) |
| ***E21B 21/10*** | (2006.01) |
| ***E21B 7/15*** | (2006.01) |
| ***E21B 43/11*** | (2006.01) |
| ***E21B 29/00*** | (2006.01) |

(56) References Cited

U.S. PATENT DOCUMENTS

| | | | |
|---|---|---|---|
| 2,742,555 | A | 4/1956 | Murray |
| 3,122,212 | A | 2/1964 | Karlovitz |
| 3,383,491 | A | 5/1968 | Muncheryan |
| 3,461,964 | A | 8/1969 | Venghiattis |
| 3,493,060 | A | 2/1970 | Van Dyk |
| 3,503,804 | A | 3/1970 | Schneider et al. |
| 3,539,221 | A | 11/1970 | Gladstone |
| 3,544,165 | A | 12/1970 | Snedden |
| 3,556,600 | A | 1/1971 | Shoupp et al. |
| 3,574,357 | A | 4/1971 | Tirgoviste et al. |
| 3,586,413 | A | 6/1971 | Adams |
| 3,652,447 | A | 3/1972 | Yant |
| 3,693,718 | A | 9/1972 | Stout |
| 3,699,649 | A | 10/1972 | McWilliams |
| 3,802,203 | A | 4/1974 | Ichise et al. |
| 3,820,605 | A | 6/1974 | Barber et al. |
| 3,821,510 | A | 6/1974 | Muncheryan |
| 3,823,788 | A | 7/1974 | Garrison et al. |
| 3,871,485 | A | 3/1975 | Keenan, Jr. |
| 3,882,945 | A | 5/1975 | Keenan, Jr. |
| 3,938,599 | A | 2/1976 | Horn |
| 3,960,448 | A | 6/1976 | Schmidt et al. |
| 3,977,478 | A | 8/1976 | Shuck |
| 3,992,095 | A | 11/1976 | Jacoby et al. |
| 3,998,281 | A | 12/1976 | Salisbury et al. |
| 4,019,331 | A | 4/1977 | Rom et al. |
| 4,025,091 | A | 5/1977 | Zeile, Jr. |
| 4,026,356 | A | 5/1977 | Shuck |
| 4,047,580 | A | 9/1977 | Yahiro et al. |
| 4,057,118 | A | 11/1977 | Ford |
| 4,061,190 | A | 12/1977 | Bloomfield |
| 4,066,138 | A | 1/1978 | Salisbury et al. |
| 4,090,572 | A | 5/1978 | Welch |
| 4,113,036 | A | 9/1978 | Stout |
| 4,125,757 | A | 11/1978 | Ross |
| 4,151,393 | A | 4/1979 | Fenneman et al. |
| 4,162,400 | A | 7/1979 | Pitts, Jr. |
| 4,189,705 | A | 2/1980 | Pitts, Jr. |
| 4,194,536 | A | 3/1980 | Stine et al. |
| 4,199,034 | A | 4/1980 | Salisbury et al. |
| 4,227,582 | A | 10/1980 | Price |
| 4,228,856 | A | 10/1980 | Reale |
| 4,243,298 | A | 1/1981 | Kao et al. |
| 4,249,925 | A | 2/1981 | Kawashima et al. |
| 4,252,015 | A | 2/1981 | Harbon et al. |
| 4,256,146 | A | 3/1981 | Genini et al. |
| 4,266,609 | A | 5/1981 | Rom et al. |
| 4,280,535 | A | 7/1981 | Willis |
| 4,281,891 | A | 8/1981 | Shinohara et al. |
| 4,282,940 | A | 8/1981 | Salisbury et al. |
| 4,332,401 | A | 6/1982 | Stephenson et al. |
| 4,336,415 | A | 6/1982 | Walling |
| 4,340,245 | A | 7/1982 | Stalder |
| 4,367,917 | A | 1/1983 | Gray |
| 4,370,886 | A | 2/1983 | Smith, Jr. et al. |
| 4,374,530 | A | 2/1983 | Walling |
| 4,375,164 | A | 3/1983 | Dodge et al. |
| 4,389,645 | A | 6/1983 | Wharton |
| 4,415,184 | A | 11/1983 | Stephenson et al. |
| 4,417,603 | A | 11/1983 | Argy |
| 4,436,177 | A | 3/1984 | Elliston |
| 4,444,420 | A | 4/1984 | McStravick et al. |
| 4,453,570 | A | 6/1984 | Hutchison |
| 4,459,731 | A | 7/1984 | Hutchison |
| 4,477,106 | A | 10/1984 | Hutchison |
| 4,504,112 | A | 3/1985 | Gould et al. |
| 4,522,464 | A | 6/1985 | Thompson et al. |
| 4,531,552 | A | 7/1985 | Kim |
| 4,565,351 | A | 1/1986 | Conti et al. |
| 4,662,437 | A | 5/1987 | Renfro |
| 4,694,865 | A | 9/1987 | Tauschmann |
| 4,725,116 | A | 2/1988 | Spencer et al. |
| 4,741,405 | A | 5/1988 | Moeny et al. |
| 4,770,493 | A | 9/1988 | Ara et al. |
| 4,774,420 | A | 9/1988 | Patterson et al. |
| 4,793,383 | A | 12/1988 | Gyory et al. |
| 4,830,113 | A | 5/1989 | Geyer |
| 4,860,654 | A | 8/1989 | Chawla et al. |
| 4,860,655 | A | 8/1989 | Chawla |
| 4,872,520 | A | 10/1989 | Nelson |
| 4,924,870 | A | 5/1990 | Wlodarczyk et al. |
| 4,952,771 | A | 8/1990 | Wrobel |
| 4,989,236 | A | 1/1991 | Myllymäki |
| 4,997,250 | A | 3/1991 | Ortiz, Jr. |
| 5,003,144 | A | 3/1991 | Lindroth et al. |
| 5,004,166 | A | 4/1991 | Sellar |
| 5,033,545 | A | 7/1991 | Sudol |
| 5,049,738 | A | 9/1991 | Gergely et al. |
| 5,084,617 | A | 1/1992 | Gergely |
| 5,086,842 | A | 2/1992 | Cholet |
| 5,107,936 | A | 4/1992 | Foppe |
| 5,121,872 | A | 6/1992 | Legget |
| 5,125,061 | A | 6/1992 | Marlier et al. |
| 5,125,063 | A | 6/1992 | Panuska et al. |
| 5,128,882 | A | 7/1992 | Cooper et al. |
| 5,140,664 | A | 8/1992 | Bosisio et al. |
| 5,163,321 | A | 11/1992 | Perales |
| 5,168,940 | A | 12/1992 | Foppe |
| 5,172,112 | A | 12/1992 | Jennings |
| 5,212,755 | A | 5/1993 | Holmberg |
| 5,269,377 | A | 12/1993 | Martin |
| 5,285,204 | A | 2/1994 | Sas-Jaworsky |
| 5,348,097 | A | 9/1994 | Giannesini et al. |
| 5,351,533 | A | 10/1994 | Macadam et al. |
| 5,353,875 | A | 10/1994 | Schultz et al. |
| 5,355,967 | A | 10/1994 | Mueller et al. |
| 5,356,081 | A | 10/1994 | Sellar |
| 5,396,805 | A | 3/1995 | Surjaatmadja |
| 5,411,081 | A | 5/1995 | Moore et al. |
| 5,411,085 | A | 5/1995 | Moore et al. |
| 5,411,105 | A | 5/1995 | Gray |
| 5,413,045 | A | 5/1995 | Miszewski |
| 5,413,170 | A | 5/1995 | Moore |
| 5,419,188 | A | 5/1995 | Rademaker et al. |
| 5,423,383 | A | 6/1995 | Pringle |
| 5,425,420 | A | 6/1995 | Pringle |
| 5,435,351 | A | 7/1995 | Head |
| 5,435,395 | A | 7/1995 | Connell |
| 5,463,711 | A | 10/1995 | Chu |
| 5,465,793 | A | 11/1995 | Pringle |
| 5,469,878 | A | 11/1995 | Pringle |
| 5,479,860 | A | 1/1996 | Ellis |
| 5,483,988 | A | 1/1996 | Pringle |
| 5,488,992 | A | 2/1996 | Pringle |
| 5,500,768 | A | 3/1996 | Doggett et al. |
| 5,503,014 | A | 4/1996 | Griffith |
| 5,503,370 | A | 4/1996 | Newman et al. |
| 5,505,259 | A | 4/1996 | Wittrisch et al. |
| 5,515,926 | A | 5/1996 | Boychuk |
| 5,526,887 | A | 6/1996 | Vestavik |
| 5,561,516 | A | 10/1996 | Noble et al. |
| 5,566,764 | A | 10/1996 | Elliston |
| 5,573,225 | A | 11/1996 | Boyle et al. |
| 5,577,560 | A | 11/1996 | Coronado et al. |
| 5,586,609 | A | 12/1996 | Schuh |
| 5,599,004 | A | 2/1997 | Newman et al. |
| 5,615,052 | A | 3/1997 | Doggett |
| 5,638,904 | A | 6/1997 | Misselbrook et al. |
| 5,655,745 | A | 8/1997 | Morrill |
| 5,694,408 | A | 12/1997 | Bott et al. |
| 5,707,939 | A | 1/1998 | Patel |
| 5,757,484 | A | 5/1998 | Miles et al. |

(56) References Cited

U.S. PATENT DOCUMENTS

| | | | |
|---|---|---|---|
| 5,759,859 | A | 6/1998 | Sausa |
| 5,771,984 | A | 6/1998 | Potter et al. |
| 5,773,791 | A | 6/1998 | Kuykendal |
| 5,794,703 | A | 8/1998 | Newman et al. |
| 5,813,465 | A | 9/1998 | Terrell et al. |
| 5,828,003 | A | 10/1998 | Thomeer et al. |
| 5,832,006 | A | 11/1998 | Rice et al. |
| 5,833,003 | A | 11/1998 | Longbottom et al. |
| 5,847,825 | A | 12/1998 | Alexander |
| 5,862,273 | A | 1/1999 | Pelletier |
| 5,862,862 | A | 1/1999 | Terrell |
| 5,896,482 | A | 4/1999 | Blee et al. |
| 5,896,938 | A | 4/1999 | Moeny et al. |
| 5,902,499 | A | 5/1999 | Richerzhagen |
| 5,909,306 | A | 6/1999 | Goldberg et al. |
| 5,913,337 | A | 6/1999 | Williams et al. |
| 5,924,489 | A | 7/1999 | Hatcher |
| 5,929,986 | A | 7/1999 | Slater et al. |
| 5,933,945 | A | 8/1999 | Thomeer et al. |
| 5,938,954 | A | 8/1999 | Onuma et al. |
| 5,973,783 | A | 10/1999 | Goldner et al. |
| 5,986,756 | A | 11/1999 | Slater et al. |
| RE36,525 | E | 1/2000 | Pringle |
| 6,015,015 | A | 1/2000 | Luft et al. |
| 6,038,363 | A | 3/2000 | Slater et al. |
| 6,059,037 | A | 5/2000 | Longbottom et al. |
| 6,060,662 | A | 5/2000 | Rafie et al. |
| 6,065,540 | A | 5/2000 | Thomeer et al. |
| RE36,723 | E | 6/2000 | Moore et al. |
| 6,076,602 | A | 6/2000 | Gano et al. |
| 6,092,601 | A | 7/2000 | Gano et al. |
| 6,104,022 | A | 8/2000 | Young et al. |
| RE36,880 | E | 9/2000 | Pringle |
| 6,116,344 | A | 9/2000 | Longbottom et al. |
| 6,135,206 | A | 10/2000 | Gano et al. |
| 6,147,754 | A | 11/2000 | Theriault et al. |
| 6,157,893 | A | 12/2000 | Berger et al. |
| 6,166,546 | A | 12/2000 | Scheihing et al. |
| 6,215,734 | B1 | 4/2001 | Moeny et al. |
| 6,227,300 | B1 | 5/2001 | Cunningham et al. |
| 6,250,391 | B1 | 6/2001 | Proudfoot |
| 6,273,193 | B1 | 8/2001 | Hermann et al. |
| 6,275,645 | B1 | 8/2001 | Vereecken et al. |
| 6,281,489 | B1 | 8/2001 | Tubel et al. |
| 6,301,423 | B1 | 10/2001 | Olson |
| 6,309,195 | B1 | 10/2001 | Bottos et al. |
| 6,321,839 | B1 | 11/2001 | Vereecken et al. |
| 6,352,114 | B1 | 3/2002 | Toalson et al. |
| 6,355,928 | B1 | 3/2002 | Skinner et al. |
| 6,356,683 | B1 | 3/2002 | Hu et al. |
| 6,377,591 | B1 | 4/2002 | Hollister et al. |
| 6,384,738 | B1 | 5/2002 | Carstensen et al. |
| 6,386,300 | B1 | 5/2002 | Curlett et al. |
| 6,401,825 | B1 | 6/2002 | Woodrow |
| 6,426,479 | B1 | 7/2002 | Bischof |
| 6,437,326 | B1 | 8/2002 | Yamate et al. |
| 6,450,257 | B1 | 9/2002 | Douglas |
| 6,494,259 | B2 | 12/2002 | Surjaatmadja |
| 6,497,290 | B1 | 12/2002 | Misselbrook et al. |
| 6,557,249 | B1 | 5/2003 | Pruett et al. |
| 6,561,289 | B2 | 5/2003 | Portman et al. |
| 6,564,046 | B1 | 5/2003 | Chateau |
| 6,591,046 | B2 | 7/2003 | Stottlemyer |
| 6,615,922 | B2 | 9/2003 | Deul et al. |
| 6,626,249 | B2 | 9/2003 | Rosa |
| 6,644,848 | B1 | 11/2003 | Clayton et al. |
| 6,661,815 | B1 | 12/2003 | Kozlovsky et al. |
| 6,710,720 | B2 | 3/2004 | Carstensen et al. |
| 6,712,150 | B1 | 3/2004 | Misselbrook et al. |
| 6,725,924 | B2 | 4/2004 | Davidson et al. |
| 6,747,743 | B2 | 6/2004 | Skinner et al. |
| 6,755,262 | B2 | 6/2004 | Parker |
| 6,808,023 | B2 | 10/2004 | Smith et al. |
| 6,832,654 | B2 | 12/2004 | Ravensbergen et al. |
| 6,847,034 | B2 | 1/2005 | Shah et al. |
| 6,851,488 | B2 | 2/2005 | Batarseh |
| 6,867,858 | B2 | 3/2005 | Owen et al. |
| 6,870,128 | B2 | 3/2005 | Kobayashi et al. |
| 6,874,361 | B1 | 4/2005 | Meltz et al. |
| 6,880,646 | B2 | 4/2005 | Batarseh |
| 6,885,784 | B2 | 4/2005 | Bohnert |
| 6,888,097 | B2 | 5/2005 | Batarseh |
| 6,888,127 | B2 | 5/2005 | Jones et al. |
| 6,912,898 | B2 | 7/2005 | Jones et al. |
| 6,913,079 | B2 | 7/2005 | Tubel |
| 6,920,395 | B2 | 7/2005 | Brown |
| 6,920,946 | B2 | 7/2005 | Oglesby |
| 6,923,273 | B2 | 8/2005 | Terry et al. |
| 6,957,576 | B2 | 10/2005 | Skinner et al. |
| 6,967,322 | B2 | 11/2005 | Jones et al. |
| 6,977,367 | B2 | 12/2005 | Tubel et al. |
| 6,978,832 | B2 | 12/2005 | Gardner et al. |
| 6,981,561 | B2 | 1/2006 | Krueger et al. |
| 6,994,162 | B2 | 2/2006 | Robison |
| 7,013,993 | B2 | 3/2006 | Masui |
| 7,040,746 | B2 | 5/2006 | McCain et al. |
| 7,055,604 | B2 | 6/2006 | Jee et al. |
| 7,055,629 | B2 | 6/2006 | Oglesby |
| 7,072,044 | B2 | 7/2006 | Kringlebotn et al. |
| 7,072,588 | B2 | 7/2006 | Skinner |
| 7,086,484 | B2 | 8/2006 | Smith, Jr. |
| 7,087,865 | B2 | 8/2006 | Lerner |
| 7,088,437 | B2 | 8/2006 | Blomster et al. |
| 7,126,332 | B2 | 10/2006 | Blanz et al. |
| 7,134,488 | B2 | 11/2006 | Tudor et al. |
| 7,134,514 | B2 | 11/2006 | Riel et al. |
| 7,140,435 | B2 | 11/2006 | Defretin et al. |
| 7,147,064 | B2 | 12/2006 | Batarseh et al. |
| 7,152,700 | B2 | 12/2006 | Church et al. |
| 7,163,875 | B2 | 1/2007 | Richerzhagen |
| 7,172,026 | B2 | 2/2007 | Misselbrook |
| 7,172,038 | B2 | 2/2007 | Terry et al. |
| 7,174,067 | B2 | 2/2007 | Murshid et al. |
| 7,188,687 | B2 | 3/2007 | Rudd et al. |
| 7,195,731 | B2 | 3/2007 | Jones |
| 7,196,786 | B2 | 3/2007 | DiFoggio |
| 7,199,869 | B2 | 4/2007 | MacDougall |
| 7,201,222 | B2 | 4/2007 | Kanady et al. |
| 7,210,343 | B2 | 5/2007 | Shammai et al. |
| 7,212,283 | B2 | 5/2007 | Hother et al. |
| 7,249,633 | B2 | 7/2007 | Ravensbergen et al. |
| 7,264,057 | B2 | 9/2007 | Rytlewski et al. |
| 7,270,195 | B2 | 9/2007 | MacGregor et al. |
| 7,273,108 | B2 | 9/2007 | Misselbrook |
| 7,334,637 | B2 | 2/2008 | Smith, Jr. |
| 7,337,660 | B2 | 3/2008 | Ibrahim et al. |
| 7,362,422 | B2 | 4/2008 | DiFoggio et al. |
| 7,372,230 | B2 | 5/2008 | McKay |
| 7,394,064 | B2 | 7/2008 | Marsh |
| 7,395,696 | B2 | 7/2008 | Bissonnette et al. |
| 7,416,032 | B2 | 8/2008 | Moeny et al. |
| 7,416,258 | B2 | 8/2008 | Reed et al. |
| 7,424,190 | B2 | 9/2008 | Dowd et al. |
| 7,471,831 | B2 | 12/2008 | Bearman et al. |
| 7,487,834 | B2 | 2/2009 | Reed et al. |
| 7,490,664 | B2 | 2/2009 | Skinner et al. |
| 7,503,404 | B2 | 3/2009 | McDaniel et al. |
| 7,515,782 | B2 | 4/2009 | Zhang et al. |
| 7,516,802 | B2 | 4/2009 | Smith, Jr. |
| 7,518,722 | B2 | 4/2009 | Julian et al. |
| 7,527,108 | B2 | 5/2009 | Moeny |
| 7,530,406 | B2 | 5/2009 | Moeny et al. |
| 7,559,378 | B2 | 7/2009 | Moeny |
| 7,587,111 | B2 | 9/2009 | de Montmorillon et al. |
| 7,600,564 | B2 | 10/2009 | Shampine et al. |
| 7,603,011 | B2 | 10/2009 | Varkey et al. |
| 7,617,873 | B2 | 11/2009 | Lovell et al. |
| 7,624,743 | B2 | 12/2009 | Sarkar et al. |
| 7,628,227 | B2 | 12/2009 | Marsh |
| 7,646,953 | B2 | 1/2010 | Dowd et al. |
| 7,647,948 | B2 | 1/2010 | Quigley et al. |
| 7,671,983 | B2 | 3/2010 | Shammai et al. |
| 7,715,664 | B1 | 5/2010 | Shou et al. |
| 7,720,323 | B2 | 5/2010 | Yamate et al. |

(56) References Cited

U.S. PATENT DOCUMENTS

| | | | |
|---|---|---|---|
| 7,769,260 | B2 | 8/2010 | Hansen et al. |
| 7,802,384 | B2 | 9/2010 | Kobayashi et al. |
| 7,834,777 | B2 | 11/2010 | Gold |
| 7,848,368 | B2 | 12/2010 | Gapontsev et al. |
| 7,900,699 | B2 | 3/2011 | Ramos et al. |
| 7,938,175 | B2 | 5/2011 | Skinner et al. |
| 8,011,454 | B2 | 9/2011 | Castillo |
| 8,074,332 | B2 | 12/2011 | Keatch et al. |
| 8,082,996 | B2 | 12/2011 | Kocis et al. |
| 8,091,638 | B2 | 1/2012 | Dusterhoft et al. |
| 8,109,345 | B2 | 2/2012 | Jeffryes |
| 8,175,433 | B2 | 5/2012 | Caldwell et al. |
| 2002/0007945 | A1 | 1/2002 | Neuroth et al. |
| 2002/0039465 | A1 | 4/2002 | Skinner |
| 2002/0189806 | A1 | 12/2002 | Davidson et al. |
| 2003/0000741 | A1 | 1/2003 | Rosa |
| 2003/0053783 | A1 | 3/2003 | Shirasaki |
| 2003/0056990 | A1 | 3/2003 | Oglesby |
| 2003/0085040 | A1 | 5/2003 | Hemphill et al. |
| 2003/0094281 | A1 | 5/2003 | Tubel |
| 2003/0132029 | A1 | 7/2003 | Parker |
| 2003/0145991 | A1 | 8/2003 | Olsen |
| 2003/0159283 | A1 | 8/2003 | White |
| 2003/0160164 | A1 | 8/2003 | Jones et al. |
| 2003/0226826 | A1 | 12/2003 | Kobayashi et al. |
| 2004/0006429 | A1 | 1/2004 | Brown |
| 2004/0016295 | A1 | 1/2004 | Skinner et al. |
| 2004/0020643 | A1 | 2/2004 | Thomeer et al. |
| 2004/0026127 | A1 | 2/2004 | Masui |
| 2004/0026382 | A1 | 2/2004 | Richerzhagen |
| 2004/0033017 | A1 | 2/2004 | Kringlebotn et al. |
| 2004/0074979 | A1 | 4/2004 | McGuire |
| 2004/0093950 | A1 | 5/2004 | Bohnert |
| 2004/0112642 | A1 | 6/2004 | Krueger et al. |
| 2004/0119471 | A1 | 6/2004 | Blanz et al. |
| 2004/0129418 | A1 | 7/2004 | Jee et al. |
| 2004/0195003 | A1 | 10/2004 | Batarseh |
| 2004/0206505 | A1 | 10/2004 | Batarseh |
| 2004/0207731 | A1 | 10/2004 | Bearman et al. |
| 2004/0211894 | A1 | 10/2004 | Hother et al. |
| 2004/0218176 | A1 | 11/2004 | Shammal et al. |
| 2004/0244970 | A1 | 12/2004 | Smith, Jr. |
| 2004/0252748 | A1 | 12/2004 | Gleitman |
| 2004/0256103 | A1 | 12/2004 | Batarseh |
| 2005/0007583 | A1 | 1/2005 | DiFoggio |
| 2005/0012244 | A1 | 1/2005 | Jones |
| 2005/0034857 | A1 | 2/2005 | Defretin et al. |
| 2005/0094129 | A1 | 5/2005 | MacDougall |
| 2005/0099618 | A1 | 5/2005 | DiFoggio et al. |
| 2005/0115741 | A1 | 6/2005 | Terry et al. |
| 2005/0121235 | A1 | 6/2005 | Larsen et al. |
| 2005/0189146 | A1 | 9/2005 | Oglesby |
| 2005/0201652 | A1 | 9/2005 | Ellwood, Jr. |
| 2005/0230107 | A1 | 10/2005 | McDaniel et al. |
| 2005/0252286 | A1 | 11/2005 | Ibrahim et al. |
| 2005/0263281 | A1 | 12/2005 | Lovell et al. |
| 2005/0268704 | A1 | 12/2005 | Bissonnette et al. |
| 2005/0269132 | A1 | 12/2005 | Batarseh et al. |
| 2005/0272512 | A1 | 12/2005 | Bissonnette et al. |
| 2005/0272513 | A1 | 12/2005 | Bissonnette et al. |
| 2005/0272514 | A1 | 12/2005 | Bissonnette et al. |
| 2005/0282645 | A1 | 12/2005 | Bissonnette et al. |
| 2006/0038997 | A1 | 2/2006 | Julian et al. |
| 2006/0049345 | A1 | 3/2006 | Rao et al. |
| 2006/0065815 | A1 | 3/2006 | Jurca |
| 2006/0070770 | A1 | 4/2006 | Marsh |
| 2006/0102343 | A1 | 5/2006 | Skinner et al. |
| 2006/0118303 | A1 | 6/2006 | Schultz et al. |
| 2006/0137875 | A1 | 6/2006 | Dusterhoft et al. |
| 2006/0185843 | A1 | 8/2006 | Smith, Jr. |
| 2006/0191684 | A1 | 8/2006 | Smith, Jr. |
| 2006/0204188 | A1 | 9/2006 | Clarkson et al. |
| 2006/0207799 | A1 | 9/2006 | Yu |
| 2006/0231257 | A1 | 10/2006 | Reed et al. |
| 2006/0237233 | A1 | 10/2006 | Reed et al. |
| 2006/0260832 | A1 | 11/2006 | McKay |
| 2006/0266522 | A1 | 11/2006 | Eoff et al. |
| 2006/0283592 | A1 | 12/2006 | Sierra et al. |
| 2006/0289724 | A1 | 12/2006 | Skinner et al. |
| 2007/0034409 | A1 | 2/2007 | Dale et al. |
| 2007/0081157 | A1 | 4/2007 | Csutak et al. |
| 2007/0125163 | A1 | 6/2007 | Dria et al. |
| 2007/0193990 | A1 | 8/2007 | Richerzhagen et al. |
| 2007/0217736 | A1 | 9/2007 | Zhang et al. |
| 2007/0227741 | A1 | 10/2007 | Lovell et al. |
| 2007/0242265 | A1 | 10/2007 | Vessereau et al. |
| 2007/0247701 | A1 | 10/2007 | Akasaka et al. |
| 2007/0267220 | A1 | 11/2007 | Magiawala et al. |
| 2007/0278195 | A1 | 12/2007 | Richerzhagen et al. |
| 2007/0280615 | A1 | 12/2007 | de Montmorillon et al. |
| 2008/0023202 | A1 | 1/2008 | Keatch et al. |
| 2008/0053702 | A1 | 3/2008 | Smith, Jr. |
| 2008/0073077 | A1 | 3/2008 | Tunc et al. |
| 2008/0093125 | A1 | 4/2008 | Potter et al. |
| 2008/0112760 | A1 | 5/2008 | Curlett |
| 2008/0128123 | A1 | 6/2008 | Gold |
| 2008/0138022 | A1 | 6/2008 | Tassone |
| 2008/0165356 | A1 | 7/2008 | DiFoggio et al. |
| 2008/0166132 | A1 | 7/2008 | Lynde et al. |
| 2008/0180787 | A1 | 7/2008 | DiGiovanni et al. |
| 2008/0245568 | A1 | 10/2008 | Jeffryes |
| 2008/0273852 | A1 | 11/2008 | Parker et al. |
| 2009/0020333 | A1 | 1/2009 | Marsh |
| 2009/0031870 | A1 | 2/2009 | O'Connor |
| 2009/0033176 | A1 | 2/2009 | Huang et al. |
| 2009/0049345 | A1 | 2/2009 | Mock et al. |
| 2009/0050371 | A1 | 2/2009 | Moeny |
| 2009/0078467 | A1 | 3/2009 | Castillo |
| 2009/0105955 | A1 | 4/2009 | Castillo et al. |
| 2009/0126235 | A1 | 5/2009 | Kobayashi et al. |
| 2009/0133871 | A1 | 5/2009 | Skinner et al. |
| 2009/0133929 | A1 | 5/2009 | Rodland |
| 2009/0139768 | A1 | 6/2009 | Castillo |
| 2009/0166042 | A1 | 7/2009 | Skinner |
| 2009/0190887 | A1 | 7/2009 | Freeland et al. |
| 2009/0194292 | A1 | 8/2009 | Oglesby |
| 2009/0205675 | A1 | 8/2009 | Sarkar et al. |
| 2009/0260834 | A1 | 10/2009 | Henson et al. |
| 2009/0266552 | A1 | 10/2009 | Barra et al. |
| 2009/0266562 | A1 | 10/2009 | Greenaway |
| 2009/0272424 | A1 | 11/2009 | Ortabasi |
| 2009/0272547 | A1 | 11/2009 | Dale et al. |
| 2009/0279835 | A1 | 11/2009 | de Montmorillon et al. |
| 2009/0294050 | A1 | 12/2009 | Traggis et al. |
| 2009/0308852 | A1 | 12/2009 | Alpay et al. |
| 2009/0324183 | A1 | 12/2009 | Bringuier et al. |
| 2010/0000790 | A1 | 1/2010 | Moeny |
| 2010/0001179 | A1 | 1/2010 | Kobayashi et al. |
| 2010/0008631 | A1 | 1/2010 | Herbst |
| 2010/0013663 | A1 | 1/2010 | Cavender et al. |
| 2010/0018703 | A1 | 1/2010 | Lovell et al. |
| 2010/0025032 | A1 | 2/2010 | Smith et al. |
| 2010/0032207 | A1 | 2/2010 | Potter et al. |
| 2010/0044102 | A1 | 2/2010 | Rinzler et al. |
| 2010/0044103 | A1 | 2/2010 | Moxley et al. |
| 2010/0044104 | A1 | 2/2010 | Zediker et al. |
| 2010/0044105 | A1 | 2/2010 | Faircloth et al. |
| 2010/0044106 | A1 | 2/2010 | Zediker et al. |
| 2010/0071794 | A1 | 3/2010 | Homan |
| 2010/0078414 | A1 | 4/2010 | Perry et al. |
| 2010/0084132 | A1 | 4/2010 | Noya et al. |
| 2010/0089571 | A1 | 4/2010 | Revellat et al. |
| 2010/0089574 | A1 | 4/2010 | Wideman et al. |
| 2010/0089576 | A1 | 4/2010 | Wideman et al. |
| 2010/0089577 | A1 | 4/2010 | Wideman et al. |
| 2010/0111474 | A1 | 5/2010 | Satake |
| 2010/0155059 | A1 | 6/2010 | Ullah |
| 2010/0170672 | A1 | 7/2010 | Schwoebel et al. |
| 2010/0170680 | A1 | 7/2010 | McGregor et al. |
| 2010/0187010 | A1 | 7/2010 | Abbasi et al. |
| 2010/0197116 | A1 | 8/2010 | Shah et al. |
| 2010/0215326 | A1 | 8/2010 | Zediker et al. |
| 2010/0218993 | A1 | 9/2010 | Wideman et al. |
| 2010/0224408 | A1 | 9/2010 | Kocis et al. |

(56) References Cited

U.S. PATENT DOCUMENTS

| | | | |
|---|---|---|---|
| 2010/0226135 | A1 | 9/2010 | Chen |
| 2010/0236785 | A1 | 9/2010 | Collis et al. |
| 2010/0326659 | A1 | 12/2010 | Schultz et al. |
| 2010/0326665 | A1 | 12/2010 | Redlinger et al. |
| 2011/0030957 | A1 | 2/2011 | Constantz et al. |
| 2011/0035154 | A1 | 2/2011 | Kendall et al. |
| 2011/0048743 | A1 | 3/2011 | Stafford et al. |
| 2011/0061869 | A1 | 3/2011 | Abass et al. |
| 2011/0079437 | A1 | 4/2011 | Hopkins et al. |
| 2011/0127028 | A1 | 6/2011 | Strickland |
| 2011/0139450 | A1 | 6/2011 | Vasques et al. |
| 2011/0147013 | A1 | 6/2011 | Kilgore |
| 2011/0162854 | A1 | 7/2011 | Bailey et al. |
| 2011/0168443 | A1 | 7/2011 | Smolka |
| 2011/0174537 | A1 | 7/2011 | Potter et al. |
| 2011/0186298 | A1 | 8/2011 | Clark et al. |
| 2011/0198075 | A1 | 8/2011 | Okada et al. |
| 2011/0205652 | A1 | 8/2011 | Abbasi et al. |
| 2011/0220409 | A1 | 9/2011 | Foppe |
| 2011/0240314 | A1 | 10/2011 | Greenaway |
| 2011/0266062 | A1 | 11/2011 | Shuman, V et al. |
| 2011/0278070 | A1 | 11/2011 | Hopkins et al. |
| 2011/0290563 | A1 | 12/2011 | Kocis et al. |
| 2011/0303460 | A1 | 12/2011 | Von Rohr et al. |
| 2012/0000646 | A1 | 1/2012 | Liotta et al. |
| 2012/0012392 | A1 | 1/2012 | Kumar |
| 2012/0012393 | A1 | 1/2012 | Kumar |
| 2012/0020631 | A1 | 1/2012 | Rinzler et al. |
| 2012/0048550 | A1 | 3/2012 | Dusterhoft et al. |
| 2012/0048568 | A1 | 3/2012 | Li et al. |
| 2012/0061091 | A1 | 3/2012 | Radi |
| 2012/0067643 | A1 | 3/2012 | DeWitt et al. |
| 2012/0068086 | A1 | 3/2012 | DeWitt et al. |
| 2012/0068523 | A1 | 3/2012 | Bowles |
| 2012/0074110 | A1 | 3/2012 | Zediker et al. |
| 2012/0103693 | A1 | 5/2012 | Jeffryes |
| 2012/0111578 | A1 | 5/2012 | Tverlid |
| 2012/0118568 | A1 | 5/2012 | Kleefisch et al. |
| 2012/0118578 | A1 | 5/2012 | Skinner |
| 2012/0217015 | A1 | 8/2012 | Zediker et al. |
| 2012/0217017 | A1 | 8/2012 | Zediker et al. |
| 2012/0217018 | A1 | 8/2012 | Zediker et al. |
| 2012/0217019 | A1 | 8/2012 | Zediker et al. |
| 2012/0248078 | A1 | 10/2012 | Zediker et al. |
| 2012/0255774 | A1 | 10/2012 | Grubb et al. |
| 2012/0255933 | A1 | 10/2012 | McKay et al. |
| 2012/0261188 | A1 | 10/2012 | Zediker et al. |
| 2012/0266803 | A1 | 10/2012 | Zediker et al. |
| 2012/0267168 | A1 | 10/2012 | Grubb et al. |
| 2012/0273269 | A1 | 11/2012 | Rinzler et al. |
| 2012/0273470 | A1 | 11/2012 | Zediker et al. |
| 2012/0275159 | A1 | 11/2012 | Fraze et al. |
| 2013/0011102 | A1 | 1/2013 | Rinzler et al. |

FOREIGN PATENT DOCUMENTS

| | | | |
|---|---|---|---|
| EP | 0 565 287 | A1 | 10/1993 |
| EP | 0 950 170 | B1 | 9/2002 |
| FR | 2 716 924 | A1 | 9/1995 |
| GB | 1 284 454 | | 8/1972 |
| GB | 2420358 | B | 5/2006 |
| JP | 1987-011804 | | 1/1987 |
| JP | 1993-118185 | | 5/1993 |
| JP | 1993-33574 | | 9/1993 |
| JP | 09072738 | A | 3/1997 |
| JP | 09-242453 | A | 9/1997 |
| JP | 2000-334590 | A | 12/2000 |
| JP | 2001-208924 | | 8/2001 |
| JP | 2003-239673 | | 8/2003 |
| JP | 2004-108132 | | 4/2004 |
| JP | 2004-108132 | A | 4/2004 |
| JP | 2006-039147 | | 2/2006 |
| JP | 2006-509253 | | 3/2006 |
| JP | 2006-307481 | A | 11/2006 |
| JP | 2007-120048 | A | 5/2007 |
| JP | 2008-242012 | | 10/2008 |
| WO | WO 95/32834 | A1 | 12/1995 |
| WO | WO 97/49893 | A1 | 12/1997 |
| WO | WO 98/50673 | A1 | 11/1998 |
| WO | WO 98/56534 | A1 | 12/1998 |
| WO | WO 02/057805 | A2 | 7/2002 |
| WO | WO 03/027433 | A1 | 4/2003 |
| WO | WO 03/060286 | A1 | 7/2003 |
| WO | WO 2004/009958 | A1 | 1/2004 |
| WO | WO2004/052078 | | 6/2004 |
| WO | WO 2004/094786 | A1 | 11/2004 |
| WO | WO 2005/001232 | A2 | 1/2005 |
| WO | WO 2005/001239 | A1 | 1/2005 |
| WO | WO 2006/008155 | A1 | 1/2006 |
| WO | WO 2006/041565 | A1 | 4/2006 |
| WO | WO 2006/054079 | A1 | 5/2006 |
| WO | WO 2007/002064 | A1 | 1/2007 |
| WO | WO 2007/112387 | A2 | 10/2007 |
| WO | WO 2007/136485 | A2 | 11/2007 |
| WO | WO 2008/016852 | A1 | 2/2008 |
| WO | WO 2008/070509 | A2 | 6/2008 |
| WO | WO 2008/085675 | A1 | 7/2008 |
| WO | WO 2009/042774 | A2 | 4/2009 |
| WO | WO 2009/042781 | A2 | 4/2009 |
| WO | WO 2009/042785 | A2 | 4/2009 |
| WO | WO 2009/131584 | A1 | 10/2009 |
| WO | WO 2010/036318 | A1 | 4/2010 |
| WO | WO 2010/060177 | A1 | 6/2010 |
| WO | WO 2010/087944 | A1 | 8/2010 |
| WO | WO 2011/008544 | A2 | 1/2011 |
| WO | WO 2011/032083 | A1 | 3/2011 |
| WO | WO 2011/041390 | A2 | 4/2011 |
| WO | WO 2011/075247 | A2 | 6/2011 |
| WO | WO 2011/106078 | A2 | 9/2011 |
| WO | WO 2012/003146 | A2 | 1/2012 |
| WO | WO 2012/012006 | A1 | 1/2012 |
| WO | WO 2012/027699 | A1 | 3/2012 |
| WO | WO 2012/064356 | A1 | 5/2012 |
| WO | WO 2012/116189 | A2 | 8/2012 |

OTHER PUBLICATIONS

U.S. Appl. No. 12/544,094, filed Aug. 19, 2009, Faircloth et al.
U.S. Appl. No. 12/543,968, filed Aug. 19, 2009, Rinzler et al.
U.S. Appl. No. 12/544,136, filed Aug. 19, 2009, Zediker et al.
U.S. Appl. No. 12/544,038, filed Aug. 19, 2009, Zediker et al.
U.S. Appl. No. 12/706,576, filed Feb. 16, 2010, Zediker et al.
U.S. Appl. No. 12/840,978, filed Jul. 21, 2010, Rinzler et al.
U.S. Appl. No. 12/896,021, filed Oct. 1, 2010, Underwood et al.
U.S. Appl. No. 13/034,017, filed Feb. 24, 2011, Zediker et al.
U.S. Appl. No. 13/034,037, filed Feb. 24, 2011, Zediker et al.
U.S. Appl. No. 13/034,175, filed Feb. 24, 2011, Zediker et al.
U.S. Appl. No. 13/034,183, filed Feb. 24, 2011, Zediker et al.
U.S. Appl. No. 13/211,729, filed Aug. 17, 2011, DeWitt et al.
U.S. Appl. No. 13/222,931, filed Aug. 31, 2011, Zediker et al.
U.S. Appl. No. 13/347,445, filed Jan. 10, 2012, Zediker et al.
U.S. Appl. No. 13/366,882, filed Feb. 6, 2012, McKay et al.
U.S. Appl. No. 13/403,132, filed Feb. 23, 2012, Zediker et al.
U.S. Appl. No. 13/403,287, filed Feb. 23, 2012, Grubb et al.
U.S. Appl. No. 13/403,615, filed Feb. 23, 2012, Grubb et al.
U.S. Appl. No. 13/403,692, filed Feb. 23, 2012, Zediker et al.
U.S. Appl. No. 13/403,723, filed Feb. 23, 2012, Rinzler et al.
U.S. Appl. No. 13/403,509, filed Feb. 23, 2012, Fraze et al.
U.S. Appl. No. 13/403,741, filed Feb. 23, 2012, Zediker et al.
U.S. Appl. No. 13/486,795, filed Feb. 23, 2012, Rinzler et al.
U.S. Appl. No. 13/768,149, filed Feb. 15, 2013, Zediker et al.
U.S. Appl. No. 13/565,345, filed Aug. 2, 2012, Zediker et al.
U.S. Appl. No. 13/782,869, filed Mar. 1, 2013, Schroit et al.
U.S. Appl. No. 13/782,942, filed Mar. 1, 2013, Norton et al.
U.S. Appl. No. 13/777,650, filed Feb. 26, 2013, Zediker et al.
U.S. Appl. No. 13/800,559, filed Mar. 13, 2013, Zediker et al.
U.S. Appl. No. 13/800,879, filed Mar. 13, 2013, Zediker et al.
U.S. Appl. No. 13/800,933, filed Mar. 13, 2013, Zediker et al.
U.S. Appl. No. 13/849,831, filed Mar. 25, 2013, Zediker et al.

(56) References Cited

OTHER PUBLICATIONS

International Search Report and Written Opinion for PCT App. No. PCT/US10/24368, dated Nov. 2, 2010, 16 pgs.
International Search Report for PCT Application No. PCT/US09/54295, dated Apr. 26, 2010, 16 pgs.
International Search Report for PCT Application No. PCT/US2011/044548, dated Jan. 24, 2012, 17 pgs.
International Search Report for PCT Application No. PCT/US2011/047902, dated Jan. 17, 2012, 9 pgs.
International Search Report for PCT Application No. PCT/US2011/050044 dated Feb. 1, 2012, 26 pgs.
International Search Report for PCT Application No. PCT/US2012/026277, dated May 30, 2012, 11 pgs.
International Search Report for PCT Application No. PCT/US2012/026265, dated May 30, 2012, 14 pgs.
International Search Report for PCT Application No. PCT/US2012/026280, dated May 30, 2012, 12 pgs.
International Search Report for PCT Application No. PCT/US2012/026337, dated Jun. 7, 2012, 21 pgs.
International Search Report for PCT Application No. PCT/US2012/026471, dated May 30, 2012, 13 pgs.
International Search Report for PCT Application No. PCT/US2012/026525, dated May 31, 2012, 8 pgs.
International Search Report for PCT Application No. PCT/US2012/026526, dated May 31, 2012, 10 pgs.
International Search Report for PCT Application No. PCT/US2012/026494, dated May 31, 2012, 12 pgs.
International Search Report for PCT Application No. PCT/US2012/020789, dated Jun. 29, 2012, 9 pgs.
International Search Report for PCT Application No. PCT/US2012/040490, dated Oct. 22, 2012, 14 pgs.
International Search Report for PCT Application No. PCT/US2012/049338, dated Jan. 22, 2013, 14 pgs.
Abdulagatova, Z. et al., "Effect of Temperature and Pressure on the Thermal Conductivity of Sandstone", *International Journal of Rock Mechanics & Mining Sciences*, vol. 46, 2009, pp. 1055-1071.
Abousleiman, Y. et al., "Poroelastic Solution of an Inclined Borehole in a Transversely Isotropic Medium", *Rock Mechanics*, Daemen & Schultz (eds), 1995, pp. 313-318.
Ackay, H. et al., Paper titled "Orthonormal Basis Functions for Continuous-Time Systems and Lp Convergence", date unknown but prior to Aug. 19, 2009, pp. 1-12.
Acosta, A. et al., paper from X Brazilian MRS meeting titled "Drilling Granite With Laser Light", X Encontro da SBPMat Granado-RS, Sep. 2011, 4 pages including pp. 56 and 59.
Agrawal Dinesh et al., "Microstructural By TEM of WC/Co composites Prepared by Conventional and Microwave Processes", Materials Research Lab, The Pennsylvania State University, *15th International Plansee Seminar*, vol. 2, , 2001, pp. 677-684.
Agrawal Dinesh et al., Report on "Development of Advanced Drill Components for BHA Using Mircowave Technology Incorporating Carbide Diamond Composites and Functionally Graded Materials", Microwave Processing and Engineering Center, Material Research Institute, The Pennsylvania State University, 2003, 10 pgs.
Agrawal Dinesh et al., Report on "Graded Steele-Tungsten Cardide/Cobalt-Diamond Systems Using Microwave Heating", Material Research Institute, Penn State University, *Proceedings of the 2002 International Conference on Functionally Graded Materials*, 2002, pp. 50-58.
Agrawal, Govind P., "Nonlinear Fiber Optics", Chap. 9, Fourth Edition, Academic Press copyright 2007, pp. 334-337.
Ahmadi, M. et al., "The Effect of Interaction Time and Saturation of Rock on Specific Energy in ND:YAG Laser Perforating", *Optics and Laser Technology*, vol. 43, 2011, pp. 226-231.
Ai, H.A. et al., "Simulation of dynamic response of granite: A numerical approach of shock-induced damage beneath impact craters", *International Journal of Impact Engineering*, vol. 33, 2006, pp. 1-10.
Akhatov, I. et al., "Collapse and Rebound of a Laser-Induced Cavitation Bubble", *Physics of Fluids*, vol. 13, No. 10, Oct. 2001, pp. 2805-2819.
Albertson, M. L. et al., "Diffusion of Submerged Jets", a paper for the *American Society of Civil Engineers*, Nov. 5, 1852, pp. 1571-1596.
Al-Harthi, A. A. et al., "The Porosity and Engineering Properties of Vesicular Basalt in Saudi Arabia", *Engineering Geology*, vol. 54, 1999, pp. 313-320.
Anand, U. et al., "Prevention of Nozzle Wear in Abrasive Water Suspension Jets (AWSJ) Using PoroLubricated Nozzles", *Transactions of the ASME*, vol. 125, Jan. 2003, pp. 168-181.
Andersson, J. C. et al., "The Aspo Pillar Stability Experiment: Part II—Rock Mass Response to Coupled Excavation-Induced and Thermal-Induced Stresses", *International Journal of Rock Mechanics & Mining Sciences*, vol. 46, 2009, pp. 879-895.
Anovitz, L. M. et al., "A New Approach to Quantification of Metamorphism Using Ultra-Small and Small Angle Neutron Scattering", *Geochimica et Cosmochimica Acta*, vol. 73, 2009, pp. 7303-7324.
Anton, Richard J. et al., "Dynamic Vickers indentation of brittle materials", *Wear*, vol. 239, 2000, pp. 27-35.
Antonucci, V. et al., "Numerical and Experimental Study of a Concentrated Indentation Force on Polymer Matrix Composites", an excerpt from the *Proceedings of the COMSOL Conference*, 2009, 4 pages.
Aptukov, V. N., "Two Stages of Spallation", publisher unknown, while the date of the publication is unknown, it is believed to be prior to Aug. 19, 2009, 6 pages.
Ashby, M. F. et al., "The Failure of Brittle Solids Containing Small Cracks Under Compressive Stress States", *Acta Metall.*, vol. 34, No. 3,1986, pp. 497-510.
ASTM International, "Standard Test Method for Thermal Conductivity of Solids by Means of the Guarded-Comparative-Longitudinal Heat Flow Technique", Standard under the fixed Designation E1225-09, 2009, pp. 1-9.
Atkinson, B. K., "Introduction to Fracture Mechanics and Its Geophysical Applications", *Fracture Mechanics of Rock*, 1987, pp. 1-26.
Aubertin, M. et al., "A Multiaxial Stress Criterion for Short- and Long-Term Strength of Isotropic Rock Media", *International Journal of Rock Mechanics & Mining Sciences*, vol. 37, 2000, pp. 1169-1193.
Author unknown, by RIO Technical Services, "Sub-Task 1: Current Capabilities of Hydraulic Motors, Air/Nitrogen Motors, and Electric Downhole Motors", a final report for Department of Energy National Petroleum Technology Office for the Contract Task 03NT30429, Jan. 30, 2004, 26 pages.
Avar, B. B. et al., "Porosity Dependence of the Elastic Modulof Lithophysae-rich Tuff: Numerical and Experimental Investigations", *International Journal of Rock Mechanics & Mining Sciences*, vol. 40, 2003, pp. 919-928.
Aydin, A. et al., "The Schmidt hammer in rock material characterization", *Engineering Geology*, vol. 81, 2005, pp. 1-14.
Backers, T. et al., "Tensile Fracture Propagation and Acoustic Emission Activity in Sandstone: The Effect of Loading Rate", *International Journal of Rock Mechanics & Mining Sciences*, vol. 42, 2005, pp. 1094-1101.
Baek, S.Y. et al., "Simulation of the Coupled Thermal/Optical Effects for Liquid Immersion Micro-/Nanolithography", source unknown, believed to be publically available prior to 2012,13 pages.
Baflon, Jean-Paul et al., "On the Relationship Between the Parameters of Paris' Law for Fatigue Crack Growth in Aluminium Alloys", *Scripta Metallurgica*, vol. 11, No. 12, 1977, pp. 1101-1106.
Bagatur, T. et al., "Air-entrainment Characteristics in a Plunging Water Jet System Using Rectangular Nozzles with Rounded Ends", *Water SA*, vol. 29, No. 1, Jan. 2003, pp. 35-38.
Bailo, El Tahir et al., "Spectral signatures and optic coefficients of surface and reservoir shales and limestones at COIL, $CO_2$ and Nd:YAG laser wavelengths", *Petroleum Engineering Department, Colorado School of Mines*, 2004, 13 pgs.
Baird, J. A. "GEODYN: A Geological Formation/Drillstring Dynamics Computer Program", *Society of Petroleum Engineers of AIME*, 1964, 9 pgs.

(56) References Cited

OTHER PUBLICATIONS

Baird, J. A. et al., "Analyzing the Dynamic Behavior of Downhole Equipment During Drilling", government Sandia Report, SAND-84-0758C, DE84 008840, 7 pages.
Baird, Jerold et al., Phase 1 Theoretical Description, A Geological Formation Drill String Dynamic Interaction Finite Element Program (GEODYN), *Sandia National Laboratories*, Report No. Sand-84-7101, 1984, 196 pgs.
Batarseh, S. I. et al, "Innovation in Wellbore Perforation Using High-Power Laser", *International Petroleum Technology Conference*, IPTC No. 10981, Nov. 2005, 7 pages.
Batarseh, S. et al. "Well Perforation Using High-Power Lasers", *Society of Petroleum Engineers*, SPE 84418, 2003, pp. 1-10.
Batarseh, S. et al., "Well Perforation Using High-Power Lasers", a paper prepared for presentation at the SPE (Society of Petroleum Engineers) Annual Technical Conference and Exhibition, SPE No. 84418, Oct. 2003, 10 pages.
Baykasoglu, A. et al., "Prediction of Compressive and Tensile Strength of Limestone via Genetic Programming", *Expert Systems with Applications*, vol. 35, 2008, pp. 111-123.
BDM Corporation, Geothermal Completion Technology Life-Cycle Cost Model (GEOCOM), *Sandia National Laboratories*, for the U.S. Dept. of Energy, vols. 1 and 2, 1982, 222 pgs.
Bechtel SAIC Company LLC, "Heat Capacity Analysis", a report prepared for Department of Energy, Nov. 2004, 100 pages.
Belushi, F. et al., "Demonstration of the Power of Inter-Disciplinary Integration to Beat Field Development Challenges in Complex Brown Field-South Oman", *Society of Petroleum Engineers*, a paper prepared for presentation at the Abu Dhabi International Petroleum Exhibition & Conference, SPE No. 137154, Nov. 2010, 18 pages.
Belyaev, V. V., "Spall Damage Modelling and Dynamic Fracture Specificities of Ceramics", *Journal of Materials Processing Technology*, vol. 32, 1992, pp. 135-144.
Benavente, D. et al., "The Combined Influence of Mineralogical, Hygric and Thermal Properties on the Durability of PoroBuilding Stones", *Eur. J. Mineral*, vol. 20, Aug. 2008, pp. 673-685.
Beste, U. et al., "Micro-scratch evaluation of rock types—a means to comprehend rock drill wear", *Tribology International*, vol. 37, 2004, pp. 203-210.
Bieniawski, Z. T., "Mechanism of Brittle Fracture of Rock: Part I—Theory of the Fracture Process", *Int. J. Rock Mech. Min. Sci.*, vol. 4, 1967, pp. 395-406.
Bilotsky, Y. et al., "Modelling Multilayers Systems with Time-Depended Heaviside and New Transition Functions", excerpt from the Proceedings of the 2006 Nordic COMSOL Conference, 2006, 4 pages.
Birkholzer, J. T. et al., "The Impact of Fracture—Matrix Interaction on Thermal—Hydrological Conditions in Heated Fractured Rock", an origial research paper published online http://vzy.scijournals.org/cgi/content/full/5/2/657, May 26, 2006, 27 pages.
Blackwell, B. F., "Temperature Profile in Semi-infinite Body With Exponential Source and Convective Boundary Condition", *Journal of Heat Transfer, Transactions of the ASME*, vol. 112, 1990, pp. 567-571.
Blackwell, D. D. et al., "Geothermal Resources in Sedimentary Basins", a presentation for the Geothermal Energy Generation in Oil and Gas Settings, Mar. 13, 2006, 28 pages.
Blair, S. C. et al., "Analysis of Compressive Fracture in Rock Using Statistical Techniques: Part I. A Non-linear Rule-based Model", *Int. J. Rock Mech. Min. Sci.*, vol. 35 No. 7, 1998, pp. 837-848.
Blomqvist, M. et al., "All-in-Quartz Optics for Low Focal Shifts", *SPIE Photonics West Conference in San Francisco*, Jan. 2011, 12 pages.
Boechat, A. A. P. et al., "Bend Loss in Large Core Multimode Optical Fiber Beam Delivery Systems", *Applied Optics.*, vol. 30 No. 3, Jan. 20, 1991, pp. 321-327.
Bolme, C. A., "Ultrafast Dynamic Ellipsometry of Laser Driven Shock Waves", a dissertation for the degree of Doctor of Philosophy in Physical Chemistry at Massachusetts Institute of Technology, Sep. 2008, pp. 1-229.
Britz, Dieter, "Digital Simulation in Electrochemistry", *Lect. Notes Phys.*, vol. 666, 2005, pp. 103-117.
Brown, G., "Development, Testing and Track Record of Fiber-Optic, Wet-Mate, Connectors", *IEEE*, 2003, pp. 83-88.
Browning, J. A. et al., "Recent Advances in Flame Jet Working of Minerals", *7th Symposium on Rock Mechanics*, Pennsylvania State Univ., 1965, pp. 281-313.
Brujan, E. A. et al., "Dynamics of Laser-Induced Cavitation Bubbles Near an Elastic Boundar", *J. Fluid Mech.*, vol. 433, 2001, pp. 251-281.
Burdine, N. T., "Rock Failure Under Dynamic Loading Conditions", Society of Petroleum Engineers Journal, Mar. 1963, pp. 1-8.
Bybee, K., "Modeling Laser-Spallation Rock Drilling", *JPT*, an SPE available at www.spe.org/jpt, Feb. 2006, 2 pages 62-63.
Bybee, Karen, highlight of "Drilling a Hole in Granite Submerged in Water by Use of CO2 Laser", an SPE available at www.spe.org/jpt, *JPT*, Feb. 2010, pp. 48, 50 and 51.
Cai, W. et al., "Strength of Glass from Hertzian Line Contact", *Optomechanics 2011: Innovations and Solutions*, 2011, 5 pages.
Capetta, I. S. et al., "Fatigue Damage Evaluation on Mechanical Components Under Multiaxial Loadings", European Comsol Conference, University of Ferrara, Oct. 16, 2009, 25 pages.
Cardenas, R., "Protected Polycrystalline Diamond Compact Bits for Hard Rock Drilling", Report No. DOE-99049-1381, *U.S. Department of Energy*, 2000, pp. 1-79.
Carstens, J. P. et al., "Rock Cutting by Laser", a paper of *Society of Petroleum Engineers of AIME*, 1971, 11 pages.
Carstens, Jeffrey et al., "Heat-Assisted Tunnel Boring Machines", *Federal Railroad Administration and Urban Mass Transportation Administration*, U.S. Dept. of Transportation, Report No. FRA-RT-71-63, 1970, 340 pgs.
Caruso, C. et al., "Dynamic Crack Propagation in Fiber Reinforced Composites", Excerpt from the Proceedings of the COMSOL Conference, 2009, 5 pages.
Chastain, T. et al., "Deepwater Drilling Riser System", *SPE Drilling Engineering*, Aug. 1986, pp. 325-328.
Chen, H. Y. et al., "Characterization of the Austin Chalk Producing Trend", *SPE*, a paper prepared for presentation at the 61st Annual Technical Conference and Exhibition of the Society of Petroleum Engineers, SPE No. 15533, Oct. 1986, pp. 1-12.
Chen, K., paper titled "Analysis of Oil Film Interferometry Implementation in Non-Ideal Conditions", source unknown, Jan. 7, 2010, pp. 1-18.
Chraplyvy, A. R., "Limitations on Lightwave Communications Imposed by Optical-Fiber Nonlinearities", *Journal of Lightwave Technology*, vol. 8 No. 10, Oct. 1990, pp. 1548-1557.
Churcher, P. L. et al., "Rock Properties of Berea Sandstone, Baker Dolomite, and Indiana Limestone", a paper prepared for presentation at the SPE International Symposium on Oilfield Chemistry), *SPE*, SPE No. 21044, Feb. 1991, pp. 431-446 and 3 additional pages.
Cimetiere, A. et al., "A Damage Model for Concrete Beams in Compression", *Mechanics Research Communications*, vol. 34, 2007, pp. 91-96.
Clegg, John et al., "Improved Optimisation of Bit Selection Using Mathematically Modelled Bit-Performance Indices", *IADC/SPE International 102287*, 2006, pp. 1-10.
Close, F. et al., "Successful Drilling of Basalt in a West of Shetland Deepwater Discovery", a paper prepared for presentation at Offshore Europe 2005 by SPE (Society of Petroleum Engineers) Program Committee, SPE No. 96575, Sep. 2005, pp. 1-10.
Close, F. et al., "Successful Drilling of Basalt in a West of Shetland Deepwater Discovery", *SPE International 96575*, Society of Petroleum Engineers, 2006, pp. 1-10.
Cobern, Martin E., "Downhole Vibration Monitoring & Control System Quarterly Technical Report #1", *APS Technology, Inc.*, Quarterly Technical Report #1, DVMCS, 2003, pp. 1-15.
Cogotsi, G. A. et al., "Use of Nondestructive Testing Methods in Evaluation of Thermal Damage for Ceramics Under Conditions of Nonstationary Thermal Effects", *Institute of Strength Problems, Academy of Sciences of the Ukrainian SSR*, 1985, pp. 52-56.

(56) References Cited

OTHER PUBLICATIONS

Cohen, J. H., "High-Power Slim-Hole Drilling System", a paper presented at the conference entitled Natural Gas RD&D Contractor's Review Meeting, Office of Scientific and Technical Information, Apr. 1995, 10 pages.
Cone, C., "Case History of the University Block 9 (Wolfcamp) Field—Gas-Water Injection Secondary Recovery Project", *Journal of Petroleum Technology*, Dec. 1970, pp. 1485-1491.
Contreras, E. et al., "Effects of Temperature and Stress on the Compressibilities, Thermal Expansivities, and Porosities of Cerro Prieto and Berea Sandstones to 9000 PSI and 208 degrees Celsius", Proceedings Eighth Workshop Geothermal Reservoir Engineering, Leland Stanford Junior University, Dec. 1982, pp. 197-203.
Cook, Troy, "Chapter 23, Calculation of Estimated Ultimate Recovery (EUR) for Wells in Continuous-Type Oil and Gas Accumulations", *U.S. Geological Survey Digital Data Series DDS-69-D*, Denver, Colorado: Version 1, 2005, pp. 1-9.
Cooper, R., "Coiled Tubing Deployed ESPs Utilizing Internally Installed Power Cable—A Project Update", a paper prepared by SPE (Society of Petroleum Engineers) Program Committee for presentation at the 2nd North American Coiled Tubing Roundtable, SPE 38406, Apr. 1997, pp. 1-6.
Coray, P. S. et al., "Measurements on 5:1 Scale Abrasive Water Jet Cutting Head Models", source unknown, available prior to 2012, 15 pages.
Cruden, D. M., "The Static Fatigue of Brittle Rock Under Uniaxial Compression", *Int. J. Rock Mech. Min. Sci. & Geomech. Abstr.*, vol. 11, 1974, pp. 67-73.
da Silva, B. M. G., "Modeling of Crack Initiation, Propagation and Coalescence in Rocks", a thesis for the degree of Master of Science in Civil and Environmental Engineering at the Massachusetts Institute of Technology, Sep. 2009, pp. 1-356.
Dahl, F. et al., "Development of a New Direct Test Method for Estimating Cutter Life, Based on the Sievers' J Miniature Drill Test", *Tunnelling and Underground Space Technology*, vol. 22, 2007, pp. 106-116.
Dahl, Filip et al., "Development of a new direct test method for estimating cutter life, based on the Sievers J miniature drill test", *Tunnelling and Underground Space Technology*, vol. 22, 2007, pp. 106-116.
Damzen, M. J. et al., "Stimulated Brillion Scattering", Chapter 8—SBS in Optical Fibres, OP Publishing Ltd, Published by Institute of Physics, London, England, 2003, pp. 137-153.
Das, A. C. et al., "Acousto-ultrasonic study of thermal shock damage in castable refractory", *Journal of Materials Science Letters*, vol. 10, 1991, pp. 173-175.
de Castro Lima, J. J. et al., "Linear Thermal Expansion of Granitic Rocks: Influence of Apparent Porosity, Grain Size and Quartz Content", *Bull Eng Geol Env.*, 2004, vol. 63, pp. 215-220.
De Guire, Mark R., "Thermal Expansion Coefficient (start)", *EMSE 201—Introduction to Materials Science & Engineering*, 2003, pp. 15.1-15.15.
Degallaix, J. et al., "Simulation of Bulk-Absorption Thermal Lensing in Transmissive Optics of Gravitational Waves Detector", *Appl. Phys.*, B77, 2003, pp. 409-414.
Dey, T. N. et al., "Some Mechanisms of Microcrack Growth and Interaction in Compressive Rock Failure", *Int. J. Rock Mech. Min. Sci. & Geomech. Abstr.*, vol. 18, 1981, pp. 199-209.
Diamond-Cutter Drill Bits, by Geothermal Energy Program, Office of Geothermal and Wind Technologies, 2000, 2 pgs.
Dimotakis, P. E. et al., "Flow Structure and Optical Beam Propagation in High-Reynolds-Number Gas-Phase Shear Layers and Jets", *J. Fluid Mech.*, vol. 433, 2001, pp. 105-134.
Dinζer, Ismail et al., "Correlation between Schmidt hardness, uniaxial compressive strength and Young's modulfor andesites, basalts and tuffs", *Bull Eng Geol Env*, vol. 63, 2004, pp. 141-148.
Dole, L. et al., "Cost-Effective CementitioMaterial Compatible with Yucca Mountain Repository Geochemistry", a paper prepared by Oak Ridge National Laboratory for the Department of Energy, No. ORNL/TM-2004/296, Dec. 2004, 128 pages.
Dumans, C. F. F. et al., "PDC Bit Selection Method Through the Analysis of Past Bit Performances", a paper prepared for presentation at the *SPE* (Society of Petroleum Engineers—Latin American Petroleum Engineering Conference), Oct. 1990, pp. 1-6.
Dunn, James C., "Geothermal Technology Development at Sandia", *Geothermal Research Division, Sandia National Laboratories*, 1987, pp. 1-6.
Dutton, S. P. et al., "Evolution of Porosity and Permeability in the Lower CretaceoTravis Peak Formation, East Texas", *The American Association of Petroleum Geologists Bulletin*, vol. 76, No. 2, Feb. 1992, pp. 252-269.
Dyskin, A. V. et al., "Asymptotic Analysis of Crack Interaction with Free Boundary", *International Journal of Solids and Structure*, vol. 37, 2000, pp. 857-886.
Eckel, J. R. et al., "Nozzle Design and its Effect on Drilling Rate and Pump Operation", a paper presented at the spring meeting of the Southwestern District, Division of Production, Beaumont, Texas, Mar. 1951, pp. 28-46.
Ehrenberg, S. N. et al., "Porosity-Permeability Relationship in Interlayered Limestone-Dolostone Reservoir", *The American Association of Petroleum Geologists Bulletin*, vol. 90, No. 1, Jan. 2006, pp. 91-114.
Eichler, H.J. et al., "Stimulated Brillouin Scattering in Multimode Fibers for Optical Phase Conjugation", *Optics Communications*, vol. 208, 2002, pp. 427-431.
Eighmy, T. T. et al., "Microfracture Surface Charaterizations: Implications for In Situ Remedial Methods in Fractured Rock", *Bedrock Bioremediation Center, Final Report, National Risk Management Research Laboratory, Office of Research and Development, U.S. Environmental Protection Agency*, EPA/600/R-05/121, 2006, pp. 1-99.
Elsayed, M.A. et al., "Measurement and analysis of Chatter in a Compliant Model of a Drillstring Equipped With a PDC Bit", *Mechanical Engineering Dept., University of Southwestern Louisiana* and *Sandia National Laboratories*, 2000, pp. 1-10.
Ersoy, A., "Wear Characteristics of PDC Pin and Hybrid Core Bits in Rock Drilling", *Wear*, vol. 188, 1995, pp. 150-165.
Extreme Coil Drilling, by Extreme Drilling Corporation, 2009, 10 pgs.
Falcao, J. L. et al., "PDC Bit Selection Through Cost Prediction Estimates Using Crossplots and Sonic Log Data", *SPE*, a paper prepared for presentation at the 1993 SPE/IADC Drilling Conference, Feb. 1993, pp. 525-535.
Falconer, I. G. et al., "Separating Bit and Lithology Effects from Drilling Mechanics Data", *SPE*, a paper prepared for presentation at the 1988 IADC/SPE Drilling Conference, Feb./Mar. 1988, pp. 123-136.
Farra, G., "Experimental Observations of Rock Failure Due to Laser Radiation", a thesis for the degree of Master of Science at Massachusetts Institute of Technology, Jan. 1969, 128 pages.
Farrow, R. L. et al., "Peak-Power Limits on Fiber Amplifiers Imposed by Self-Focusing", *Optics Letters*, vol. 31, No. 23, Dec. 1, 2006, pp. 3423-3425.
Ferro, D. et al., "Vickers and Knoop hardness of electron beam deposited ZrC and HfC thin films on titanium", *Surface & Coatings Technology*, vol. 200, 2006, pp. 4701-4707.
Fertl, W. H. et al., "Spectral Gamma-Ray Logging in the Texas Austin Chalk Trend", *SPE of AIME*, a paper for Journal of Petroleum Technology, Mar. 1980, pp. 481-488.
Field, F. A., "A Simple Crack-Extension Criterion for Time-Dependent Spallation", *J. Mech. Phys. Solids*, vol. 19, 1971, pp. 61-70.
Figueroa, H. et al., "Rock removal using high power lasers for petroleum exploitation purposes", *Gas Technology Institute, Colorado School of Mines, Halliburton Energy Services, Argonne National Laboratory*, 2002, pp. 1-13.
Finger, J. T. et al., "PDC Bit Research at Sandia National Laboratories", Sandia Report No. SAND89-0079-UC-253, a report prepared for Department of Energy, Jun. 1989, 88 pages.
Finger, John T. et al., "PDC Bit Research at Sandia National Laboratories", Sandia Report, *Geothermal Research Division 6252, Sandia National Laboratories*, SAND89-0079-UC-253, 1989, pp. 1-88.

(56) References Cited

OTHER PUBLICATIONS

Freeman, T. T. et al., "THM Modeling for Reservoir Geomechanical Applications", presented at the COMSOL Conference, Oct. 2008, 22 pages.
Friant, J. E. et al., "Disc Cutter Technology Applied to Drill Bits", a paper prepared by Exacavation Engineering Associates, Inc. for the Department of Energy's Natural Gas Conference, Mar. 1997, pp. 1-16.
Fuerschbach, P. W. et al., "Understanding Metal Vaporization from Laser Welding", Sandia Report No. SAND-2003-3490, a report prepared for DOE, Sep. 2003, pp. 1-70.
Gahan, B. C. et al., "Analysis of Efficient High-Power Fiber Lasers for Well Perforation", *SPE*, No. 90661, a paper prepared for presentation at the SPE Annual Technical Conference and Exhibition, Sep. 2004, 9 pages.
Gahan, B. C. et al., "Effect of Downhole Pressure Conditions on High-Power Laser Perforation", *SPE*, No. 97093, a paper prepared for the 2005 SPE (Society of Petroleum Engineers) Annual Technical Conference and Exhibition, Oct. 12, 2005, 7 pages.
Gahan, B. C. et al., "Laser Drilling: Drilling with the Power of Light, Phase 1: Feasibility Study", a Topical Report by the *Gas Technology Institute*, for the Government under Cooperative Agreement No. DE-FC26-00NT40917, Sep. 30, 2001, 107 pages.
Gahan, B. C. et al., "Laser Drilling: Determination of Energy Required to Remove Rock", *Society of Petroleum Engineers International*, SPE 71466, 2001, pp. 1-11.
Gahan, B. C., et al., "Laser Drilling—Drilling with the Power of Light: High Energy Laser Perforation and Completion Techniques", Annual Technical Progress Report by the *Gas Technology Institute*, to the Department of Energy, Nov. 2006, 94 pages.
Gahan, Brian C. et al. "Analysis of Efficient High-Power Fiber Lasers for Well Perforation", *Society of Petroleum Engineers*, SPE 90661, 2004, pp. 1-9.
Gahan, Brian C. et al. "Efficient of Downhole Pressure Conditions on High-Power Laser Perforation", *Society of Petroleum Engineers*, SPE 97093, 2005, pp. 1-7.
Gahan, Brian C. et al., "Laser Drilling: Drilling with the Power of Light, Phase 1: Feasibility Study", *Topical Report*, Cooperative Agreement No. DE-FC26-00NT40917, 2000-2001, pp. 1-148.
Gale, J. F. W. et al., "Natural Fractures in the Barnett Shale and Their Importance for Hydraulic Fracture Treatments", The American Assoction of Petroleum Geologists, *AAPG Bulletin*, vol. 91, No. 4, Apr. 2007, pp. 603-622.
Gardner, R. D. et al., "Flourescent Dye Penetrants Applied to Rock Fractures", *Int. J. Rock Mech. Min. Sci.*, vol. 5, 1968, pp. 155-158 with 2 additional pages.
Gelman, A., "Multi-level (hierarchical) modeling: what it can and can't do", source unknown, Jun. 1, 2005, pp. 1-6.
Gerbaud, L. et al., "PDC Bits: All Comes From the Cutter/Rock Interaction", SPE, No. IADC/SPE 98988, a paper presented at the IADC/SPE Drilling Conference, Feb. 2006, pp. 1-9.
Glowka, David A. et al., "Program Plan for the Development of Advanced Synthetic-Diamond Drill Bits for Hard-Rock Drilling", *Sandia National Laboratories*, SAND 93/1953, 1993, pp. 1-50.
Glowka, David A. et al., "Progress in the Advanced Synthetic-Diamond Drill Bit Program", *Sandia National Laboratories*, SAND95-2617C, 1994, pp. 1-9.
Glowka, David A., "Design Considerations for a Hard-Rock PDC Drill Bit", *Geothermal Technology Development Division 6241, Sandia National Laboratories*, SAND-85-0666C, DE85 008313, 1985, pp. 1-23.
Glowka, David A., "Development of a Method for Predicting the Performance and Wear of PDC Drill Bits", *Sandia National Laboratories*, SAND86-1745-UC-66c, 1987, pp. 1-206.
Glowka, David A., "The Use of Single-Cutter Data in the Analysis of PDC Bit Designs", *61st Annual Technical Conference and Exhibition of Society of Petroleum Engineers*, 1986, pp. 1-37.
Gonthier, F. "High-power All-Fiber® components: The missing link for high power fiber fasers", source unknown, 11 pages.
Graves, R. M. et al., "Comparison of Specific Energy Between Drilling With High Power Lasers and Other Drilling Methods", *SPE*, No. SPE 77627, a paper presented at the SPE (Society of Petroleum Engineers) Annual Technical Conference and Exhibiton, Sep. 2002, pp. 1-8.
Graves, R. M. et al., "Spectral signatures and optic coeffecients of surface and reservoir rocks at COIL, CO2 and Nd:YAG laser wavelenghts", source unknown, 13 pages.
Graves, R. M. et al., "StarWars Laser Technology Applied to Drilling and Completing Gas Wells", *SPE*, No. 49259, a paper prepared for presentation at the 1998 SPE Annual Technical Conference and Exhibition, 1998, 761-770.
Graves, Ramona M. et al., "Application of High Power Laser Technology to Laser/Rock Destruction: Where Have We Been? Where Are We Now?", *SW AAPG Convention*, 2002, pp. 213-224.
Graves, Ramona M. et al., "Laser Parameters That Effect Laser-Rock Interaction: Determining the Benefits of Applying Star Wars Laser Technology for Drilling and Completing Oil and Natural Gas Wells", Topical Report, *Petroleum Engineering Department, Colorado School of Mines*, 2001, pp. 1-157.
Green, D. J. et al., "Crack Arrest and Multiple Crackling in Glass Through the Use of Designed Residual Stress Profiles", *Science*, vol. 283, No. 1295, 1999, pp. 1295-1297.
Grigoryan, V., "InhomogeneoBoundary Value Problems", a lecture for Math 124B, Jan. 26, 2010, pp. 1-5.
Grigoryan, V., "Separathion of variables: Neumann Condition", a lecture for Math 124A, Dec. 1, 2009, pp. 1-3.
Gunn, D. A. et al., "Laboratory Measurement and Correction of Thermal Properties for Application to the Rock Mass", *Geotechnical and Geological Engineering*, vol. 23, 2005, pp. 773-791.
Guo, B. et al., "Chebyshev Rational Spectral and Pseudospectral Methods on a Semi-infinite Interval", *Int. J. Numer. Meth. Engng*, vol. 53, 2002, pp. 65-84.
Gurarie, V. N., "Stress Resistance Parameters of Brittle Solids Under Laser/Plasma Pulse Heating", *Materials Science and Engineering*, vol. A288, 2000, pp. 168-172.
Habib, P. et al., "The Influence of Residual Stresses on Rock Hardness", *Rock Mechanics*, vol. 6, 1974, pp. 15-24.
Hagan, P. C., "The Cuttability of Rock Using a High Pressure Water Jet", University of New South Wales, Sydney, Australia, obtained form the Internet on Sep. 7, 2010, at: http://www.mining.unsw.edu.au/Publications/publications_staff/Paper_Hagan_WASM.htm, 16 pages.
Hall, K. et al., "Rock Albedo and Monitoring of Thermal Conditions in Respect of Weathering: Some Expected and Some Unexpected Results", *Earth Surface Processes and Landforms*, vol. 30, 2005, pp. 801-811.
Hall, Kevin, "The role of thermal stress fatigue in the breakdown of rock in cold regions", *Geomorphology*, vol. 31, 1999, pp. 47-63.
Hammer, D. X. et al., "Shielding Properties of Laser-Induced Breakdown in Water for Pulse Durations from 5 ns to 125 fs", *Applied Optics*, vol. 36, No. 22, Aug. 1, 1997, pp. 5630-5640.
Han, Wei, "Computational and experimental investigations of laser drilling and welding for microelectronic packaging", *Dorchester Polytechnic Institute*, A Dissertation submitted in May 2004, 242 pgs.
Hancock, M. J., "The 1-D Heat Equation: 18.303 Linear Partial Differential Equations", source unknown, 2004, pp. 1-41.
Hareland, G. et al., "Drag—Bit Model Including Wear", *SPE*, No. 26957, a paper prepared for presentation at the Latin American/Caribbean Petroleum Engineering Conference, Apr. 1994, pp. 657-667.
Hareland, G. et al., "Cutting Efficiency of a Single PDC Cutter on Hard Rock", *Journal of Canadian Petroleum Technology*, vol. 48, No. 6, 2009, pp. 1-6.
Hareland, G., et al., "A Drilling Rate Model for Roller Cone Bits and Its Application", *SPE*, No. 129592, a paper prepared for presentation at the CPS/SPE International Oil and Gas Conference and Exhibition, Jun. 2010, pp. 1-7.
Harrison, C. W. III et al., "Reservoir Characterization of the Frontier Tight Gas Sand, Green River Basin, Wyoming", *SPE*, No. 21879, a paper prepared for presentation at the Rocky Mountain Regional Meeting and Low-Permeability Reservoirs Symposium, Apr. 1991, pp. 717-725.

(56) References Cited

OTHER PUBLICATIONS

Hashida, T. et al., "Numerical Simulation with Experimental Verification of the Fracture Behavior in Granite Under Confining Pressures based on the Tension-Softening Model", *International Journal of Fracture*, vol. 59, 1993, pp. 227-244.
Hasting, M. A. et al., "Evaluation of the Environmental Impacts of Induced Seismicity at the Naknek Geothermal Energy Project, Naknek, Alaska", a final report prepared for ASRC Energy Services Alaska Inc., May 2010, pp. 1-33.
Head, P. et al., "Electric Coiled Tubing Drilling (E-CTD) Project Update", *SPE*, No. 68441, a paper prepared for presentation at the SPE/CoTA Coiled Tubing Roundtable, Mar. 2001, pp. 1-9.
Healy, Thomas E., "Fatigue Crack Growth in Lithium Hydride", *Lawrence Livermore National Laboratory*, 1993, pp. 1-32.
Hettema, M. H. H. et al., "The Influence of Steam Pressure on Thermal Spalling of Sedimentary Rock: Theory and Experiments", *Int. J. Rock Mech. Min. Sci.*, vol. 35, No. 1, 1998, pp. 3-15.
Hibbs, Louis E. et al., "Wear Machanisms for Polycrystalline-Diamond Compacts as Utilized fro Drilling in Geothermal Environments", *Sandia National Laboratories*, for the United States Government, Report No. SAND-82-7213, 1983, 287 pgs.
Hoek, E., "Fracture of Anisotropic Rock", *Journal of the South African Institute of Mining and Metallurgy*, vol. 64, No. 10, 1964, pp. 501-523.
Hood, M., "Waterjet-Assisted Rock Cutting Systems—The Present State of the Art", *International Journal of Mining Engineering*, vol. 3, 1985, pp. 91-111.
Hoover, Ed R. et al., "Failure Mechanisms of Polycrystalline-Diamond Compact Drill Bits in Geothermal Environments", Sandia Report, *Sandia National Laboratories*, SAND81-1404, 1981, pp. 1-35.
Howard, A. D. et al., "VOLAN Interpretation and Application in the Bone Spring Formation (Leonard Series) in Southeastern New Mexico", *SPE*, No. 13397, a paper presented at the 1984 SPE Production Technology Symposium, Nov. 1984, 10 pages.
Howells, G., "Super-Water [R] Jetting Applications from 1974 to 1999", paper presented st the Proceedings of the 10th American Waterjet Confeence in Houston, Texas, 1999, 25 pages.
Hu, H. et al., "SimultaneoVelocity and Concentration Measurements of a Turbulent Jet Mixing Flow", *Ann. N. Y. Acad. Sci.*, vol. 972, 2002, pp. 254-259.
Huang, C. et al., "A Dynamic Damage Growth Model for Uniaxial Compressive Response of Rock Aggregates", *Mechanics of Materials*, vol. 34, 2002, pp. 267-277.
Huang, H. et al., "Intrinsic Length Scales in Tool-Rock Interaction", *International Journal of Geomechanics*, Jan./Feb. 2008, pp. 39-44.
Huenges, E. et al., "The Stimulation of a Sedimentary Geothermal Reservoir in the North German Basin: Case Study Grob Schonebeck", *Proceedings, Twenty-Ninth Workshop on Geothermal Reservoir Engineering*, Stanford University, Stanford, California, Jan. 26-28, 2004, 4 pages.
Huff, C. F. et al., "Recent Developments in Polycrystalline Diamond-Drill-Bit Design", *Drilling Technology Division—4741, Sandia National Laboratories*, 1980, pp. 1-29.
Hutchinson, J. W., "Mixed Mode Cracking in Layered Materials", *Advances in Applied Mechanics*, vol. 29, 1992, pp. 63-191.
IADC Dull Grading System for Fixed Cutter Bits, by Hughes Christensen, 1996, 14 pgs.
Imbt, W. C. et al., "Porosity in Limestone and Dolomite Petroleum Reservoirs", paper presented at the Mid Continent District, Division of Production, Oklahoma City, Oklahoma, Jun. 1946, pp. 364-372.
Jackson, M. K. et al., "Nozzle Design for Coherent Water Jet Production", source unknown, believed to be published prior to 2012, pp. 53-89.
Jadoun, R. S., "Study on Rock-Drilling Using PDC Bits for the Prediction of Torque and Rate of Penetration", *Int. J. Manufacturing Technology and Management*, vol. 17, No. 4, 2009, pp. 408-418.
Jain, R. K. et al., "Development of Underwater Laser Cutting Technique for Steel and Zircaloy for Nuclear Applications", *Journal of Physics for Indian Academy of Sciences*, vol. 75 No. 6, Dec. 2010, pp. 1253-1258.
Jen, C. K. et al., "Leaky Modes in Weakly Guiding Fiber Acoustic Waveguides", *IEEE Transactions on Ultrasonic Ferroelectrics and Frequency Control*, vol. UFFC-33 No. 6, Nov. 1986, pp. 634-643.
Jimeno, Carlos Lopez et al., Drilling and Blasting of Rocks, *a. a. Balkema* Publishers, 1995, 30 pgs.
Judzis, A. et al., "Investigation of Smaller Footprint Drilling System; Ultra-High Rotary Speed Diamond Drilling Has Potential for Reduced Energy Requirements", IADC/SPE No. 99020, 33 pages.
Jurewicz, B. R., "Rock Excavation with Laser Assistance", *Int. J. Rock Mech. Min. Sci. & Geomech. Abstr.*, vol. 13, 1976, pp. 207-219.
Kahraman, S. et al., "Dominant rock properties affecting the penetration rate of percussive drills", *International Journal of Rock Mechanics and Mining Sciences*, 2003, vol. 40, pp. 711-723.
Karakas, M., "Semianalytical Productivity Models for Perforated Completions", *SPE*, No. 18247, a paper for SPE (Society of Petroleum Engineers) Production Engineering, Feb. 1991, pp. 73-82.
Karasawa, H. et al., "Development of PDC Bits for Downhole Motors", *Proceedings 17th NZ Geothermal Workshop*, 1995, pp. 145-150.
Kelsey, James R., "Drilling Technology/GDO", *Sandia National Laboratories*, SAND-85-1866c, DE85 017231, 1985, pp. 1-7.
Kemeny, J. M., "A Model for Non-linear Rock Deformation Under Compression Due to Sub-critical Crack Growth", *Int. J. Rock Mech. Min. Sci. & Geomech. Abstr.*, vol. 28 No. 6, 1991, pp. 459-467.
Kerr, Callin Joe, "PDC Drill Bit Design and Field Application Evolution", *Journal of Petroleum Technology*, 1988, pp. 327-332.
Ketata, C. et al., "Knowledge Selection for Laser Drilling in the Oil and Gas Industry", *Computer Society*, 2005, pp. 1-6.
Khan, Ovais U. et al., "Laser heating of sheet metal and thermal stress development", *Journal of Materials Processing Technology*, vol. 155-156, 2004, pp. 2045-2050.
Khandelwal, M., "Prediction of Thermal Conductivity of Rocks by Soft Computing", *Int. J. Earth Sci.* (*Geo/. Rundsch*), May 11, 2010, 7 pages.
Kim, C. B. et al., "Measurement of the Refractive Index of Liquids at 1.3 and 1.5 Micron Using a Fibre Optic Fresnel Ratio Meter", *Meas. Sci. Technol.*,vol. 5, 2004, pp. 1683-1686.
Kim, K. R. et al., "$CO_2$ laser-plume interaction in materials processing", *Journal of Applied Physics*, vol. 89, No. 1, 2001, pp. 681-688.
Kiwata, T. et al., "Flow Visualization and Characteristics of a Coaxial Jet with a Tabbed Annular Nozzle", *JSME International Journal Series B*, vol. 49, No. 4, 2006, pp. 906-913.
Klotz, K. et al., "Coatings with intrinsic stress profile: Refined creep analysis of (Ti,A1)N and cracking due to cyclic laser heating", *Thin Solid Films*, vol. 496, 2006, pp. 469-474.
Kobayashi, T. et al., "Drilling a 2-inch in Diameter Hole in Granites Submerged in Water by CO2 Lasers", *SPE*, No. 119914, a paper prepared for presentation at the SPE/IADC Drilling Conference and Exhibition, Mar. 2009, 6 pages.
Kobayashi, Toshio et al., "Drilling a 2-inch in Diameter Hole in Granites Submerged in Water by $CO_2$ Lasers", *SPE International, IADC 119914 Drilling Conference and Exhibition*, 2009, pp. 1-11.
Kobyakov, A. et al., "Design Concept for Optical Fibers with Enhanced SBS Threshold", *Optics Express*, vol. 13, No. 14, Jul. 11, 2005, pp. 5338-5346.
Kolari, K., "Damage Mechanics Model for Brittle Failure of Transversely Isotropic Solids (Finite Element Implementation)", *VTT Publications 628*, 2007, 210 pages.
Kollé, J. J., "A Comparison of Water Jet, Abrasive Jet and Rotary Diamond Drilling in Hard Rock", *Tempress Technologies Inc.*, 1999, pp. 1-8.
Kolle, J. J., "HydroPulse Drilling", a Final Report for Department of Energy under Cooperative Development Agreement No. DE-FC26-FT34367, Apr. 2004, 28 pages.
Kovalev, V. I. et al., "Observation of Hole Burning in Spectrum in SBS in Optical Fibres Under CW Monochromatic Laser Excitation", IEEE, Jun. 3, 2010, pp. 56-57.

(56) References Cited

OTHER PUBLICATIONS

Koyamada, Y. et al., "Simulating and Designing Brillouin Gain Spectrum in Single-Mode Fibers", *Journal of Lightwave Technology*, vol. 22, No. 2, Feb. 2004, pp. 631-639.
Krajcinovic, D. et al., "A Micromechanical Damage Model for Concrete", *Engineering Fracture Mechanics*, vol. 25, No. 5/6, 1986, pp. 585-596.
Kranz, R. L., "Microcracks in Rocks: A Review", *Tectonophysics*, vol. 100, 1983, pp. 449-480.
Kubacki, Emily et al., "Optics for Fiber Laser Applications", *CVI Laser, LLC*, Technical Reference Document #20050415, 2005, 5 pgs.
Kujawski, Daniel, "A fatigue crack driving force parameter with load ratio effects", *International Journal of Fatigue*, vol. 23, 2001, pp. S239-S246.
Labuz, J. F. et al., "Experiments with Rock: Remarks on Strength and Stability Issues", *International Journal of Rock Mechanics & Mining Science*, vol. 44, 2007, pp. 525-537.
Labuz, J. F. et al., "Size Effects in Fracture of Rock", *Rock Mechanics for Industry*, Amadei, Kranz, Scott & Smeallie (eds), 1999, pp. 1137-1143.
Labuz, J. F. et al., "Microrack-dependent fracture of damaged rock", *International Journal of Fracture*, vol. 51, 1991, pp. 231-240.
Lacy, Lewis L,, "Dynamic Rock Mechanics Testing for Optimized Fracture Designs", *Society of Petroleum Engineers International, Annual Technical Conference and Exhibition*, 1997, pp. 23-36.
Lally, Evan M., "A Narrow-Linewidth Laser at 1550 nm Using the Pound-Drever-Hall Stabilization Technique", *Thesis*, submitted to Virginia Polytechnic Institute and State University, Blacksburg, Virginia, 2006, 92 pgs.
Langeveld, C. J., "PDC Bit Dynamics", a paper prepared for presentation at the 1992 IADC/SPE Drilling Conference, Feb. 1992, pp. 227-241.
Lau, John H., "Thermal Fatigue Life Prediction of Flip Chip Solder Joints by Fracture Mechanics Method", *Engineering Fracture Mechanics*, vol. 45, No. 5, 1993, pp. 643-654.
Lee, S. H. et al., "Themo-Poroelastic Analysis of Injection-Induced Rock Deformation and Damage Evolution", *Proceedings Thirty-Fifth Workshop on Geothermal Reservoir Engineering*, Feb. 2010, 9 pages.
Lee, Y. W. et al., "High-Power Yb3+ Doped Phosphate Fiber Amplifier", *IEEE Journal of Selected Topics in Quantum Electronics*, vol. 15, No. 1, Jan./Feb. 2009, pp. 93-102.
Legarth, B. et al., "Hydraulic Fracturing in a Sedimentary Geothermal Reservoir: Results and Implications", *International Journal of Rock Mechanics & Mining Sciences*, vol. 42 , 2005, pp. 1028-1041.
Lehnhoff, T. F. et al., "The Influence of Temperature Dependent Properties on Thermal Rock Fragmentation", *Int. J. Rock Mech. Min. Sci. & Geomech. Abstr.*, vol. 12, 1975, pp. 255-260.
Leong, K. H. et al., "Lasers and Beam Delivery for Rock Drilling", *Argonne National Laboratory*, ANL/TD/TM03-01, 2003, pp. 1-35.
Leong, K. H., "Modeling Laser Beam-Rock Interaction", a report prepared for Department of Energy (http://www.doe.gov/bridge), 8 pages.
Leung, M. et al., "Theoretical study of heat transfer with moving phase-change interface in thawing of frozen food", *Journal of Physics D: Applied Physics*, vol. 38, 2005, pp. 477-482.
Li, Q. et al., "Experimental Research on Crack Propagation and Failure in Rock-type Materials under Compression", *EJGE*, vol. 13, Bund. D, 2008, p. 1-13.
Li, X. B. et al., "Experimental Investigation in the Breakage of Hard Rock by the PDC Cutters with Combined Action Modes", *Tunnelling and Underground Space Technology*, vol. 16., 2001, pp. 107-114.
Liddle, D. et al., "Cross Sector Decommissioning Workshop", presentation, Mar. 23, 2011, 14 pages.
Lima, R. S. et al., "Elastic ModulMeasurements via Laser-Ultrasonic and Knoop Indentation Techniques in Thermally Sprayed Coatings", *Journal of Thermal Spray Technology*, vol. 14(1), 2005, pp. 52-60.
Lin, Y. T., "The Impact of Bit Performance on Geothermal-Well Cost", *Sandia National Laboratories*, SAND-81-1470C, 1981, pp. 1-6.
Lindholm, U. S. et al., "The Dynamic Strength and Fracture Properties of Dresser Basalt", *Int. J. Rock Mech. Min. Sci. & Geomech. Abstr.*, vol. 11, 1974, pp. 181-191.
Loland, K. E., "ContinuoDamage Model for Load-Response Estimation of Concrete", *Cement and Concrete Research*, vol. 10, 1980, pp. 395-402.
Lomov, I. N. et al., "Explosion in the Granite Field: Hardening and Softening Behavior in Rocks", *U.S. Department of Energy, Lawrence Livermore National Laboratory*, 2001, pp. 1-7.
Long, S. G. et al., "Thermal fatigue of particle reinforced metal-matrix composite induced by laser heating and mechanical load", *Composites Science and Technology*, vol. 65, 2005, pp. 1391-1400.
Lorenzana, H. E. et al., "Metastability of Molecular Phases of Nitrogen: Implications to the Phase Diagram", a manuscript submitted to the European Hight Pressure Research Group 39 Conference, *Advances on High Pressure*, Sep. 21, 2001, 18 pages.
Lubarda, V. A. et al., "Damage Model for Brittle Elastic Solids with Unequal Tensile and Compressive Strengths", *Engineering Fracture Mechanics*, vol. 29, No. 5, 1994, pp. 681-692.
Lucia, F. J. et al., "Characterization of Diagenetically Altered Carbonate Reservoirs, South Cowden Grayburg Reservoir, West Texas", a paper prepared for presentation at the 1996 SPE Annual Technical Conference and Exhibition, Oct. 1996, pp. 883-893.
Luffel, D. L. et al., "Travis Peak Core Permeability and Porosity Relationships at Reservoir Stress", *SPE Formation Evaluation*, Sep. 1991, pp. 310-318.
Luft, H. B. et al., "Development and Operation of a New Insulated Concentric Coiled Tubing String for ContinuoSteam Injection in Heavy Oil Production", Conference Paper published by Society of Petroleum Engineers on the Internet at: (http://www.onepetro.org/mslib/servlet/onepetropreview?id=00030322), on Aug. 8, 2012, 1 page.
Lund, M. et al., "Specific Ion Binding to Macromolecules: Effect of Hydrophobicity and Ion Pairing", *Langmuir*, 2008 vol. 24, 2008, pp. 3387-3391.
Lyons, K. David et al., "NETL Extreme Drilling Laboratory Studies High Pressure High Temperature Drilling Phenomena", *U.S. Department of Energy, National Energy Technology Laboratory*, 2007, pp. 1-6.
Manrique, E. J. et al., "EOR Field Experiences in Carbonate Reservoirs in the United States", *SPE Reservoir Evaluation & Engineering*, Dec. 2007, pp. 667-686.
Maqsood, A. et al., "Thermophysical Properties of PoroSandstones: Measurement and Comparative Study of Some Representative Thermal Conductivity Models", *International Journal of Thermophysics*, vol. 26, No. 5, Sep. 2005, pp. 1617-1632.
Marcuse, D., "Curvature Loss Formula for Optical Fibers", *J. Opt. Soc. Am.*, vol. 66, No. 3, 1976, pp. 216-220.
Marshall, David B. et al., "Indentation of Brittle Materials", *Microindentation Techniques in Materials Science and Engineering, ASTM STP 889; American Society for Testing and Materials*, 1986, pp. 26-46.
Martin, C. D., "Seventeenth Canadian Geotechnical Colloquium: The Effect of Cohesion Loss and Stress Path on Brittle Rock Strength", *Canadian Geotechnical Journal*, vol. 34, 1997, pp. 698-725.
Martins, A. et al., "Modeling of Bend Losses in Single-Mode Optical Fibers", Institutu de Telecomunicacoes, Portugal, 3 pages.
Maurer, W. C. et al., "Laboratory Testing of High-Pressure, High-Speed PDC Bits", a paper prepared for presentation at the 61st Annual Technical Conference and Exhibition of the Society of Petroleum Engineers, Oct. 1986, pp. 1-8.
Maurer, William C., "Advanced Drilling Techniques", published by Petroleum Publishing Co., copyright 1980, 26 pgs.
Maurer, William C., "Novel Drilling Techniques", published by Pergamon Press, UK, copyright 1968, pp. 1-64.
Mazerov, Katie, "Bigger coil sizes, hybrid rigs, rotary steerable advances push coiled tubing drilling to next level", *Drilling Contractor*, 2008, pp. 54-60.

(56) References Cited

OTHER PUBLICATIONS

McElhenny, John E. et al., "Unique Characteristic Features of Stimulated Brillouin Scattering in Small-Core Photonic Crystal Fibers", *J. Opt. Soc. Am. B*, vol. 25, No. 4, 2008, pp. 582-593.
McKenna, T. E. et al., "Thermal Conductivity of Wilcox and Frio Sandstones in South Texas (Gulf of Mexico Basin)", *AAPG Bulletin*, vol. 80, No. 8, Aug. 1996, pp. 1203-1215.
Medvedev, I. F. et al., "Optimum Force Characteristics of Rotary-Percussive Machines for Drilling Blast Holes", Moscow, Translated from *Fiziko-Tekhnicheskie Problemy Razrabotki Poleznykh Iskopaemykh*, No. 1, 1967, pp. 77-80.
Meister, S. et al., "Glass Fibers for Stimulated Brillouin Scattering and Phase Conjugation", *Laser and Particle Beams*, vol. 25, 2007, pp. 15-21.
Mejia-Rodriguez, G. et al., "Multi-Scale Material Modeling of Fracture and Crack Propagation", Final Project Report in Multi-Scale Methods in Applied Mathematics, while the date of the publication is unknown, it is believed to be prior to Aug. 19, 2009, pp. 1-9.
Mensa-Wilmot, G. et al., "New PDC Bit Technology, Improved Drillability Analysis, and Operational Practices Improve Drilling Performance in Hard and Highly HeterogeneoApplications", a paper prepared for the 2004 SPE (Society of Petroleum Engineers) Eastern Regional Meeting, Sep. 2004, pp. 1-14.
Mensa-Wilmot, Graham et al., "Advanced Cutting Structure Improves PDC Bit Performance in Hard and Abrasive Drilling Environments", *Society of Petroleum Engineers International*, 2003, pp. 1-13.
Messaoud, Louafi, "Influence of Fluids on the Essential Parameters of Rotary Percussive Drilling", Laboratoire d'Environnement (Tébessa), vol. 14, 2009, pp. 1-8.
Messica, A. et al., "Theory of Fiber-Optic Evanescent-Wave Spectroscopy and Sensor", *Applied Optics*, vol. 35, No. 13, May 1, 1996, pp. 2274-2284.
Mills, W. R. et al., "Pulsed Neutron Porosity Logging", SPWLA Twenty-Ninth Annual Logging Symposium, Jun. 1988, pp. 1-21.
Mirkovich, V. V., "Experimental Study Relating Thermal Conductivity to Thermal Piercing of Rocks", *Int. J. Rock Mech. Min. Sci.*, vol. 5, 1968, pp. 205-218.
Mittelstaedt, E. et al., "A Noninvasive Method for Measuring the Velocity of Diffuse Hydrothermal Flow by Tracking Moving Refractive Index Anomalies", *Geochemistry Geophysics Geosystems*, vol. 11, No. 10, Oct. 8, 2010, pp. 1-18.
Moavenzadeh, F. et al., "Thin Disk Technique for Analyzing Fock Fractures Induced by Laser Irradiation", a report prepared for the Department of Transportation under Contract C-85-65, May 1968, 91 pages.
Mocofanescu, A. et al., "SBS threshold for single mode and multimode GRIN fibers in an all fiber configuration", *Optics Express*, vol. 13, No. 6, 2005, pp. 2019-2024.
Montross, C. S. et al., "Laser-Induced Shock Wave Generation and Shock Wave Enhancement in Basalt", *International Journal of Rock Mechanics and Mining Sciences*, 1999, pp. 849-855.
Moradian, Z. A. et al., "Predicting the Uniaxial Compressive Strength and Static Young's Modulof Intact Sedimentary Rocks Using the Ultrasonic Test", *International Journal of Geomechanics*, vol. 9, No. 1, 2009, pp. 14-19.
Morozumi, Y. et al., "Growth and Structures of Surface Disturbances of a Round Liquid Jet in a Coaxial Airflow", *Fluid Dynamics Research*, vol. 34, 2004, pp. 217-231.
Morse, J. W. et al., "Experimental and Analytic Studies to Model Reaction Kinetics and Mass Transport of Carbon Dioxide Sequestration in Depleted Carbonate Reservoirs", a Final Scientific/Technical Report for DOE, while the date of the publication is unknown, it is believed to be prior to Aug. 19, 2009, 158 pages.
Moshier, S. O., "Microporosity in Micritic Limestones: A Review", *Sedimentary Geology*, vol. 63, 1989, pp. 191-213.
Mostafa, M. S. et al., "Investigation of Thermal Properties of Some Basalt Samples in Egypt", *Journal of Thermal Analysis and Calorimetry*, vol. 75, 2004, pp. 178-188.
Mukhin, I. B. et al., "Experimental Study of Kilowatt-Average-Power Faraday Isolators", OSA/ASSP, 2007, 3 pages.
Multari, R. A. et al., "Effect of Sampling Geometry on Elemental Emissions in Laser-Induced Breakdown Spectroscopy", *Applied Spectroscopy*, vol. 50, No. 12, 1996, pp. 1483-1499.
Munro, R. G., "Effective Medium Theory of the Porosity Dependence of Bulk Moduli", *Communications of American Ceramic Society*, vol. 84, No. 5, 2001, pp. 1190-1192.
Murphy, H. D., "Thermal Stress Cracking and Enhancement of Heat Extraction from Fractured Geothermal Reservoirs", a paper submitted to the Geothermal Resource Council for its 1978 Annual Meeting, Jul. 1978, 7 pages.
Murrell, S. A. F. et al., "The Effect of Temperature on the Strength at High Confining Pressure of Granodiorite Containing Free and Chemically-Bound Water", *Mineralogy and Petrology*, vol. 55, 1976, pp. 317-330.
Muto, Shigeki et al., "Laser cutting for thick concrete by multi-pass technique", *Chinese Optics Letters*, vol. 5 Supplement, 2007, pp. S39-S41.
Myung, I. J., "Tutorial on Maximum Likelihood Estimation", *Journal of Mathematical Psychology*, vol. 47, 2003, pp. 90-100.
Nakano, A. et al., "Visualization for Heat and Mass Transport Phenomena in Supercritical Artificial Air", *Cryogenics*, vol. 45, 2005, pp. 557-565.
Naqavi, I. Z. et al., "Laser heating of multilayer assembly and stress levels: elasto-plastic consideration", *Heat and Mass Transfer*, vol. 40, 2003, pp. 25-32.
Nara, Y. et al., "Study of Subcritical Crack Growth in Andesite Using the Double Torsion Test", *International Journal of Rock Mechanics & Mining Sciences*, vol. 42, 2005, pp. 521-530.
Nara, Y. et al., "Sub-critical crack growth in anisotropic rock", *International Journal of Rock Mechanics and Mining Sciences*, vol. 43, 2006, pp. 437-453.
Nemat-Nasser, S. et al., "Compression-Induced Nonplanar Crack Extension With Application to Splitting, Exfoliation, and Rockburst", *Journal of Geophysical Research*, vol. 87, No. B8, 1982, pp. 6805-6821.
Nicklaus, K. et al., "Optical Isolator for Unpolarized Laser Radiation at Multi-Kilowatt Average Power", *Optical Society of America*, 2005, 3 pages.
Nikles, M. et al., "Brillouin Gain Spectrum Characterization in Single-Mode Optical Fibers", *Journal of Lightwave Technology*, vol. 15, No. 10, Oct. 1997, pp. 1842-1851.
Nilsen, B. et al., "Recent Developments in Site Investigation and Testing for Hard Rock TBM Projects", *1999 RETC Proceedings*, 1999, pp. 715-731.
Nimick, F. B., "Empirical Relationships Between Porosity and the Mechanical Properties of Tuff", *Key Questions in Rock Mechanics*, Cundall et al. (eds), 1988, pp. 741-742.
Nolen-Hoeksema, R., "Fracture Development and Mechnical Stratigraphy of Austin Chalk, Texas: Discussion", a discussion for The American Association of Petroleum Geologists Bulletin, vol. 73, No. 6, Jun. 1989, pp. 792-793.
O'Hare, Jim et al., "Design Index: A Systematic Method of PDC Drill-Bit Selection", *Society of Petroleum Engineers International*, IADC/SPE Drilling Conference, 2000, pp. 1-15.
Oglesby, K. et al., "Advanced Ultra High Speed Motor for Drilling", a project update by Impact Technologies LLC for the Department of Energy, Sep. 12, 2005, 36 pages.
Okon, P. et al., "Laser Welding of Aluminium Alloy 5083", *21st International Congress on Applications of Lasers and Electro-Optics*, 2002, pp. 1-9.
Olsen, F. O., "Fundamental Mechanisms of Cutting Front Formation in Laser Cutting", *SPIE*, vol. 2207, pp. 402-413.
Ortega, Alfonso et al., "Frictional Heating and Convective Cooling of Polycrystalline Diamond Drag Tools During Rock Cutting", Report No. SAND 82-0675c, *Sandia National Laboratories*, 1982, 23 pgs.
Ortega, Alfonso et al., "Studies of the Frictional Heating of Polycrystalline Diamond Compact Drag Tools During Rock Cutting", *Sandia National Laboratories*, SAND-80-2677, 1982, pp. 1-151.

(56) References Cited

OTHER PUBLICATIONS

Ortiz, Blas et al., Improved Bit Stability Reduces Downhole Harmonics (Vibrations), *International Association of Drilling Contractors/Society of Petroleum Engineers Inc.*, 1996, pp. 379-389.
Ouyang, L. B. et al., "General Single Phase Wellbore Flow Model", a report prepared for the COE/PETC, May 2, 1997, 51 pages.
Palashchenko, Yuri A., "Pure Rolling of Bit Cones Doubles Performance", *I & Gas Journal*, vol. 106, 2008, 8 pgs.
Palchaev, D. K. et al., "Thermal Expansion of Silicon Carbide Materials", *Journal of Engineering Physics and Thermophysics*, vol. 66, No. 6, 1994, 3 pages.
Pardoen, T. et al., "An extended model for void growth and Coalescence", *Journal of the Mechanics and Physics of Solids*, vol. 48, 2000, pp. 2467-2512.
Park, Un-Chul et al., "Thermal Analysis of Laser Drilling Processes", *IEEE Journal of Quantum Electronics*, 1972, vol. QK-8, No. 2, 1972, pp. 112-119.
Parker, R. et al., "Drilling Large Diameter Holes in Rocks Using Multiple Laser Beams (504)", while the date of the publication is unknown, it is believed to be prior to Aug. 19, 2009, 6 pages.
Parker, Richard A. et al., "Laser Drilling Effects of Beam Application Methods on Improving Rock Removal", *Society of Petroleum Engineers*, SPE 84353, 2003, pp. 1-7.
Patricio, M. et al., "Crack Propagation Analysis", while the date of the publication is unknown, it is believed to be prior to Aug. 19, 2009, 24 pages.
Pavlina, E. J. et al., "Correlation of Yield Strength and Tensile Strength with Hardness for Steels", *Journals of Materials Engineering and Performance*, vol. 17, No. 6, 2008, pp. 888-893.
Peebler, R. P. et al., "Formation Evaluation with Logs in the Deep Anadarko Basin", *SPE of AIME*, 1972, 15 pages.
Pepper, D. W. et al., "Benchmarking COMSOL Multiphysics 3.5a—CFD Problems", a presentation, Oct. 10, 2009, 54 pages.
Percussion Drilling Manual, by Smith Tools, 2002, 67 pgs.
Pettitt, R. et al., "Evolution of a Hybrid Roller Cone/PDC Core Bit", a paper prepared for Geothermal Resources Council 1980 Annual Meeting, Sep. 1980, 7 pages.
Phani, K. K. et al., "Pororsity Dependence of Ultrasonic Velocity and Elastic Modulin Sintered Uranium Dioxide—a discussion", *Journal of Materials Science Letters*, vol. 5, 1986, pp. 427-430.
Ping, Cao et al., "Testing study of subcritical crack growth rate and fracture toughness in different rocks", *Transactions of NonferroMetals Society of China*, vol. 16, 2006, pp. 709-714.
Plinninger, Dr. Ralf J. et al., "Wear Prediction in Hardrock Excavation Using the CERCHAR Abrasiveness Index (CAI)", *EUROCK 2004 & 53rd Geomechanics Colloquium. Schubert (ed.)*, VGE, 2004, pp. 1-6.
Plinninger, R. J. et al., "Wear Prediction in Hardrock Excavation Using the CERCHAR Abrasiveness Index (CAI)", EUROCK 2004 & 53rd Geomechanics Colloquium, 2004, 6 pages.
Plinninger, Ralf J. et al., "Predicting Tool Wear in Drill and Blast", *Tunnels & Tunneling International Magazine*, 2002, pp. 1-5.
Plumb, R. A. et al., "Influence of Composition and Texture on Compressive Strength Variations in the Travis Peak Formation", a paper prepared for presentation at the 67th Annual Technical Conference and Exhibition of the Society of Petroleum Engineers, Oct. 1992, pp. 985-998.
Polsky, Yarom et al., "Enhanced Geothermal Systems (EGS) Well Construction Technology Evaluation Report", *Sandia National Laboratories*, Sandia Report, SAND2008-7866, 2008, pp. 1-108.
Pooniwala, S. et al., "Lasers: The Next Bit", a paper prepared for the presentation at the 2006 SPE (Society of Petroleum Engineers) Eastern Regional Meeting, Oct. 2006, pp. 1-10.
Pooniwala, Shahvir, "Lasers: The Next Bit", *Society of Petroleum Engineers*, No. SPE 104223, 2006, 10 pgs.
Porter, J. A. et al., "Cutting Thin Sheet Metal with a Water Jet Guided Laser Using VarioCutting Distances, Feed Speeds and Angles of Incidence", *Int. J. Adv. Manuf. Technol.*, vol. 33, 2007, pp. 961-967.
Potyondy, D. O. et al., "A Bonded-particle model for rock", *International Journal of Rock Mechanics and Mining Sciences*, vol. 41, 2004, pp. 1329-1364.
Potyondy, D. O., "Simulating Stress Corrosion with a Bonded-Particle Model for Rock", *International Journal of Rock Mechanics & Mining Sciences*, vol. 44, 2007, pp. 677-691.
Potyondy, D., "Internal Technical Memorandum—Molecular Dynamics with PFC", a Technical Memorandum to PFC Development Files and Itasca Website, *Molecular Dynamics with PFC*, Jan. 6, 2010, 35 pages.
Powell, M. et al., "Optimization of UHP Waterjet Cutting Head, The Orifice", Flow International, while the date of the publication is unknown, it is believed to be prior to Aug. 19, 2009, 19 pages.
Price, R. H. et al., "Analysis of the Elastic and Strength Properties of Yuccs Mountain tuff, Nevada", 26th Symposium on Rock Mechanics, Jun. 1985, pp. 89-96.
Qixian, Luo et al., "Using compression wave ultrasonic transducers to measure the velocity of surface waves and hence determine dynamic modulof elasticity for concrete", *Construction and Building Materials*, vol. 10, No. 4, 1996, pp. 237-242.
Quinn, R. D. et al., "A Method for Calculating Transient Surface Temperatures and Surface Heating Rates for High-Speed Aircraft", NASA, Dec. 2000, 35 pages.
Radkte, Robert, "New High Strength and faster Drilling TSP Diamond Cutters", Report by *Technology International, Inc.*, DOE Award No. DE-FC26-97FT34368, 2006, 97 pgs.
Ramadan, K. et al., "On the Analysis of Short-Pulse Laser Heating of Metals Using the Dual Phase Lag Heat Conduction Model", *Journal of Heat Transfer*, vol. 131, Nov. 2009, pp. 111301-1 to 111301-7.
Rao, M. V. M. S. et al., "A Study of Progressive Failure of Rock Under Cyclic Loading by Ultrasonic and AE Monitoring Techniques", *Rock Mechanics and Rock Engineering*, vol. 25, No. 4, 1992, pp. 237-251.
Rauenzahn, R. M. et al., "Rock Failure Mechanisms of Flame-Jet Thermal Spallation Drilling—Theory and Experimental Testing", *Int. J. Rock Mech. Min. Sci. & Geomech. Abstr.*, vol. 26, No. 5, 1989, pp. 381-399.
Rauenzahn, R. M., "Analysis of Rock Mechanics and Gas Dynamics of Flame-Jet Thermal Spallation Drilling", a dissertation for the degree of Doctor of Philosophy at Massachusettes Institute of Technology, Sep. 1986, pp. 1-524.
Rauenzahn, R. M. et al., "Rock Failure Mechanisms of Flame-Jet Thermal Spallation Drilling—Theory and Experimental Testing", *Int. J. Rock Merch. Min. Sci. & Geomech. Abstr.*, vol. 26, No. 5, 1989, pp. 381-399.
Rauenzahn, R. M., "Analysis of Rock Mechanics and Gas Dynamics of Flame-Jet Thermal Spallation Drilling", *Massachusetts Institute of Technology*, submitted in partial fulfillment of doctorate degree, 1986 583 pgs.
Ravishankar, M. K., "Some Results on Search Complexity vs Accuracy", DARPA Spoken Systems Technology Workshop, Feb. 1997, 4 pages.
Raymond, David W., "PDC Bit Testing At Sandia Reveals Influence of Chatter in Hard-Rock Drilling", *Geothermal Resources Council Monthly Bulletin*, SAND99-2655J, 1999, 7 pgs.
Ream, S. et al., "Zinc Sulfide Optics for High Power Laser Applications", Paper 1609, while the date of the publication is unknown, it is believed to be prior to Aug. 19, 2009, 7 pages.
Rice, J. R., "On the Stability of Dilatant Hardening for Saturated Rock Masses", *Journal of Geophysical Research*, vol. 80, No. 11, Apr. 10, 1975, pp. 1531-1536.
Richter, D. et al., "Thermal Expansion Behavior of IgneoRocks", *Int. J. Rock Mech. Min. Sci. & Geomech. Abstr.*, vol. 11, 1974, pp. 403-411.
Rietman, N. D. et al., "Comparative Economics of Deep Drilling in Anadarka Basin", a paper presented at the 1979 Society of Petroleum Engineers of AIME Deep Drilling and Production Symposium, Apr. 1979, 5 pages.
Rijken, P. et al., "Predicting Fracture Attributes in the Travis Peak Formation Using Quantitative Mechanical Modeling and Stractural Diagenesis", Gulf Coast Association of Geological Societies Transactions vol. 52, 2002, pp. 837-847.

(56) References Cited

OTHER PUBLICATIONS

Rijken, P. et al., "Role of Shale Thickness on Vertical Connectivity of Fractures: Application of Crack-Bridging Theory to the Austin Chalk, Texas", *Tectonophysics*, vol. 337 ,2001, pp. 117-133.
Rosier, M., "Generalized Hermite Polynomials and the Heat Equation for Dunkl Operators", a paper, while the date of the publication is unknown, it is believed to be prior to Aug. 19, 2009, pp. 1-24.
Rossmanith, H. P. et al., "Fracture Mechanics Applications to Drilling and Blasting"*Fatigue & Fracture Engineering Materials & Structures*, vol. 20, No. 11, 1997, pp. 1617-1636.
Rossmanith, H. P. et al., "Wave Propagation, Damage Evolution, and Dynamic Fracture Extension. Part I. Percussion Drilling", *Materials Science*, vol. 32, No. 3, 1996, pp. 350-358.
Rubin, A. M. et al., "Dynamic Tensile-Failure-Induced Velocity Deficits in Rock", *Geophysical Research Letters*, vol. 18, No. 2, Feb. 1991, pp. 219-222.
Sachpazis, C. I, M. Sc., Ph. D., "Correlating Schmidt Hardness With Compressive Strength and Young's ModulOf Carbonate Rocks", *International Association of Engineering Geology*, Bulletin, No. 42, 1990, pp. 75-83.
Salehi, I. A. et al., "Laser Drilling—Drilling with the Power Light", a final report a contract with DOE with award No. DE-FC26-00NT40917, May 2007, in parts 1-4 totaling 318 pages.
Sandler, I. S. et al., "An Algorithm and a Modular Subroutine for the Cap Model", *International Journal for Numerical and Analytical Methods in Geomechanics*, vol. 3, 1979, pp. 173-186.
Sano, Osam et al., "Acoustic Emission During Slow Crack Growth", *Department Mining and Mineral Engineering, NII-Electronic Library Service*, 1980, pp. 381-388.
Santarelli, F. J. et al., "Formation Evaluation From Logging on Cuttings", *SPE Reservoir Evaluation & Engineering*, Jun. 1998, pp. 238-244.
Sattler, A. R., "Core Analysis in a Low Permeability Sandstone Reservoir: Results from the Multiwell Experiment", a report by Sandia National Laboratories for The Department of Energy, Apr. 1989, 69 pages.
Scaggs, M. et al., "Thermal Lensing Compensation Objective for High Power Lasers", published by Haas Lasers Technologies, Inc., while the date of the publication is unknown, it is believed to be prior to Aug. 19, 2009, 7 pages.
Schaff, D. P. et al., "Waveform Cross-Correlation-Based Differential Travel-Time Measurements at the Northern California Seismic Network", *Bulletin of the Seismological Society of America*, vol. 95, No. 6, Dec. 2005, pp. 2446-2461.
Schaffer, C. B. et al., "Dynamics of Femtosecond Laser-Induced Breakdown in Water from Femtoseconds to Microseconds", *Optics Express*, vol. 10, No. 3, Feb. 11, 2002, pp. 196-203.
Scholz, C. H., "Microfracturing of Rock in Compression", a dissertation for the degree of Doctor of Philosophy at Massachusettes Instutute of Trechnology, Sep. 1967, 177 pages.
Schormair, Nik et al., "The influence of anisotropy on hard rock drilling and cutting", *The Geological Society of London, IAEG*, Paper No. 491, 2006, pp. 1-11.
Schroeder, R. J. et al., "High Pressure and Temperature Sensing for the Oil Industry Using Fiber Bragg Gratings Written onto Side Hole Single Mode Fiber", publisher unknown, while the date of the publication is unknown, it is believed to be prior to Aug. 19, 2009, 4 pages.
Shannon, G. J. et al., "High power laser welding in hyperbaric gas and water environments", *Journal of Laser Applications*, vol. 9, 1997, pp. 129-136.
Shiraki, K. et al., "SBS Threshold of a Fiber with a Brillouin Frequency Shift Distribution", *Journal of Lightwave Technology*, vol. 14, No. 1, Jan. 1996, pp. 50-57.
Shuja, S. Z. et al., "Laser heating of semi-infinite solid with consecutive pulses: Influence of materaial properties on temperature field", *Optics & Laser Technology*, vol. 40, 2008, pp. 472-480.
Simple Drilling Methods, WEDC Loughborough University, United Kingdom, 1995, 4 pgs.
Singh, T. N. et al., "Prediction of Thermal Conductivity of Rock Through Physico-Mechanical Properties", *Building and Environment*, vol. 42, 2007, pp. 146-155.
Sinha, D., "Cantilever Drilling—Ushering a New Genre of Drilling", a paper prepared for presentation at the SPE/IADC Middle East Drilling Technology Conference and Exhibition, Oct. 2003, 6 pages.
Sinor, A. et al., "Drag Bit Wear Model", *SPE Drilling Engineering*, Jun. 1989, pp. 128-136.
Smith, D., "Using Coupling Variables to Solve Compressible Flow, Multiphase Flow and Plasma Processing Problems", COMSOL Users Conference 2006, 38 pages.
Smith, E., "Crack Propagation at a Constant Crack Tip Stress Intensity Factor", *Int. Journal of Fracture*, vol. 16, 1980, pp. R215-R218.
Sneider, RM et al., "Rock Types, Depositional History, and Diangenetic Effects, Ivishak reservoir Prudhoe Bay Field", *SPE Reservoir Engineering*, Feb. 1997, pp. 23-30.
Soeder, D. J. et al., "Pore Geometry in High- and Low-Permeability Sandstones, Travis Peak Formation, East Texas", *SPE Formation Evaluation*, Dec. 1990, pp. 421-430.
Solomon, A. D. et al., "Moving Boundary Problems in Phase Change Models Current Research Questions", *Engineering Physics and Mathematics Division*, ACM Signum Newsletter, vol. 20, Issue 2, 1985, pp. 8-12.
Somerton, W. H. et al., "Thermal Expansion of Fluid Saturated Rocks Under Stress", SPWLA Twenty-Second Annual Logging Symposium, Jun. 1981, pp. 1-8.
Sousa, L. M. O. et al., "Influence of Microfractures and Porosity on the Physico-Mechanical Properties and Weathering of Ornamental Granites", *Engineering Geology*, vol. 77, 2005, pp. 153-168.
Sousa, Luis M. O. et al., "Influence of microfractures and porosity on the physico-mechanical properties and weathering of ornamental granites", *Engineering Geology*, vol. 77, 2005, pp. 153-168.
Stone, Charles M. et al., "Qualification of a Computer Program for Drill String Dynamics", *Sandia National Laboratories*, SAND-85-0633C, 1985, pp. 1-20.
Stowell, J. F. W., "Characterization of Opening-Mode Fracture Systems in the Austin Chalk", *Gulf Coast Association of Geological Societies Transactions*, vol. L1, 2001, pp. 313-320.
Straka, W. A. et al., "Cavitation Inception in Quiescent and Co-Flow Nozzle Jets", 9th International Conference on Hydrodynamics, Oct. 2010, pp. 813-819.
Suarez, M. C. et al., "COMSOL in a New Tensorial Formulation of Non-Isothermal Poroelasticity", publisher unknown, while the date of the publication is unknown, it is believed to be prior to Aug. 19, 2009,2 pages.
Summers, D. A., "Water Jet Cutting Related to Jet & Rock Properties", publisher unknown, while the date of the publication is unknown, it is believed to be prior to Aug. 19, 2009, 13 pages.
Suwarno, et al., "Dielectric Properties of Mixtures Between Mineral Oil and Natural Ester from Palm Oil", *WSEAS Transactions on Power Systems*, vol. 3, Issue 2, Feb. 2008, pp. 37-46.
Takarli, Mokhfi et al., "Damage in granite under heating/cooling cycles and water freeze-thaw condition", *International Journal of Rock Mechanics and Mining Sciences*, vol. 45, 2008, pp. 1164-1175.
Tanaka, K. et al., "The Generalized Relationship Between the Parameters *C* and *m* of Paris' Law for Fatigue Crack Growth", *Scripta Metallurgica*, vol. 15, No. 3, 1981, pp. 259-264.
Tang, C. A. et al., "Numerical Studies of the Influence of Microstructure on Rock Failure in Uniaxial Compression—Park I: Effect of Heterogeneity", *International Journal of Rock Mechanics and Mining Sciences*, vol. 37, 2000, pp. 555-569.
Tang, C. A. et al., "Coupled analysis of flow, stress and damage (FSD) in rock failure", *International Journal of Rock Mechanics and Mining Sciences*, vol. 39, 2002, pp. 477-489.
Tao, Q. et al., "A Chemo-Poro-Thermoelastic Model for Stress/Pore Pressure Analysis around a Wellbore in Shale", a paper prepared for presentation at the Symposium on Rock Mechanics (USRMS): *Rock Mechanics for Energy*, Mineral and Infrastracture Development in the Northern Regions, Jun. 2005, 7 pages.
Terra, O. et al., "Brillouin Amplification in Phase Coherent Transfer of Optical Frequencies over 480 km Fiber", publisher unknown, while the date of the publication is unknown, it is believed to be prior to Aug. 19, 2009, 9 pages.

(56) References Cited

OTHER PUBLICATIONS

Terzopoulos, D. et al., "Modeling Inelastic Deformation: Viscoelasticity, Plasticity, Fracture", *SIGGRAPH '88*, Aug. 1988, pp. 269-278.
Thomas, R. P., "Heat Flow Mapping at the Geysers Geothermal Field", published by the California Department of Conservation Division of Oil and Gas, 1986, 56 pages.
Thompson, G. D., "Effects of Formation Compressive Strength on Perforator Performance", a paper presented of the Southern District API Division of Production, Mar. 1962, pp. 191-197.
Thorsteinsson, Hildigunnur et al., "The Impacts of Drilling and Reservoir Technology Advances on EGS Exploitation", *Proceedings, Thirty-Third Workshop on Geothermal Reservoir Engineering, Institute for Sustainable Energy, Environment, and Economy* (*ISEEE*), 2008, pp. 1-14.
Tovo, R. et al., "Fatigue Damage Evaluation on Mechanical Components Under Multiaxial Loadings", excerpt from the Proceedings of the COMSOL Conference, 2009, 8 pages.
Tuler, F. R. et al., "A Criterion for the Time Dependence of Dynamic Fracture", *The International Jopurnal of Fracture Mechanics*, vol. 4, No. 4, Dec. 1968, pp. 431-437.
Turner, D. et al., "New DC Motor for Downhole Drilling and Pumping Applications", a paper prepared for presentation at the SPE/ICoTA Coiled Tubing Roundtable, Mar. 2001, pp. 1-7.
Turner, D. R. et al., "The All Electric BHA: Recent Developments Toward an Intelligent Coiled-Tubing Drilling System", a paper prepared for presentation at the 1999 SPE/ICoTA Coiled Tubing Roundtable, May 1999, pp. 1-10.
Tutuncu, A. N. et al., "An Experimental Investigation of Factors Influencing Compressional- and Shear-Wave Velocities and Attenuations in Tight Gas Sandstones", *Geophysics*, vol. 59, No. 1, Jan. 1994, pp. 77-86.
U.S. Dept of Energy, "Chapter 6—Drilling Technology and Costs", from Report for the Future of Geothermal Energy, 2005, 53 pgs.
U.S. Appl. No. 12/840,978, filed Jul. 21, 2009, 61 pgs.
Udd, E. et al., "Fiber Optic Distributed Sensing Systems for Harsh Aerospace Environments", publisher unknown, while the date of the publication is unknown, it is believed to be prior to Aug. 19, 2009, 12 pages.
Valsangkar, A. J. et al., Stress-Strain Relationship for Empirical Equations of Creep in Rocks, *Engineering Geology*, Mar. 29, 1971, 5 pages.
Varnado, S. G. et al., "The Design and Use of Polycrystalline Diamond Compact Drag Bits in the Geothermal Environment", *Society of Petroleum Engineers of AIME*, SPE 8378, 1979, pp. 1-11.
Wagh, A. S. et al., "Dependence of Ceramic Fracture Properties on Porosity", *Journal of Material Sience*, vol. 28, 1993, pp. 3589-3593.
Wagner, F. et al., "The Laser Microjet Technology—10 Years of Development (M401)", publisher unknown, while the date of the publication is unknown, it is believed to be prior to Aug. 19, 2009, 9 pages.
Waldron, K. et al., "The Microstructures of Perthitic Alkali Feldspars Revealed by Hydroflouric Acid Etching", *Contributions to Mineralogy and Petrology*, vol. 116, 1994, pp. 360-364.
Walker, B. H. et al., "Roller-Bit Penetration Rate Response as a Function of Rock Properties and Well Depth", a paper prepared for presentation at the 61st Annual Technical Conference and Exhibition of the Society of Petroleum Engineers, Oct. 1986, 12 pages.
Wandera, C. et al., "Characterization of the Melt Removal Rate in Laser Cutting of Thick-Section Stainless Steel", *Journal of Laser Applications*, vol. 22, No. 2, May 2010, pp. 62-70.
Wandera, C. et al., "Inert Gas Cutting of Thick-Section Stainless Steel and Medium Section Aluminun Using a High Power Fiber Laser", *Journal of Chemical Physics*, vol. 116, No. 4, Jan. 22, 2002, pp. 154-161.
Wandera, C. et al., "Laser Power Requirement for Cutting of Thick-Section Steel and Effects of Processing Parameters on Mild Steel Cut Quality", a paper accepted for publication in the Proceedings IMechE Part B, *Journal of Engineering Manufacture*, vol. 225, 2011, 23 pages.
Wandera, C. et al., "Optimization of Parameters for Fiber Laser Cutting of 10mm Stainless Steel Plate", a paper for publication in the Proceeding IMechE Part B, *Journal of Engineering Manufacture*, vol. 225, 2011, 22 pages.
Wandera, C., "Performance of High Power Fibre Laser Cutting of Thick-Section Steel and Medium-Section Aluminium", a thesis for the degree of Doctor of Science (Technology) at , Lappeenranta University of Technology, Oct. 2010, 74 pages.
Wang, C. H., "Introduction to Fractures Mechanics", published by DSTO Aeronautical and Maritime Research Laboratory, Jul. 1996, 82 pages.
Wang, G. et al., "Particle Modeling Simulation of Thermal Effects on Ore Breakage", *Computational Materials Science*, vol. 43, 2008, pp. 892-901.
Waples, D. W. et al., "A Review and Evaluation of Specific Heat Capacities of Rocks, Minerals, and Subsurface Fluids. Part 1: Minerals and NonporoRocks", *Natural Resources Research*, vol. 13, No. 2, Jun. 2004, pp. 97-122.
Waples, D. W. et al., "A Review and Evaluation of Specific Heat Capacities of Rocks, Minerals, and Subsurface Fluids. Part 2: Fluids and PoroRocks", *Natural Resources Research*, vol. 13 No. 2, Jun. 2004, pp. 123-130.
Warren, T. M. et al., "Laboratory Drilling Performance of PDC Bits", *SPE Drilling Engineering*, Jun. 1988, pp. 125-135.
Wen-gui, Cao et al., "Damage constituitive model for strain-softening rock based on normal distribution and its parameter determination", *J. Cent. South Univ. Technol.*, vol. 14, No. 5, 2007, pp. 719-724.
White, E. J. et al., "Reservoir Rock Characteristics of the Madison Limestone in the Williston Basin", *The Log Analyst*, Sep.-Oct. 1970, pp. 17-25.
White, E. J. et al., "Rock Matrix Properties of the Ratcliffe Interval (Madison Limestone) Flat Lake Field, Montana", *SPE of AIME*, Jun. 1968, 16 pages.
Wiercigroch, M., "Dynamics of ultrasonic percussive drilling of hard rocks", *Journal of Sound and Vibration*, vol. 280, 2005, pp. 739-757.
Wilkinson, M. A. et al., "Experimental Measurement of Surface Temperatures During Flame-Jet Induced Thermal Spallation", *Rock Mechanics and Rock Engineering*, 1993, pp. 29-62.
Williams, R. E. et al., "Experiments in Thermal Spallation of VarioRocks", *Transactions of the ASME*, vol. 118, 1996, pp. 2-8.
Willis, David A. et al., "Heat transfer and phase change during picosecond laser ablation of nickel", *International Journal of Heat and Mass Transfer*, vol. 45, 2002, pp. 3911-3918.
Winters, W. J. et al., "Roller Bit Model with Rock Ductility and Cone Offset", a paper prepared for presentation at 62nd Annual Technical Conference and Exhibition of the Society of Petroleum Engineers, Sep. 1987, 12 pages.
Wippich, M. et al., "Tunable Lasers and Fiber-Bragg-Grating Sensors", Obatined from the at: from the Internet website of The Industrial Physicist at: http://www.aip.org/tip/INPHFA/vol-9/iss-3/p24.html, on May 18, 2010, pp. 1-5.
Wong, Teng-fong et al., "Microcrack statistics, Weibull distribution and micromechanical modeling of compressive failure in rock", *Mechanics of Materials*, vol. 38, 2006, pp. 664-681.
Wood, Tom, "Dual Purpose COTD™ Rigs Establish New Operational Records", *Treme Coil Drilling Corp., Drilling Technology Without Borders*, 2009, pp. 1-18.
Wu, X. Y. et al., "The Effects of Thermal Softening and Heat Conductin on the Dynamic Growth of Voids", *International Journal of Solids and Structures*, vol. 40, 2003, pp. 4461-4478.
Xia, K. et al., "Effects of microstructures on dynamic compression of Barre granite", *International Journal of Rock Mechanics and Mining Sciences*, vol. 45, 2008. pp. 879-887, available at: www.sciencedirect.com.
Xiao, J. Q. et al., "Inverted S-Shaped Model for Nonlinear Fatigue Damage of Rock", *International Journal of Rock Mechanics & Mining Sciences*, vol. 46, 2009, pp. 643-648.
Xu, Z et al. "Modeling of Laser Spallation Drilling of Rocks fro gas- and Oilwell Drilling", *Society of Petroleum Engineers*, SPE 95746, 2005, pp. 1-6.
Xu, Z. et al., "Application of High Powered Lasers to Perforated Completions", *International Congress on Applications of Laser & Electro-Optics*, Oct. 2003, 6 pages.

(56) References Cited

OTHER PUBLICATIONS

Xu, Z. et al., "Laser Rock Drilling by a Super-Pulsed CO2 Laser Beam", a manuscript created for the Department of Energy, while the date of the publication is unknown, it is believed to be prior to Aug. 19, 2009, 9 pages.
Xu, Z. et al., "Laser Spallation of Rocks for Oil Well Drilling", Proceedings of the 23rd International Congress on Applications of Lasers and Electro-Optics, 2004, pp. 1-6.
Xu, Z. et al., "Modeling of Laser Spallation Drilling of Rocks for Gas-and Oilwell Drilling", a paper prepared for the presentation at the 2005 SPE (Society of Petroleum Engineers) Annual Technical Conference and Exhibition, Oct. 2005, 6 pages.
Xu, Z. et al., "Rock Perforation by Pulsed Nd: YAG Laser", Proceedings of the 23rd International Congress on Applications of Lasers and Electro-Optics 2004, 2004, 5 pages.
Xu, Z. et al., "Specific Energy of Pulsed Laser Rock Drilling", *Journal of Laser Applications*, vol. 15, No. 1, Feb. 2003, pp. 25-30.
Xu, Z. et al., "Specific Energy for Laser Removal of Rocks", *Proceedings of the 20th International Congress on Applications of Lasers & Electro-Optics*, 2001, pp. 1-8.
Xu, Z. et al., "Specific energy for pulsed laser rock drilling", *Journal of Laser Applications*, vol. 15, No. 1, 2003, pp. 25-30.
Xu, Zhiyue et al., "Laser Spallation of Rocks for Oil Well Drilling", *Proceedings of the 23rd International Congress on Applications of Lasers and Electro-Optics*, 2004, pp. 1-6.
Yabe, T. et al., "The Constrained Interpolation Profile Method for Multiphase Analysis", *Journal of Computational Physics*, vol. 169, 2001, pp. 556-593.
Yamamoto, K. Y. et al., "Detection of Metals in the Environment Using a Portable Laser-Induced Breakdown Spectroscopy Instrument", *Applied Spectroscopy*, vol. 50, No. 2, 1996, pp. 222-233.
Yamashita, Y. et al., "Underwater Laser Welding by 4kW CW YAG Laser", *Journal of Nuclear Science and Technology*, vol. 38, No. 10, Oct. 2001, pp. 891-895.
Yamshchikov, V. S. et al., "An Evaluation of the Microcrack Density of Rocks by Ultrasonic Velocimetric Method", *Moscow Mining Institute*. (*Translated from Fiziko-Tekhnicheskie Problemy Razrabotki Poleznykh Iskopaemykh*), 1985, pp. 363-366.
Yasar, E. et al., "Determination of the Thermal Conductivity from Physico-Mechanical Properties", *Bull Eng. Geol. Environ.*, vol. 67, 2008, pp. 219-225.
Yilbas, B. S. et al., "Laser short pulse heating: Influence of pulse intensity on temperature and stress fields", *Applied Surface Science*, vol. 252, 2006, pp. 8428-8437.
Yilbas, B. S. et al., "Laser treatment of aluminum surface: Analysis of thermal stress field in the irradiated región", *Journal of Materials Processing Technology*, vol. 209, 2009, pp. 77-88.
Yilbas, B. S. et al., "Nano-second laser pulse heating and assisting gas jet considerations", *International Journal of Machine Tools & Manufacture*, vol. 40, 2000, pp. 1023-1038.
Yilbas, B. S. et al., "Repetitive laser pulse heating with a convective boundary condition at the surface", *Journal of Physics D : Applied Physics*, vol. 34, 2001, pp. 222-231.
York, J. L. et al., "The Influence of Flashing and Cavitation on Spray Formation", a progress report for UMRI Project 2815 with Delavan Manufacturing Company, Oct. 1959, 27 pages.
Yun, Yingwei et al., "Thermal Stress Distribution in Thick Wall Cylinder Under Thermal Shock", *Journal of Pressure Vessel Technology, Transactions of the ASME*, 2009, vol. 131, pp. 1-6.
Zamora, M. et al., "An Empirical Relationship Between Thermal Conductivity and Elastic Wave Velocities in Sandstone", *Geophysical Research Letters*, vol. 20, No. 16, Aug. 20, 1993, pp. 1679-1682.
Zehnder, A. T., "Lecture Notes on Fracture Mechanics", 2007, 227 pages.
Zeng, Z. W. et al., "Experimental Determination of Geomechanical and Petrophysical Properties of Jackfork Sandstone—A Tight Gas Formation", a paper prepared for the presentation at the 6th North American Rock Mechanics Symposium (NARMS): *Rock Mechanics Across Borders and Disciplines*, Jun. 2004, 9 pages.
Zeuch, D. H. et al., "Rock Breakage Mechanisms With a PDC Cutter", a paper prepared for presentation at the 60th Annual Technical Conference and Exhibition of the Society of Petroleum Engineers, Sep. 1985, 12 pages.
Zeuch, D.H. et al., "Rock Breakage Mechanism Wirt A PDC Cutter", *Society of Petroleum Engineers, 60th Annual Technical Conference*, Las Vegas, Sep. 22-25, 1985, 11 pgs.
Zhai, Yue et al., "Dynamic failure analysis on granite under uniaxial impact compressive load", *Front. Archit. Civ. Eng. China*, vol. 2, No. 3, 2008, pp. 253-260.
Zhang, L. et al., "Energy from Abandoned Oil and Gas Reservoirs", a paper prepared for presentation at the 2008 SPE (Society of Petroleum Engineers) Asia Pacific Oil & Gas Conference and Exhibition, 2008, pp. 1-10.
Zheleznov, D. S. et al., "Faraday Rotators With Short Magneto-Optical Elements for 50-kW Laser Power", *IEEE Journal of Quantum Electronics*, vol. 43, No. 6, Jun. 2007, pp. 451-457.
Zhou, T. et al., "Analysis of Stimulated Brillouin Scattering in Multi-Mode Fiber by Numerical Solution", *Journal of Zhejiang University of Science*, vol. 4 No. 3, May-Jun. 2003, pp. 254-257.
Zhou, X.P., "Microcrack Interaction Brittle Rock Subjected to Uniaxial Tensile Loads", *Theoretical and Applied Fracture Mechanics*, vol. 47, 2007, pp. 68-76.
Zhou, Zehua et al., "A New Thermal-Shock-Resistance Model for Ceramics: Establishment and validation", *Materials Science and Engineering*, A 405, 2005, pp. 272-276.
Zhu, Dongming et al., "Influence of High Cycle Thermal Loads on Thermal Fatigue Behavior of Thick Thermal Barrier Coatings", *National Aeronautics and Space Administration, Army Research Laboratory*, Technical Report ARL-TR-1341, NASA TP-3676, 1997, pp. 1-50.
Zhu, Dongming et al., "Investigation of thermal fatigue behavior of thermal barrier coating systems", *Surface and Coatings Technology*, vol. 94-95, 1997, pp. 94-101.
Zhu, Dongming et al., "Investigation of Thermal High Cycle and Low Cycle Fatigue Mechanisms of Thick Thermal Barrier Coatings", *National Aeronautics and Space Administration, Lewis Research Center*, NASA/TM-1998-206633, 1998, pp. 1-31.
Zhu, Dongming et al., "Thermophysical and Thermomechanical Properties of Thermal Barrier Coating Systems", *National Aeronautics and Space Administration, Glenn Research Center*, NASA/TM-2000-210237, 2000, pp. 1-22.
Zhu, X. et al., "High-Power ZBLAN Glass Fiber Lasers: Review and Prospect", *Advances in OptoElectronics*, vol. 2010, pp. 1-23.
Zietz, J. et al., "Determinants of House Prices: A Quantile Regression Approach", *Department of Economics and Finance Working Paper Series*, May 2007, 27 pages.
Zuckerman, N. et al., "Jet Impingement Heat Transfer: Physics, Correlations, and Numerical Modeling", *Advances in Heat Transfer*, vol. 39, 2006, pp. 565-631.
A Built-for-Purpose Coiled Tubing Rig, by Schulumberger Wells, No. DE-PS26-03NT15474, 2006, 1 pg.
"Chapter I—Laser-Assisted Rock-Cutting Tests", publisher unknown, while the date of the publication is unknown, it is believed to be prior to Aug. 19, 2009, 64 pages.
"Chapter 7: Energy Conversion Systems—Options and Issues", publisher unknown, while the date of the publication is unknown, it is believed to be prior to Aug. 19, 2009, pp. 7-1 to 7-32 and table of contents page.
"Cross Process Innovations", Obtained from the Internat at: http://www.mrl.columbia.edu/ntm/CrossProcess/CrossProcessSect5.htm, on Feb. 2, 2010, 11 pages.
"Fourier Series, Generalized Functions, Laplace Transform", publisher unknown, while the date of the publication is unknown, it is believed to be prior to Aug. 19, 2009, 6 pages.
"Introduction to Optical Liquids", published by Cargille-Sacher Laboratories Inc., Obtained from the Internet at: http://www.cargille.com/opticalintro.shtml, on Dec. 23, 2008, 5 pages.
"Laser Drilling", Oil & Natural Gas Projects (Exploration & Production Technologies) Technical Paper, Dept. of Energy, Jul. 2007, 3 pages.
"Leaders in Industry Luncheon", IPAA & TIPRO, Jul. 8, 2009, 19 pages.

(56) References Cited

OTHER PUBLICATIONS

"Measurement and Control of Abrasive Water-Jet Velocity", publisher unknown, while the date of the publication is unknown, it is believed to be prior to Aug. 19, 2009, 8 pages.
"NonhomogeneoPDE—Heat Equation with a Forcing Term", a lecture, 2010, 6 pages.
"Performance Indicators for Geothermal Power Plants", prepared by International Geothermal Association for World Energy Council Working Group on Performance of Renewable Energy Plants, author unknown, Mar. 2011, 7 pages.
"Rock Mechanics and Rock Engineering", publisher unknown, while the date of the publication is unknown, it is believed to be prior to Aug. 19, 2009, 69 pages.
"Shock Tube", Cosmol MultiPhysics 3.5a, 2008, 5 pages.
"Silicone Fluids: Stable, Inert Media", Gelest, Inc., while the date of the publication is unknown, it is believed to be prior to Aug. 19, 2009, 27 pages.
"Stimulated Brillouin Scattering (SBS) in Optical Fibers", Centro de Pesquisa em Optica e Fotonica, Obtained from the Internet at: http://cepof.ifi.unicamp.br/index.php . . . ), on Jun. 25, 2012, 2 pages.
"Underwater Laser Cutting", TWI Ltd, May/Jun. 2011, 2 pages.
Utility U.S. Appl. No. 13/768,149, filed Feb. 15, 2013, 27 pages.
Utility U.S. Appl. No. 13/782,869, filed Mar. 1, 2013, 80 pages.
Utility U.S. Appl. No. 13/782,942, filed Mar. 1, 2013, 81 pages.
Utility U.S. Appl. No. 13/777,650, filed Feb. 26, 2013, 73 pages.
Utility U.S. Appl. No. 13/800,559, filed Mar. 13, 2013, 73 pages.
Utility U.S. Appl. No. 13/800,879, filed Mar. 13, 2013, 73 pages.
Utility U.S. Appl. No. 13/800,933, filed Mar. 13, 2013, 73 pages.
Utility U.S. Appl. No. 13/849,831, filed Mar. 25, 2013, 83 pages.
Office Action from JP Application No. 2011-523959 dated Aug. 27, 2013.
Office Action from JP Application No. 2011-551172 dated Sep. 17, 2013.

HIGH POWER LASER WORKOVER AND COMPLETION TOOLS AND SYSTEMS

This invention was made with Government support under Award DE-AR0000044 awarded by the Office of ARPA-E U.S. Department of Energy. The Government has certain rights in this invention.

This application is a continuation of U.S. patent application Ser. No. 12/544,136, filed Aug. 19, 2009, titled Method and Apparatus for Delivering High Power Laser Energy Over Long Distances (issued as U.S. Pat. No. 8,511,401), which claims the benefit of priority of provisional applications: Ser. No. 61/090,384 filed Aug. 20, 2008, titled System and Methods for Borehole Drilling: Ser. No. 61/102,730 filed Oct. 3, 2008, titled Systems and Methods to Optically Pattern Rock to Chip Rock Formations; Ser. No. 61/106,472 filed Oct. 17, 2008, titled Transmission of High Optical Power Levels via Optical Fibers for Applications such as Rock Drilling and Power Transmission; and, Ser. No. 61/153,271 filed Feb. 17, 2009, title Method and Apparatus for an Armored High Power Optical Fiber for Providing Boreholes in the Earth, the disclosures of which are incorporated herein by reference.

BACKGROUND OF THE INVENTION

The present invention relates to methods, apparatus and systems for delivering high power laser energy over long distances, while maintaining the power of the laser energy to perform desired tasks. In a particular, the present invention relates to providing high power laser energy to create and advance a borehole in the earth and to perform other tasks in the borehole.

In general, boreholes have been formed in the earth's surface and the earth, i.e., the ground, to access resources that are located at and below the surface. Such resources would include hydrocarbons, such as oil and natural gas, water, and geothermal energy sources, including hydrothermal wells. Boreholes have also been formed in the ground to study, sample and explore materials and formations that are located below the surface. They have also been formed in the ground to create passageways for the placement of cables and other such items below the surface of the earth.

The term borehole includes any opening that is created in the ground that is substantially longer than it is wide, such as a well, a well bore, a well hole, and other terms commonly used or known in the art to define these types of narrow long passages in the earth. Although boreholes are generally oriented substantially vertically, they may also be oriented on an angle from vertical, to and including horizontal. Thus, using a level line as representing the horizontal orientation, a borehole can range in orientation from 0° i.e., a vertical borehole, to 90°,i.e., a horizontal borehole and greater than 90° e.g., such as a heel and toe. Boreholes may further have segments or sections that have different orientations, they may be arcuate, and they may be of the shapes commonly found when directional drilling is employed. Thus, as used herein unless expressly provided otherwise, the "bottom" of the borehole, the "bottom" surface of the borehole and similar terms refer to the end of the borehole, i.e., that portion of the borehole farthest along the path of the borehole from the borehole's opening, the surface of the earth, or the borehole's beginning.

Advancing a borehole means to increase the length of the borehole. Thus, by advancing a borehole, other than a horizontal one, the depth of the borehole is also increased. Boreholes are generally formed and advanced by using mechanical drilling equipment having a rotating drilling bit. The drilling bit is extending to and into the earth and rotated to create a hole in the earth. In general, to perform the drilling operation a diamond tip tool is used. That tool must be forced against the rock or earth to be cut with a sufficient force to exceed the shear strength of that material. Thus, in conventional drilling activity mechanical forces exceeding the shear strength of the rock or earth must be applied to that material. The material that is cut from the earth is generally known as cuttings, i.e., waste, which may be chips of rock, dust, rock fibers and other types of materials and structures that may be created by the thermal or mechanical interactions with the earth. These cuttings are typically removed from the borehole by the use of fluids, which fluids can be liquids, foams or gases.

In addition to advancing the borehole, other types of activities are performed in or related to forming a borehole, such as, work over and completion activities. These types of activities would include for example the cutting and perforating of casing and the removal of a well plug. Well casing, or casing, refers to the tubulars or other material that are used to line a wellbore. A well plug is a structure, or material that is placed in a borehole to fill and block the borehole. A well plug is intended to prevent or restrict materials from flowing in the borehole.

Typically, perforating, i.e., the perforation activity, involves the use of a perforating tool to create openings, e.g. windows, or a porosity in the casing and borehole to permit the sought after resource to flow into the borehole. Thus, perforating tools may use an explosive charge to create, or drive projectiles into the casing and the sides of the borehole to create such openings or porosities.

The above mentioned conventional ways to form and advance a borehole are referred to as mechanical techniques, or mechanical drilling techniques, because they require a mechanical interaction between the drilling equipment, e.g., the drill bit or perforation tool, and the earth or casing to transmit the force needed to cut the earth or casing.

It has been theorized that lasers could be adapted for use to form and advance a borehole. Thus, it has been theorized that laser energy from a laser source could be used to cut rock and earth through spalling, thermal dissociation, melting, vaporization and combinations of these phenomena. Melting involves the transition of rock and earth from a solid to a liquid state. Vaporization involves the transition of rock and earth from either a solid or liquid state to a gaseous state. Spalling involves the fragmentation of rock from localized heat induced stress effects. Thermal dissociation involves the breaking of chemical bonds at the molecular level.

To date it is believed that no one has succeeded in developing and implementing these laser drilling theories to provide an apparatus, method or system that can advance a borehole through the earth using a laser, or perform perforations in a well using a laser. Moreover, to date it is believed that no one has developed the parameters, and the equipment needed to meet those parameters, for the effective cutting and removal of rock and earth from the bottom of a borehole using a laser, nor has anyone developed the parameters and equipment need to meet those parameters for the effective perforation of a well using a laser. Further is it believed that no one has developed the parameters, equipment or methods need to advance a borehole deep into the earth, to depths exceeding about 300 ft (0.09 km), 500 ft (0.15 km), 1000 ft, (0.30 km), 3,280 ft (1 km), 9,840 ft (3 km) and 16,400 ft (5 km), using a laser. In particular, it is believed that no one has developed parameters, equipments, or methods nor implemented the delivery of high power laser energy, i.e., in excess of 1 kW or more to advance a borehole within the earth.

While mechanical drilling has advanced and is efficient in many types of geological formations, it is believed that a highly efficient means to create boreholes through harder geologic formations, such as basalt and granite has yet to be developed. Thus, the present invention provides solutions to this need by providing parameters, equipment and techniques for using a laser for advancing a borehole in a highly efficient manner through harder rock formations, such as basalt and granite.

The environment and great distances that are present inside of a borehole in the earth can be very harsh and demanding upon optical fibers, optics, and packaging. Thus, there is a need for methods and an apparatus for the deployment of optical fibers, optics, and packaging into a borehole, and in particular very deep boreholes, that will enable these and all associated components to withstand and resist the dirt, pressure and temperature present in the borehole and overcome or mitigate the power losses that occur when transmitting high power laser beams over long distances. The present inventions address these needs by providing a long distance high powered laser beam transmission means.

It has been desirable, but prior to the present invention believed to have never been obtained, to deliver a high power laser beam over a distance within a borehole greater than about 300 ft (0.09 km), about 500 ft (0.15 km), about 1000 ft, (0.30 km), about 3,280 ft (1 km), about 9,8430 ft (3 km) and about 16,400 ft (5 km) down an optical fiber in a borehole, to minimize the optical power losses due to non-linear phenomenon, and to enable the efficient delivery of high power at the end of the optical fiber. Thus, the efficient transmission of high power from point A to point B where the distance between point A and point B within a borehole is greater than about 1,640 ft (0.5 km) has long been desirable, but prior to the present invention is believed to have never been obtainable and specifically believed to have never been obtained in a borehole drilling activity.

A conventional drilling rig, which delivers power from the surface by mechanical means, must create a force on the rock that exceeds the shear strength of the rock being drilled. Although a laser has been shown to effectively spall and chip such hard rocks in the laboratory under laboratory conditions, and it has been theorized that a laser could cut such hard rocks at superior net rates than mechanical drilling, to date it is believed that no one has developed the apparatus systems or methods that would enable the delivery of the laser beam to the bottom of a borehole that is greater than about 1,640 ft (0.5 km) in depth with sufficient power to cut such hard rocks, let alone cut such hard rocks at rates that were equivalent to and faster than conventional mechanical drilling. It is believed that this failure of the art was a fundamental and long standing problem for which the present invention provides a solution.

Thus, the present invention addresses and provides solutions to these and other needs in the drilling arts by providing, among other things: spoiling the coherence of the Stimulated Brillioun Scattering (SBS) phenomenon, e.g. a bandwidth broadened laser source, such as an FM modulated laser or spectral beam combined laser sources, to suppress the SBS, which enables the transmission of high power down a long >1000 ft (0.30 km) optical fiber; the use of a fiber laser, disk laser, or high brightness semiconductor laser for drilling rock with the bandwidth broadened to enable the efficient delivery of the optical power via a >1000 ft (0.30 km) long optical fiber; the use of phased array laser sources with its bandwidth broadened to suppress the Stimulated Brillioun Gain (SBG) for power transmission down fibers that are >1000 ft (0.30 km) in length; a fiber spooling technique that enables the fiber to be powered from the central axis of the spool by a laser beam while the spool is turning; a method for spooling out the fiber without having to use a mechanically moving component; a method for combining multiple fibers into a single jacket capable of withstanding down hole pressures; the use of active and passive fiber sections to overcome the losses along the length of the fiber; the use of a buoyant fiber to support the weight of the fiber, laser head and encasement down a drilling hole; the use of micro lenses, aspherical optics, axicons or diffractive optics to create a predetermined pattern on the rock to achieve higher drilling efficiencies; and the use of a heat engine or tuned photovoltaic cell to reconvert optical power to electrical power after transmitting the power >1000 ft (0.30 km) via an optical fiber.

SUMMARY

It is desirable to develop systems and methods that provide for the delivery of high power laser energy to the bottom of a deep borehole to advance that borehole at a cost effective rate, and in particular, to be able to deliver such high power laser energy to drill through rock layer formations including granite, basalt, sandstone, dolomite, sand, salt, limestone, rhyolite, quartzite and shale rock at a cost effective rate. More particularly, it is desirable to develop systems and methods that provide for the ability to deliver such high power laser energy to drill through hard rock layer formations, such as granite and basalt, at a rate that is superior to prior conventional mechanical drilling operations. The present invention, among other things, solves these needs by providing the system, apparatus and methods taught herein.

Thus there is provided herein a high power laser drilling system for advancing a borehole the system having a source of high power laser energy, the laser source capable of providing a laser beam having at least 5 kW of power, the system further having a tubing assembly, the tubing assembly having at least 1000 feet of tubing and having a distal end and a proximal, the system further having a source of fluid for use in advancing a borehole. The components of the system are configured so that the proximal end of the tubing is in fluid communication with the source of fluid, whereby fluid is transported in association with the tubing, the proximal end of the tubing is in optical communication with the laser source, whereby the laser beam can be transported in association with the tubing, the tubing comprising a high power laser transmission cable, the transmission cable having a distal end and a proximal end, the proximal end being in optical communication with the laser source, whereby the laser beam is transmitted by the cable from the proximal end to the distal end of the cable for delivery of the laser beam energy to the borehole. In this manner, the power of the laser energy at the distal end of the cable when the cable is within a borehole is at least about 2 kW.

This system wherein the high power laser energy source provides a laser beam having at least about 10 kW of power and at least about 3 kW of power at the distal end of the cable within the borehole, this system wherein the high power laser energy source provides a laser beam having at least about 15 kW of power and at least about 5 kW of power at the distal end of the cable within the borehole, and this system wherein the high power laser energy source provides a laser beam having at least about 20 kW of power and at least about 7 kW of power at the distal end are provided.

These systems wherein the power of the laser energy at the distal end of the cable when the cable is within a borehole is at least about 4 kW, is at least about 14 kW and is at least about 19 kW are provided. These systems wherein the tubing assembly is a coiled tubing rig having at least 4000 ft of coiled tubing is provided. These systems wherein the tubing assembly comprises a spool of coiled tubing or a stationary spool of coiled tubing.

There is provided a further embodiment of these high power laser drilling systems for advancing a borehole the systems further having a means for advancing the tubing into the borehole, bottom hole assembly, a blowout preventer, and a diverter. Such further systems are configured so that the bottom hole assembly is in fluid and optical communication with the distal end of the tubing and the tubing extends through the blowout preventer and the diverter and into the borehole, and is capable of being advanced through the blowout preventer and the diverter into and out of the borehole by the advancing means. Thus, the laser beam and fluid are directed by the bottom hole assembly to a surface in the borehole to advance the borehole.

There is additionally provided a system for providing high power laser energy to the bottom of deep boreholes, the system comprising a source or high powered laser energy capable of providing a high power laser beam, a means for transmitting the laser beam from the high power laser to the bottom of a deep borehole, and, the transmitting means having a means to suppress SBS; whereby substantially all of the high power laser energy is delivered to the bottom of the borehole. This system may further be configured for use when the deep of borehole is at least 1,000 feet, at least 5,000 feet, is at least 10,000 feet, and still further when the laser source is at least 10 kW or greater.

There is yet further provided a spool assembly for rotatably coupling high power laser transmission cables for use in advancing boreholes, comprising base, a spool. Wherein, the spool is supported by the base through a load bearing bearing. The spool having coiled tubing having a first end and a second end, the coiled tubing comprising a means for transmitting a high power laser beam. The spool comprising an axle around which the coiled tubing is wound, the axle supported by the load bearing bearing, a first non-rotating optical connector for optically connecting a laser beam source to the axle, a rotatable optical connector optically associated with the first optical connector, whereby a laser beam is capable of being transmitted from the first optical connector to the rotatable optical connector. The assembly comprises a rotating optical connector optically associated with the rotatable optical connector, optically associated with the transmitting means and associated with the axle, whereby the spool is capable of transmitting a laser beam from the first optical connector through the rotatable optical connector and into the transmitting means during winding and unwinding of the tubing on the spool while maintaining sufficient power to advance a borehole.

There is still further provided a system and a method for providing high power laser energy to the bottom of deep boreholes, the system and method comprising employing a high powered laser source, from for example about 1 kW to about 20 k W, which provides a high power laser beam, employing a means for transmitting the laser beam from the high power laser source to the bottom of a deep borehole, the employed transmitting means having a means for suppressing nonlinear scattering phenomena whereby, high power laser energy is delivered to the bottom of the borehole with sufficient power to advance the borehole.

There is additionally provided a system for providing high power laser energy to the bottom of deep boreholes, the system comprising a high powered laser capable of providing a high power laser beam, a means for transmitting the laser beam from the high power laser to the bottom of a deep borehole, and the transmitting means having a means for increasing the maximum transmission power; whereby, high power laser energy is delivered to the bottom of the borehole with sufficient power to advance.

Moreover, there is provided a system for providing high power laser energy to the bottom of deep boreholes, the system comprising: a high powered laser capable of providing a high power laser beam; a means for transmitting the laser beam from the high power laser to the bottom of a deep borehole; and, the transmitting means having a means for increasing power threshold; whereby high power laser energy is delivered to the bottom of the borehole with sufficient power to advance the borehole.

Furthermore methods are provided herein such as a method of advancing a borehole using a laser, which method comprises: advancing a high power laser beam transmission means into a borehole; the borehole having a bottom surface, a top opening, and a length extending between the bottom surface and the top opening of at least about 1000 feet; the transmission means comprising a distal end, a proximal end, and a length extending between the distal and proximal ends, the distal end being advanced down the borehole; the transmission means comprising a means for transmitting high power laser energy; providing a high power laser beam to the proximal end of the transmission means; transmitting substantially all of the power of the laser beam down the length of the transmission means so that the beam exits the distal end; and, directing the laser beam to the bottom surface of the borehole whereby the length of the borehole is increased, in part, based upon the interaction of the laser beam with the bottom of the borehole.

Still further there is provided a method of advancing a borehole using a laser comprising: advancing a high power laser beam transmission fiber into a borehole; the borehole having a bottom surface, a top opening, and a length extending between the bottom surface and the top opening of at least about 1000 feet, the transmission fiber comprising a distal end, a proximal end, and a length extending between the distal and proximal ends, the distal end being advanced down the borehole, the transmission fiber comprising a means for suppressing nonlinear scattering phenomena; providing a high power laser beam to the proximal end of the transmission means; transmitting the power of the laser beam down the length of the transmission fiber so that the beam exits the distal end; and, directing the laser beam to the bottom surface of the borehole whereby the length of the borehole is increased, in part, based upon the interaction of the laser beam with the bottom of the borehole.

Yet further there is contemplated a method of advancing a borehole using a laser, the method having an advancing a high power laser beam transmission fiber into a borehole, where the borehole has a bottom surface, a top opening, and a length extending between the bottom surface and the top opening of at least about 1000 feet; the transmission fiber comprising a distal end, a proximal end, and a length extending between the distal and proximal ends, the distal end being advanced down the borehole; the transmission fiber comprising a means for increasing the maximum transmission power; providing a high power laser beam to the proximal end of the transmission means; transmitting the power of the laser beam down the length of the transmission fiber so that the beam exits the distal end; and, directing the laser beam to the bottom surface of the borehole whereby the length of the borehole is increased, in part, based upon the interaction of the laser beam with the bottom of the borehole.

Still additionally there is provided a method of advancing a borehole using a laser, the method comprising: advancing a high power laser beam transmission fiber into a borehole; the borehole having a bottom surface, a top opening, and a length extending between the bottom surface and the top opening of at least about 1000 feet; the transmission fiber comprising a distal end, a proximal end, and a length extending between the distal and proximal ends, the distal end being advanced down the borehole; the transmission fiber comprising a means for increasing power threshold; providing a high power laser beam to the proximal end of the transmission means; transmitting the power of the laser beam down the length of the transmission fiber so that the beam exits the distal end; and, directing the laser beam to the bottom surface of the borehole whereby the length of the borehole is increased in part based upon the interaction of the laser beam with the bottom of the borehole.

Additionally there is provided a high power laser drilling system for advancing a borehole comprising: a source of high power laser energy, the laser source capable of providing a laser beam having at least 5 kW of power, at least about 10 kW, at least about 15 kW, and at least about 29 kW; a tubing assembly, the tubing assembly having at least 1000 feet of tubing, having a distal end and a proximal; the proximal end of the tubing being in optical communication with the laser source, whereby the laser beam can be transported in association with the tubing; the tubing comprising a high power laser transmission cable, the transmission cable having a distal end and a proximal end, the proximal end being in optical communication with the laser source, whereby the laser beam is transmitted by the cable from the proximal end to the distal end of the cable for delivery of the laser beam energy to the borehole; and, the power of the laser energy at the distal end of the cable when the cable is within a borehole being at least about 2 kW, at least about 3 kW of power at the distal end of the cable within the borehole, at least about 5 kW of power at the distal end of the cable within the borehole, at least about 7 kW of power at the distal end.

These systems and methods herein wherein the high power laser energy source provides a laser beam having at least about 10 kW of power and at least about 3 kW of power at the distal end of the cable within the borehole, this system wherein the high power laser energy source provides a laser beam having at least about 15 kW of power and at least about 5 kW of power at the distal end of the cable within the borehole, and this system wherein the high power laser energy source provides a laser beam having at least about 20 kW of power and at least about 7 kW of power at the distal end are provided.

These systems and methods herein wherein the power of the laser energy at the distal end of the cable when the cable is within a borehole is at least about 4 kW, is at least about 14 kW and is at least about 19 kW are provided. These systems wherein the tubing assembly is a coiled tubing rig having at least 4000 ft of coiled tubing is provided.

The systems and methods provided herein wherein the laser source comprises a single laser, comprises two lasers and comprises a plurality of lasers is provided One of ordinary skill in the art will recognize, based on the teachings set forth in these specifications and drawings, that there are various embodiments and implementations of these teachings to practice the present invention. Accordingly, the embodiments in this summary are not meant to limit these teachings in any way.

DESCRIPTION OF THE DRAWINGS AND THE PREFERRED EMBODIMENTS

In general, the present inventions relate to methods, apparatus and systems for use in laser drilling of a borehole in the earth, and further, relate to equipment, methods and systems for the laser advancing of such boreholes deep into the earth and at highly efficient advancement rates. These highly efficient advancement rates are obtainable because the present invention provides for a means to get high power laser energy to the bottom of the borehole, even when the bottom is at great depths.

Figure 1:
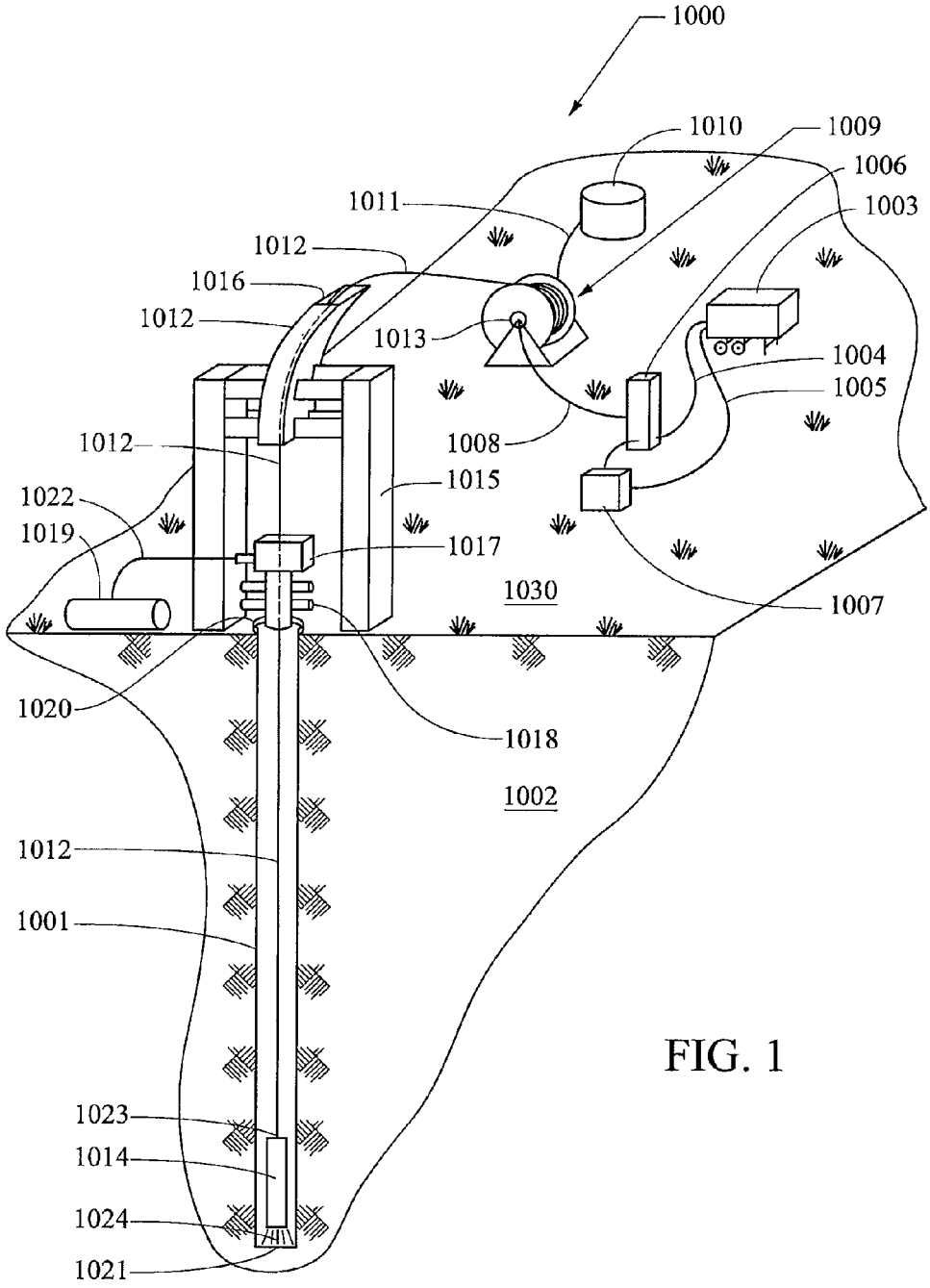
FIG. 1 is a. cross sectional view of the earth, a borehole and an example of a system of the present invention for advancing a borehole.

Thus, in general, and by way of example, there is provided in FIG. 1 a high efficiency laser drilling system 1000 for creating a borehole 1001 in the earth 1002. As used herein the term "earth" should be given its broadest possible meaning (unless expressly stated otherwise) and would include, without limitation, the ground, all natural materials, such as rocks, and artificial materials, such as concrete, that are or may be found in the ground, including without limitation rock layer formations, such as, granite, basalt, sandstone, dolomite, sand, salt, limestone, rhyolite, quartzite and shale rock.

FIG. 1 provides a cut away perspective view showing the surface of the earth 1030 and a cut away of the earth below the surface 1002. In general and by way of example, there is provided a source of electrical power 1003, which provides electrical power by cables 1004 and 1005 to a laser 1006 and a chiller 1007 for the laser 1006. The laser provides a laser beam, i.e., laser energy, that can be conveyed by a laser beam transmission means 1008 to a spool of coiled tubing 1009. A source of fluid 1010 is provided. The fluid is conveyed by fluid conveyance means 1011 to the spool of coiled tubing 1009.

The spool of coiled tubing 1009 is rotated to advance and retract the coiled tubing 1012. Thus, the laser beam transmission means 1008 and the fluid conveyance means 1011 are attached to the spool of coiled tubing 1009 by means of rotating coupling means 1013. The coiled tubing 1012 contains a means to transmit the laser beam along the entire length of the coiled tubing, i.e., "long distance high power laser beam transmission means," to the bottom hole assembly, 1014. The coiled tubing 1012 also contains a means to convey the fluid along the entire length of the coiled tubing 1012 to the bottom hole assembly 1014.

Additionally, there is provided a support structure 1015, which holds an injector 1016, to facilitate movement of the coiled tubing 1012 in the borehole 1001. Further other support structures may be employed for example such structures could be derrick, crane, mast, tripod, or other similar type of structure or hybrid and combinations of these. As the borehole is advance to greater depths from the surface 1030, the use of a diverter 1017, a blow out preventer (BOP) 1018, and a fluid and/or cutting handling system 1019 may become necessary. The coiled tubing 1012 is passed from the injector 1016 through the diverter 1017, the BOP 1018, a wellhead 1020 and into the borehole 1001.

The fluid is conveyed to the bottom 1021 of the borehole 1001. At that point the fluid exits at or near the bottom hole assembly 1014 and is used, among other things, to carry the cuttings, which are created from advancing a borehole, back up and out of the borehole. Thus, the diverter 1017 directs the fluid as it returns carrying the cuttings to the fluid and/or cuttings handling system 1019 through connector 1022. This handling system 1019 is intended to prevent waste products from escaping into the environment and separates and cleans waste products and either vents the cleaned fluid to the air, if permissible environmentally and economically, as would be the case if the fluid was nitrogen, or returns the cleaned fluid to the source of fluid 1010, or otherwise contains the used fluid for later treatment and/or disposal.

The BOP 1018 serves to provide multiple levels of emergency shut off and/or containment of the borehole should a high-pressure event occur in the borehole, such as a potential blow-out of the well. The BOP is affixed to the wellhead 1020. The wellhead in turn may be attached to casing. For the purposes of simplification the structural components of a borehole such as casing, hangers, and cement are not shown. It is understood that these components may be used and will vary based upon the depth, type, and geology of the borehole, as well as, other factors.

The downhole end 1023 of the coiled tubing 1012 is connected to the bottom hole assembly 1014. The bottom hole assembly 1014 contains optics for delivering the laser beam 1024 to its intended target, in the case of FIG. 1, the bottom 1021 of the borehole 1001. The bottom hole assembly 1014, for example, also contains means for delivering the fluid.

Thus, in general this system operates to create and/or advance a borehole by having the laser create laser energy in the form of a laser beam. The laser beam is then transmitted from the laser through the spool and into the coiled tubing. At which point, the laser beam is then transmitted to the bottom hole assembly where it is directed toward the surfaces of the earth and/or borehole. Upon contacting the surface of the earth and/or borehole the laser beam has sufficient power to cut, or otherwise effect, the rock and earth creating and/or advancing the borehole. The laser beam at the point of contact has sufficient power and is directed to the rock and earth in such a manner that it is capable of borehole creation that is comparable to or superior to a conventional mechanical drilling operation. Depending upon the type of earth and rock and the properties of the laser beam this cutting occurs through spalling, thermal dissociation, melting, vaporization and combinations of these phenomena.

Although not being bound by the present theory, it is presently believed that the laser material interaction entails the interaction of the laser and a fluid or media to clear the area of laser illumination. Thus the laser illumination creates a surface event and the fluid impinging on the surface rapidly transports the debris, i.e. cuttings and waste, out of the illumination region. The fluid is further believed to remove heat either on the macro or micro scale from the area of illumination, the area of post-illumination, as well as the borehole, or other media being cut, such as in the case of perforation.

The fluid then carries the cuttings up and out of the borehole. As the borehole is advanced the coiled tubing is unspooled and lowered further into the borehole. In this way the appropriate distance between the bottom hole assembly and the bottom of the borehole can be maintained. If the bottom hole assembly needs to be removed from the borehole, for example to case the well, the spool is wound up, resulting in the coiled tubing being pulled from the borehole. Additionally, the laser beam may be directed by the bottom hole assembly or other laser directing tool that is placed down the borehole to perform operations such as perforating, controlled perforating, cutting of casing, and removal of plugs. This system may be mounted on readily mobile trailers or trucks, because its size and weight are substantially less than conventional mechanical rigs.

The Laser.

For systems of the general type illustrated in FIG. 1, having the laser located outside of the borehole, the laser may be any high powered laser that is capable of providing sufficient energy to perform the desired functions, such advancing the borehole into and through the earth and rock believed to be present in the geology corresponding to the borehole. The laser source of choice is a single mode laser or low order multi-mode laser with a low $M^2$ to facilitate launching into a small core optical fiber, i.e. about 50 microns. However, larger core fibers are preferred. Examples of a laser source include fiber lasers, chemical lasers, disk lasers, thin slab lasers, high brightness diode lasers, as well as, the spectral beam combination of these laser sources or a coherent phased array laser of these sources to increase the brightness of the individual laser source.

Figure 4:
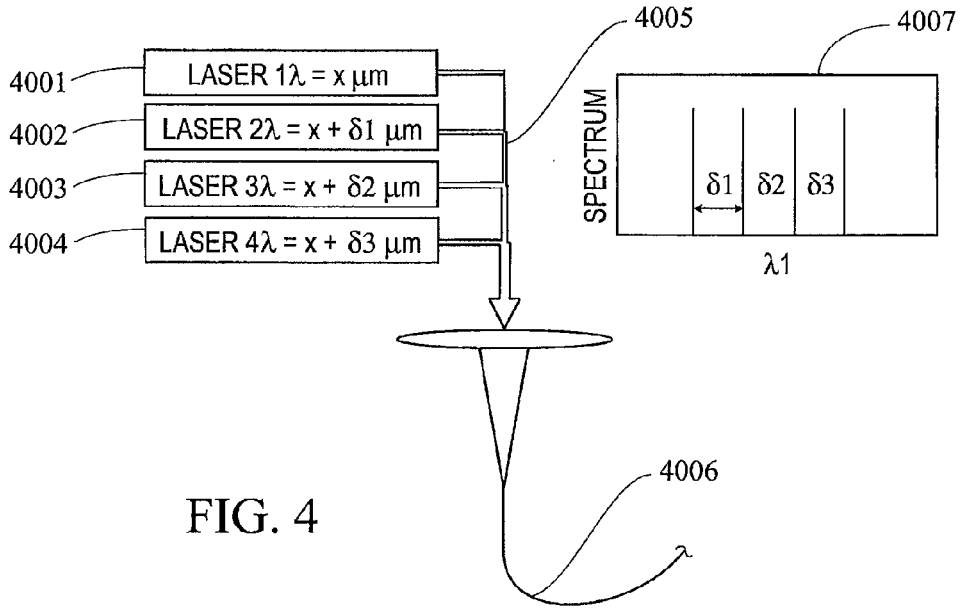
FIG. 4 is schematic diagram for a configuration of lasers.

For example, FIG. 4 Illustrates a spectral beam combination of lasers sources to enable high power transmission down a fiber by allocating a predetermined amount of power per color as limited by the Stimulated Brillioun Scattering (SBS) phenomena. Thus, there is provided in FIG. 4 a first laser source 4001 having a first wavelength of "x", where x is less than 1 micron. There is provided a second laser 4002 having a second wavelength of $x+\delta 1$ microns, where $\delta 1$ is a predetermined shift in wavelength, which shift could be positive or negative. There is provided a third laser 4003 having a third wavelength of $x+\delta 1+\delta 2$ microns and a fourth laser 4004 having a wavelength of $x+\delta 1+\delta 2+\delta 3$ microns. The laser beams are combined by a beam combiner 4005 and transmitted by an optical fiber 4006. The combined beam having a spectrum show in 4007.

Figure 5:
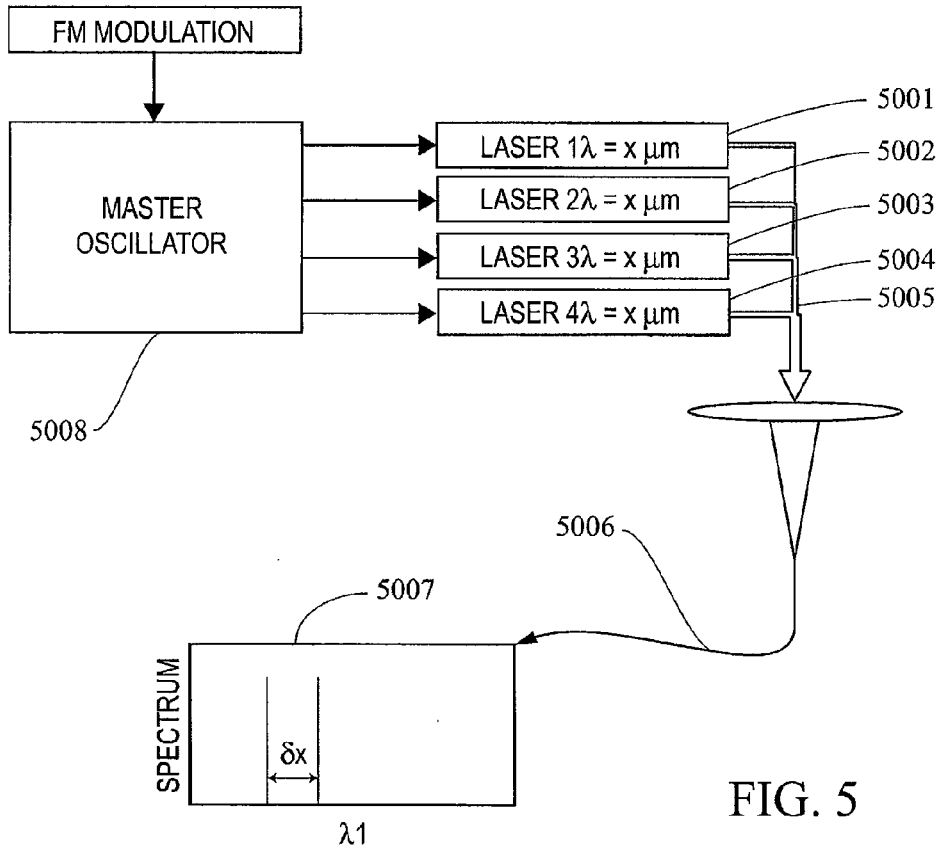
FIG. 5 is a schematic diagram for a configuration of lasers.

For example, FIG. 5. Illustrates a frequency modulated phased array of lasers. Thus, there is provided a master oscillator than can be frequency modulated, directly or indirectly, that is then used to injection-lock lasers or amplifiers to create a higher power composite beam than can be achieved by any individual laser. Thus, there are provided lasers 5001, 5002, 5003, and 5004, which have the same wavelength. The laser beams are combined by a beam combiner 5005 and transmitted by an optical fiber 5006. The lasers 5001, 5002, 5003 and 5004 are associated with a master oscillator 5008 that is FM modulated. The combined beam having a spectrum show in 5007, where $\delta$ is the frequency excursion of the FM modulation. Such lasers are disclosed in U.S. Pat. No. 5,694,408, the disclosure of which is incorporated here in reference in its entirety.

The laser source may be a low order mode source ($M^2<2$) so it can be focused into an optical fiber with a mode diameter of <100 microns. Optical fibers with small mode field diameters ranging from 50 microns to 6 microns have the lowest transmission losses. However, this should be balanced by the onset of non-linear phenomenon and the physical damage of the face of the optical fiber requiring that the fiber diameter be as large as possible while the transmission losses have to be as small as possible.

Thus, the laser source should have total power of at least about 1 kW, from about 1 kW to about 20 kW, from about 10 kW to about 20 kW, at least about 10 kW, and preferably about 20 or more kW. Moreover, combinations of various lasers may be used to provide the above total power ranges. Further, the laser source should have beam parameters in mm millirad as large as is feasible with respect to bendability and manufacturing substantial lengths of the fiber, thus the beam parameters may be less than about 100 mm millirad, from single mode to about 50 mm millirad, less than about 50 mm millirad, less than about 15 mm millirad, and most preferably about 12 mm millirad. Further, the laser source should have at least a 10% electrical optical efficiency, at least about 50% optical efficiency, at least about 70% optical efficiency, whereby it is understood that greater optical efficiency, all other factors being equal, is preferred, and preferably at least about 25%. The laser source can be run in either pulsed or continuous wave (CW) mode. The laser source is preferably capable of being fiber coupled.

For advancing boreholes in geologies containing hard rock formations such as granite and basalt it is preferred to use the IPG 20000YB having the following specifications set forth in Table 1 herein.

TABLE 1

| Optical Characteristics | | | | | | |
|---|---|---|---|---|---|---|
| Characteristics | Test conditions | Symbol | Min. | Typ. | Max | Unit |
| Operation Mode | | | | CW, QCW | | |
| Polarization | | | | Random | | |
| Nominal Output Power | | $P_{NOM}$ | 20000* | | | W |
| Output Power Tuning Range | | | 10 | | 100 | % |
| Emission Wavelength | $P_{OUT}$ = 20 kW | | 1070 | | 1080 | nm |
| Emission Linewidth | $P_{OUT}$ = 20 kW | | | 3 | 6 | nm |
| Switching ON/OFF Time | $P_{OUT}$ = 20 kW | | | 80 | 100 | μsec |
| Output Power Modulation Rate | $P_{OUT}$ = 20 kW | | | | 5.0 | kHz |
| Output Power Stability | Over 8 hrs, $T_{WATER}$ = Const | | | 1.0 | 2.0 | % |
| Feeding Fiber Core Diameter | | | | 200 | | μm |
| Beam Parameter Product | 200 μm | BPP | | 12 | 14 | mm * mrad |
| Feeding Fiber | | | | | | |
| Fiber Length | | L | | 10 | | m |
| Fiber Cable Bend Radius: | | | | | | |
| unstressed | | R | 100 | | | |
| stressed | | | 200 | | | mm |
| Output Termination | | | IPG HLC-8 Connector (QBH compatible) | | | |
| Aiming Laser Wavelength | | | 640 | | 680 | nm |
| Aiming Laser Output Power | | | 0.5 | | 1 | mW |

| Parameters | Test conditions | Min. | Typ. | Max | Unit |
|---|---|---|---|---|---|
| Operation Voltage (3 phases) | | 440 V | 480 | 520 | VAC |
| Frequency | | | 50/60 | | Hz |
| Power Consumption | $P_{OUT}$ = 20 kW | | 75 | 80 | kW |
| Operating Temperature Range | | +15 | | +40 | ° C. |
| Humidity: | | | | | |
| without conditioner | T < 25° C. | | | 90 | % |
| with built-in conditioner | T < 40° C. | | | 95 | |
| Storage Temperature | Without water | −40 | | +75 | ° C |
| Dimensions, H × W × D | NEMA-12; IP-55 | | 1490 × 1480 × 810 | | mm |
| Weight | | | 1200 | | kg |
| Plumbing | | | NPT Threaded Stainless Steel and/or Plastic Tubing | | |

*Output power tested at connector at distance not greater than 50 meters from laser.

For cutting casing, removal of plugs and perforation operations the laser may be any of the above referenced lasers, and it may further be any smaller lasers that would be only used for workover and completion downhole activities.

In addition to the configuration of FIG. 1, and the above preferred examples of lasers for use with the present invention other configurations of lasers for use in a high efficiency laser drilling systems are contemplated. Thus, Laser selection may generally be based on the intended application or desired operating parameters. Average power, specific power, irradiance, operation wavelength, pump source, beam spot size, exposure time, and associated specific energy may be considerations in selecting a laser. The material to be drilled, such as rock formation type, may also influence laser selection. For example, the type of rock may be related to the type of resource being pursued. Hard rocks such as limestone and granite may generally be associated with hydrothermal sources, whereas sandstone and shale may generally be associated with gas or oil sources. Thus by way of example, the laser may be a solid-state laser, it may be a gas, chemical, dye or metal-vapor laser, or it may be a semiconductor laser. Further, the laser may produce a kilowatt level laser beam, and it may be a pulsed laser. The laser further may be a Nd:YAG laser, a $CO_2$ laser, a diode laser, such as an infrared diode laser, or a fiber laser, such as a ytterbium-doped multi-clad fiber laser. The infrared fiber laser emits light in the wavelengths ranges from 800 nm to 1600 nm. The fiber laser is doped with an active gain medium comprising rare earth elements, such as holmium, erbium, ytterbium, neodymium, dysprosium, praseodymium, thulium or combinations thereof. Combinations of one or more types of lasers may be implemented.

Fiber lasers of the type useful in the present invention are generally built around dual-core fibers. The inner core may be composed of rare-earth elements; ytterbium, erbium, thulium, holmium or a combination. The optical gain medium emits wavelengths of 1064 nm, 1360 nm, 1455 nm, and 1550 nm, and can be diffraction limited. An optical diode may be coupled into the outer core (generally referred to as the inner cladding) to pump the rare earth ion in the inner core. The outer core can be a multi-mode waveguide. The inner core serves two purposes: to guide the high power laser; and, to provide gain to the high power laser via the excited rare earth ions. The outer cladding of the outer core may be a low index polymer to reduce losses and protect the fiber. Typical pumped laser diodes emit in the range of about 915-980 nm (generally—940 nm). Fiber lasers are manufactured from IPG Photonics or Southhampton Photonics. High power fibers were demonstrated to produce 50 kW by IPG Photonics when multiplexed.

In use, one or more laser beams generated or illuminated by the one or more lasers may spall, vaporize or melt material, such as rock. The laser beam may be pulsed by one or a plurality of waveforms or it may be continuous. The laser beam may generally induce thermal stress in a rock formation due to characteristics of the material, such as rock including, for example, the thermal conductivity. The laser beam may also induce mechanical stress via superheated steam explosions of moisture in the subsurface of the rock formation. Mechanical stress may also be induced by thermal decompositions and sublimation of part of the in situ mineral of the material. Thermal and/or mechanical stress at or below a laser-material interface may promote spallation of the material, such as rock. Likewise, the laser may be used to effect well casings, cement or other bodies of material as desired. A laser beam may generally act on a surface at a location where the laser beam contacts the surface, which may be referred to as a region of laser illumination. The region of laser illumination may have any preselected shape and intensity distribution that is required to accomplish the desired outcome, the laser illumination region may also be referred to as a laser beam spot. Boreholes of any depth and/or diameter may be formed, such as by spalling multiple points or layers. Thus, by way of example, consecutive points may be targeted or a strategic pattern of points may be targeted to enhance laser/rock interaction. The position or orientation of the laser or laser beam may be moved or directed so as to intelligently act across a desired area such that the laser/material interactions are most efficient at causing rock removal.

One or more lasers may further be positioned downhole, i.e., down the borehole. Thus, depending upon the specific requirements and operation parameters, the laser may be located at any depth within the borehole. For example, the laser may be maintained relatively close to the surface, it may be positioned deep within the borehole, it may be maintained at a constant depth within the borehole or it may be positioned incrementally deeper as the borehole deepens. Thus, by way of further example, the laser may be maintained at a certain distance from the material, such as rock to be acted upon. When the laser is deployed downhole, the laser may generally be shaped and/or sized to fit in the borehole. Some lasers may be better suited than others for use downhole. For example, the size of some lasers may deem them unsuitable for use downhole, however, such lasers may be engineered or modified for use downhole. Similarly, the power or cooling of a laser may be modified for use downhole.

Systems and methods may generally include one or more features to protect the laser. This become important because of the harsh environments, both for surface units and downhole units. Thus, In accordance with one or more embodiments, a borehole drilling system may include a cooling system. The cooling system may generally function to cool the laser. For example, the cooling system may cool a downhole laser, for example to a temperature below the ambient temperature or to an operating temperature of the laser. Further, the laser may be cooled using sorption cooling to the operating temperature of the infrared diode laser, for example, about 20° C. to about 100° C. For a fiber laser its operating temperature may be between about 20° C. to about 50° C. A liquid at a lower temperature may be used for cooling when a temperature higher than the operating diode laser temperature is reached to cool the laser.

Heat may also be sent uphole, i.e., out of the borehole and to the surface, by a liquid heat transfer agent. The liquid transfer agent may then be cooled by mixing with a lower temperature liquid uphole. One or multiple heat spreading fans may be attached to the laser diode to spread heat away from the infrared diode laser. Fluids may also be used as a coolant, while an external coolant may also be used.

In downhole applications the laser may be protected from downhole pressure and environment by being encased in an appropriate material. Such materials may include steel, titanium, diamond, tungsten carbide and the like. The fiber head for an infrared diode laser or fiber laser may have an infrared transmissive window. Such transmissive windows may be made of a material that can withstand the downhole environment, while retaining transmissive qualities. One such material may be sapphire or other material with similar qualities. One or more infrared diode lasers or fiber lasers may be entirely encased by sapphire. By way of example, an infrared diode laser or fiber laser may be made of diamond, tungsten carbide, steel, and titanium other than the part where the laser beam is emitted.

In the downhole environment it is further provided by way of example that the infrared diode laser or fiber laser is not in contact with the borehole while drilling. For example, a downhole laser may be spaced from a wall of the borehole.

The Chiller.

The chiller, which is used to cool the laser, in the systems of the general type illustrated in FIG. 1 is chosen to have a cooling capacity dependent on the size of the laser, the efficiency of the laser, the operating temperature, and environmental location, and preferably the chiller will be selected to operate over the entirety of these parameters. Preferably, an example of a chiller that is useful for a 20 kW laser will have the following specifications set forth in Table 2 herein.

TABLE 2

| Chiller PC400.01-NZ-DIS | |
|---|---|
| Technical Data for 60 Hz operation: IPG-Laser type | |
| Cooling capacity net | YLR-15000, YLR-20000 |
| Refrigerant | 60.0 kW |
| Necessary air flow | R407C |
| Installation | 26100 $m^3/h$ |
| Number of compressors | Outdoor installation |
| Number of fans | 2 |
| Number of pumps | 3 |
| | 2 |
| Operation Limits | |
| Designed Operating Temperature | 33° C. (92 F.) |
| Operating Temperature min. | (−) 20° C. (−4 F.) |

TABLE 2-continued

| Chiller PC400.01-NZ-DIS | |
|---|---|
| Operating Temperature max. | 39° C. (102 F.) |
| Storage Temperature min. (with empty water tank) | (−) 40° C. (−40 F.) |
| Storage Temperature max. | 70° C. (158 F.) |
| Tank volume regular water | 240 Liter (63.50 Gallon) |
| Tank volume DI water | 25 Liter (6.61 Gallon) |
| Electrical Data for 60 Hz operation: | |
| Designed power consumption without heater | 29.0 kW |
| Designed power consumption with heater | 33.5 kW |
| Power consumption max. | 41.0 kW |
| Current max. | 60.5 A |
| Fuse max. | 80.0 A |
| Starting current | 141.0 A |
| Connecting voltage | 460 V/3 Ph/PE |
| Frequency | 60 Hz |
| Tolerance connecting voltage | +/−10% |
| Dimensions, weights and sound level | |
| Weight with empty tank | 900 KG (1984 lbs) |
| Sound level at distance of 5 m | 68 dB(A) |
| Width | 2120 mm (83½ inches) |
| Depth | 860 mm (33⅞ inches) |
| Height | 1977 mm (77⅞ inches) |
| Tap water circuit | 0 |
| Cooling capacity | 56.0 kW |
| Water outlet temperature | 21° C. (70 F.) |
| Water inlet temperature | 26° C. (79 F.) |
| Temperature stability | +/−1.0 K |
| Water flow vs. water pressure free available | 135 l/min at 3.0 bar (35.71 GPM at 44 PSI) |
| Water flow vs. water pressure free available | 90 l/min at 1.5 bar (23.81 GPM at 21 PSI) |
| De-ionized water circuit | |
| Cooling capacity | 4.0 kW |
| Water outlet temperature | 26° C. (79 F.) |
| Water inlet temperature | 31° C. (88 F.) |
| Temperature stability | +/−1.0 K |
| Water flow vs. water pressure free available | 20 l/min at 1.5 bar (5.28 GPM at 21 PSI) |
| Waterflow vs. water pressure free available | 15 l/min at 4.0 bar (3.96 GPM at 58 PSI) |
| Options (included) | |
| Bifrequent version: | |
| 400 V/3 Ph/50 Hz | |
| 460 V/3 Ph 60 Hz | |

The Spool

For systems of the general type illustrated in FIG. 1, the laser beam is transmitted to the spool of coiled tubing by a laser beam transmission means. Such a transmittance means may be by a commercially available industrial hardened fiber optic cabling with QBH connectors at each end.

There are two basic spool approaches, the first is to use a spool which is simply a wheel with conduit coiled around the outside of the wheel. For example, this coiled conduit may be a hollow tube, it may be an optical fiber, it may be a bundle of optical fibers, it may be an armored optical fiber, it may be other types of optically transmitting cables or it may be a hollow tube that contains the aforementioned optically transmitting cables.

The spool in this configuration has a hollow central axis where the optical power is transmitted to the input end of the optical fiber. The beam will be launched down the center of the spool, the spool rides on precision bearings in either a horizontal or vertical orientation to prevent any tilt of the spool as the fiber is spooled out. It is optimal for the axis of the spool to maintain an angular tolerance of about +/−10 microradians, which is preferably obtained by having the optical axis isolated and/or independent from the spool axis of rotation. The beam when launched into the fiber is launched by a lens which is rotating with the fiber at the Fourier Transform plane of the launch lens, which is insensitive to movement in the position of the lens with respect the laser beam, but sensitive to the tilt of the incoming laser beam. The beam, which is launched in the fiber, is launched by a lens that is stationary with respect to the fiber at the Fourier Transform plane of the launch lens, which is insensitive to movement of the fiber with respect to the launch lens.

A second approach is to use a stationary spool similar to a creel and rotate the laser head as the fiber spools out to keep the fiber from twisting as it is extracted from the spool. If the fiber can be designed to accept a reasonable amount of twist along its length, then this would be the preferred method. Using the second approach if the fiber could be pre-twisted around the spool then as the fiber is extracted from the spool, the fiber straightens out and there is no need for the fiber and the drill head to be rotated as the fiber is played out. There will be a series of tensioners that will suspend the fiber down the hole, or if the hole is filled with water to extract the debris from the bottom of the hole, then the fiber can be encased in a buoyant casing that will support the weight of the fiber and its casing the entire length of the hole. In the situation where the bottom hole assembly does not rotate and the fiber is twisted and placed under twisting strain, there will be the further benefit of reducing SBS as taught herein.

For systems of the general type illustrated in FIG. 1, the spool of coiled tubing can contain the following exemplary lengths of coiled tubing: from 1 km (3,280 ft) to 9 km (29,528 ft); from 2 km (6,561 ft) to 5 km (16,404 ft); at least about 5 km (16,404 ft); and from about 5 km (16,404 ft) to at least about 9 km (29,528 ft). The spool may be any standard type spool using 2.875 steel pipe. For example commercial spools typically include 4-6 km of steel 2⅞" tubing, Tubing is available in commercial sizes ranging from 1" to 2⅞".

Preferably, the Spool will have a standard type 2⅞" hollow steel pipe, i.e., the coiled tubing. As discussed in further herein, the coiled tubing will have in it at least one optical fiber for transmitting the laser beam to the bottom hole assembly. In addition to the optical fiber the coiled tubing may also carry other cables for other downhole purposes or to transmit material or information back up the borehole to the surface. The coiled tubing may also carry the fluid or a conduit for carrying the fluid. To protect and support the optical fibers and other cables that are carried in the coiled tubing stabilizers may be employed.

The spool may have QBH fibers and a collimator. Vibration isolation means are desirable in the construction of the spool, and in particular for the fiber slip ring, thus for example the spool's outer plate mounts to the spool support using a Delrin plate, while the inner plate floats on the spool and pins rotate the assembly. The fiber slip ring is the stationary fiber, which communicates power across the rotating spool hub to the rotating fiber.

When using a spool the mechanical axis of the spool is used to transmit optical power from the input end of the optical fiber to the distal end. This calls for a precision optical bearing system (the fiber slip ring) to maintain a stable alignment between the external fiber providing the optical power and the optical fiber mounted on the spool. The laser can be mounted inside of the spool, or as shown in FIG. 1 it can be mounted external to the spool or if multiple lasers are employed both internal and external locations may be used. The internally mounted laser may be a probe laser, used for analysis and monitoring of the system and methods performed by the system. Further, sensing and monitoring equipment may be located inside of or otherwise affixed to the rotating elements of the spool.

There is further provided rotating coupling means to connect the coiled tubing, which is rotating, to the laser beam transmission means 1008, and the fluid conveyance means 1011, which are not rotating. As illustrated by way of example in FIG. 2, a spool of coiled tubing 2009 has two rotating coupling means 2013. One of said coupling means has an optical rotating coupling means 2002 and the other has a fluid rotating coupling means 2003. The optical rotating coupling means 2002 can be in the same structure as the fluid rotating coupling means 2003 or they can be separate. Thus, preferably, two separate coupling means are employed. Additional rotating coupling means may also be added to handle other cables, such as for example cables for downhole probes.

The optical rotating coupling means 2002 is connected to a hollow precision ground axle 2004 with bearing surfaces 2005, 2006. The laser transmission means 2008 is optically coupled to the hollow axle 2004 by optical rotating coupling means 2002, which permits the laser beam to be transmitted from the laser transmission means 2008 into the hollow axle 2004. The optical rotating coupling means for example may be made up of a QBH connector, a precision collimator, and a rotation stage, for example a Precitec collimator through a Newport rotation stage to another Precitec collimator and to a QBH collimator. To the extent that excessive heat builds up in the optical rotating coupling cooling should be applied to maintain the temperature at a desired level.

The hollow axle 2004 then transmits the laser beam to an opening 2007 in the hollow axle 2004, which opening contains an optical coupler 202010 that optically connects the hollow axle 2004 to the long distance high power laser beam transmission means 2025 that is located inside of the coiled tubing 2012. Thus, in this way the laser transmission means 2008, the hollow axle 2004 and the long distance high power laser beam transmission means 2025 are rotatably optically connected, so that the laser beam can be transmitted from the laser to the long distance high power laser beam transmission means 2025.

Figure 6:
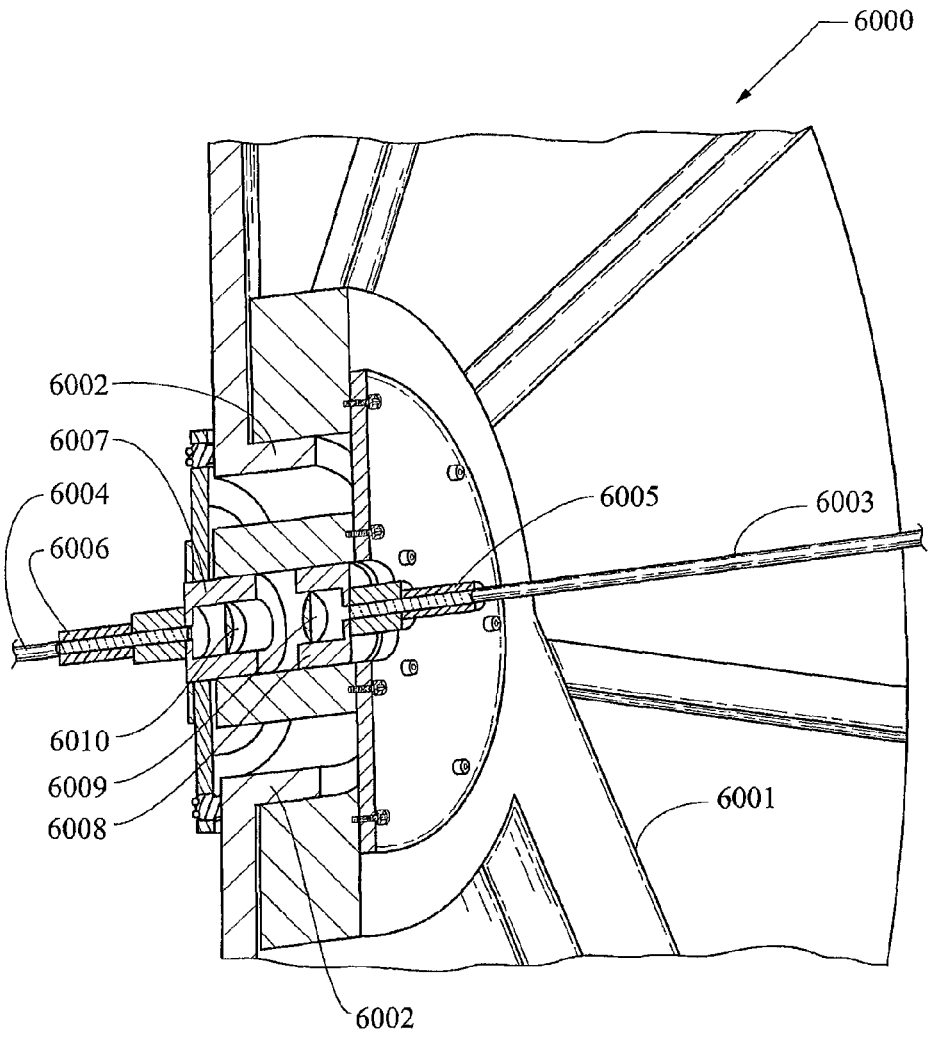
FIG. 6 is a perspective cutaway of a spool and optical rotatable coupler.

A further illustration of an optical connection for a rotation spool is provided in FIG. 6, wherein there is illustrated a spool 6000 and a support 6001 for the spool 6000. The spool 6000 is rotatably mounted to the support 6001 by load bearing bearings 6002. An input optical cable 6003, which transmits a laser beam from a laser source (not shown in this figure) to an optical coupler 6005. The laser beam exits the connector 6005 and passes through optics 6009 and 6010 into optical coupler 6006, which is optically connected to an output optical cable 6004. The optical coupler 6005 is mounted to the spool by a preferably non-load bearing bearing 6008, while coupler 6006 is mounted to the spool by device 6007 in a manner that provides for its rotation with the spool. In this way as the spool is rotated, the weight of the spool and coiled tubing is supported by the load bearing bearings 6002, while the rotatable optical coupling assembly allows the laser beam to be transmitted from cable 6003 which does not rotate to cable 6004 which rotates with the spool.

Figure 2:
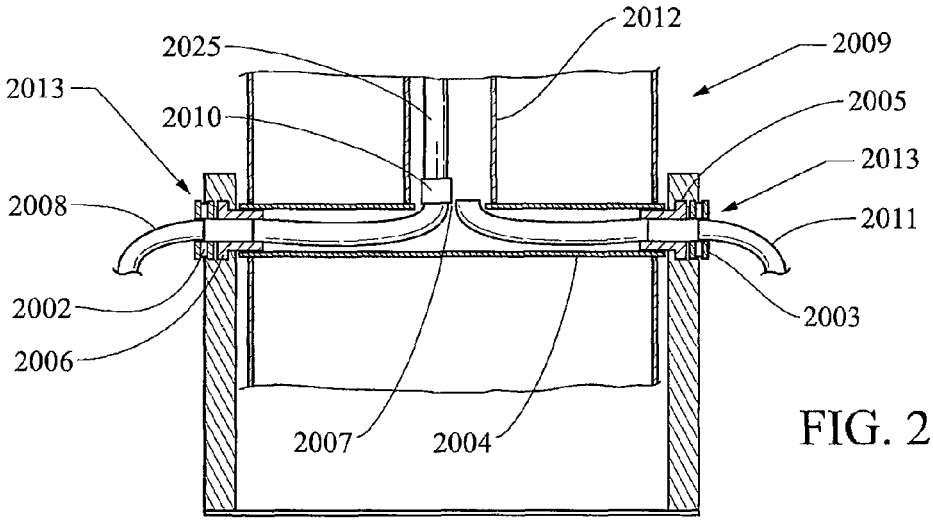
FIG. 2 is a view of a spool.
Figure 3A:
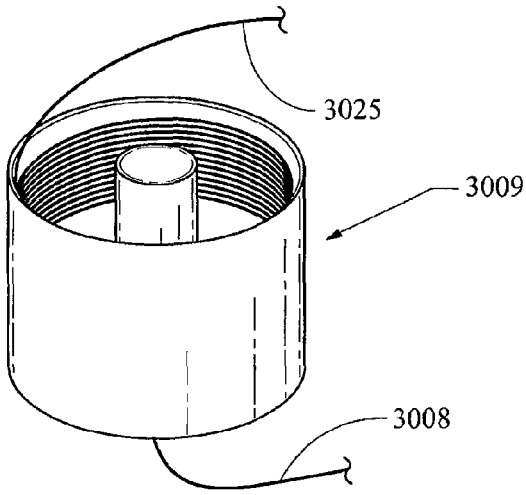
FIGS. 3A and 3B are views of a creel.
Figure 3B:
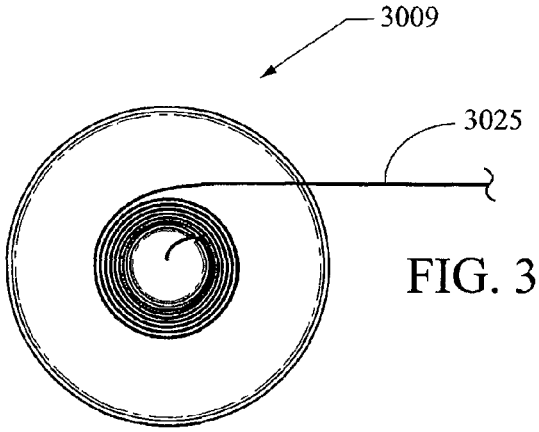

In addition to using a rotating spool of coiled tubing, as illustrated in FIGS. 1 and 2, another means for extending and retrieving the long distance high powered laser beam transmission means is a stationary spool or creel. As illustrated, by way of example, in FIGS. 3A and 3B there is provided a creel 3009 that is stationary and which contains coiled within the long distance high power laser beam transmission means 3025. That means is connected to the laser beam transmission means 3008, which is connected to the laser (not shown in this figure). In this way the laser beam may be transmitted into the long distance high power laser beam transmission means and that means may be deployed down a borehole. Similarly, the long distance high power laser beam transmission means may be contained within coiled tubing on the creel. Thus, the long distance means would be an armored optical cable of the type provided herein. In using the creel consideration should be given to the fact that the optical cable will be twisted when it is deployed. To address this consideration the bottom hole assembly, or just the laser drill head, may be slowly rotated to keep the optical cable untwisted, the optical cable may be pre-twisted, and the optical cable may be designed to tolerate the twisting.

The Fluid

The source of fluid may be either a gas, a liquid, a foam, or system having multiple capabilities. The fluid may serve many purposes in the advancement of the borehole. Thus, the fluid is primarily used for the removal of cuttings from the bottom of the borehole, for example as is commonly referred to as drilling fluid or drilling mud, and to keep the area between the end of the laser optics in the bottom hole assembly and the bottom of the borehole sufficiently clear of cuttings so as to not interfere with the path and power of the laser beam. It also may function to cool the laser optics and the bottom hole assembly, as well as, in the case of an incompressible fluid, or a compressible fluid under pressure. The fluid further provides a means to create hydrostatic pressure in the well bore to prevent influx of gases and fluids.

Thus, in selecting the type of fluid, as well as the fluid delivery system, consideration should be given to, among other things, the laser wavelength, the optics assembly, the geological conditions of the borehole, the depth of the borehole, and the rate of cuttings removal that is needed to remove the cuttings created by the laser's advancement of the borehole. It is highly desirable that the rate of removal of cuttings by the fluid not be a limiting factor to the systems rate of advancing a borehole. For example fluids that may be employed with the present invention include conventional drilling muds, water (provided they are not in the optical path of the laser), and fluids that are transmissive to the laser, such as halocarbons, (halocarbon are low molecular weight polymers of chlorotrifluoroethylene (PCTFE)), oils and $N_2$. Preferably these fluids can be employed and preferred and should be delivered at rates from a couple to several hundred CFM at a pressure ranging from atmospheric to several hundred psi. If combinations of these fluids are used flow rates should be employed to balance the objects of maintaining the trasmissiveness of the optical path and removal of debris.

The Long Distance HPLB Transmission Means

Preferably the long distance high powered laser beam transmission means is an optical fiber or plurality of optical fibers in an armored casing to conduct optical power from about 1 kW to about 20 kW, from about 10 kW to about 20 kW, at least about 10 kW, and preferably about 20 or more kW average power down into a borehole for the purpose of sensing the lithology, testing the lithology, boring through the lithology and other similar applications relating in general to the creation, advancement and testing of boreholes in the earth. Preferably the armored optical fiber comprises a 0.64 cm (¼") stainless steel tube that has 1, 2, 1 to 10, at least 2, more than 2, at least about 50, at least about 100, and most preferably between 2 to 15 optical fibers in it. Preferably these will be about 500 micron core diameter baseline step index fibers At present it is believed that Industrial lasers use high power optical fibers armored with steel coiled around the fiber and a polymer jacket surrounding the steel jacket to prevent unwanted dust and dirt from entering the optical fiber environment. The optical fibers are coated with a thin coating of metal or a thin wire is run along with the fiber to detect a fiber break. A fiber break can be dangerous because it can result in the rupture of the armor jacket and would pose a danger to an operator. However, this type of fiber protection is designed for ambient conditions and will not withstand the harsh environment of the borehole.

Fiber optic sensors for the oil and gas industry are deployed both unarmored and armored. At present it is believed that the currently available unarmored approaches are unacceptable for the high power applications contemplated by this application. The current manifestations of the armored approach are similarly inadequate, as they do not take into consideration the method for conducting high optical power and the method for detecting a break in the optical fiber, both of which are important for a reliable and safe system. The current method for armoring an optical fiber is to encase it in a stainless steel tube, coat the fiber with carbon to prevent hydrogen migration, and finally fill the tube with a gelatin that both cushions the fiber and absorbs hydrogen from the environment. However this packaging has been performed with only small diameter core optical fibers (50 microns) and with very low power levels <1 Watt optical power.

Thus, to provide for a high power optical fiber that is useful in the harsh environment of a borehole, there is provided a novel armored fiber and method. Thus, it is provided to encase a large core optical fiber having a diameter equal to or greater than 50 microns, equal to or greater than 75 microns and most preferably equal to or greater than 100 microns, or a plurality of optical fibers into a metal tube, where each fiber may have a carbon coating, as well as a polymer, and may include Teflon coating to cushion the fibers when rubbing against each other during deployment. Thus the fiber, or bundle of fibers, can have a diameter of from about greater than or equal to 150 microns to about 700 microns, 700 microns to about 1.5 mm, or greater than 1.5 mm.

The carbon coating can range in thicknesses from 10 microns to >600 microns. The polymer or Teflon coating can range in thickness from 10 microns to >600 microns and preferred types of such coating are acrylate, silicone, polyimide, PFA and others. The carbon coating can be adjacent the fiber, with the polymer or Teflon coating being applied to it. Polymer or Teflon coatings are applied last to reduce binding of the fibers during deployment.

In some non-limiting embodiments, fiber optics may send up to 10 kW per a fiber, up to 20 kW per a fiber, up to and greater than 50 kw per fiber. The fibers may transmit any desired wavelength or combination of wavelengths. In some embodiments, the range of wavelengths the fiber can transmit may preferably be between about 800 nm and 2100 nm. The fiber can be connected by a connector to another fiber to maintain the proper fixed distance between one fiber and neighboring fibers. For example, fibers can be connected such that the beam spot from neighboring optical fibers when irradiating the material, such as a rock surface are under 2" and non-overlapping to the particular optical fiber. The fiber may have any desired core size. In some embodiments, the core size may range from about 50 microns to 1 mm or greater. The fiber can be single mode or multimode. If multimode, the numerical aperture of some embodiments may range from 0.1 to 0.6. A lower numerical aperture may be preferred for beam quality, and a higher numerical aperture may be easier to transmit higher powers with lower interface losses. In some embodiments, a fiber laser emitted light at wavelengths comprised of 1060 nm to 1080 nm, 1530 nm to 1600 nm, 1800 nm to 2100 nm, diode lasers from 800 nm to 2100 nm, $C0_2$ Laser at 10,600 nm, or Nd:YAG Laser emitting at 1064 nm can couple to the optical fibers. In some embodiments, the fiber can have a low water content. The fiber can be jacketed, such as with polyimide, acrylate, carbon polyamide, and carbon/dual acrylate or other material. If requiring high temperatures, a polyimide or a derivative material may be used to operate at temperatures over 300 degrees Celsius. The fibers can be a hollow core photonic crystal or solid core photonic crystal. In some embodiments, using hollow core photonic crystal fibers at wavelengths of 1500 nm or higher may minimize absorption losses.

The use of the plurality of optical fibers can be bundled into a number of configurations to improve power density. The optical fibers forming a bundle may range from two at hundreds of watts to kilowatt powers in each fiber to millions at milliwatts or microwatts of power. In some embodiments, the plurality of optical fibers may be bundled and spliced at powers below 2.5 kW to step down the power. Power can be spliced to increase the power densities through a bundle, such as preferably up to 10 kW, more preferably up to 20 kW, and even more preferably up to or greater than 50 kW. The step down and increase of power allows the beam spot to increase or decrease power density and beam spot sizes through the fiber optics. In most examples, splicing the power to increase total power output may be beneficial so that power delivered through fibers does not reach past the critical power thresholds for fiber optics.

Thus, by way of example there is provided the following configurations set forth in Table 3 herein.

TABLE 3

| Diameter of bundle | Number of fibers in bundle |
|---|---|
| 100 microns | 1 |
| 200 microns-1 mm | 2 to 100 |
| 100 microns-1 mm | 1 |

A thin wire may also be packaged, for example in the ¼" stainless tubing, along with the optical fibers to test the fiber for continuity. Alternatively a metal coating of sufficient thickness is applied to allow the fiber continuity to be monitored. These approaches, however, become problematic as the fiber exceeds 1 km in length, and do not provide a practical method for testing and monitoring.

The configurations in Table 3 can be of lengths equal to or greater than 1 m, equal to or greater than 1 km, equal to or greater than 2 km, equal to or greater than 3 km, equal to or greater than 4 km and equal to or greater than 5 km. These configuration can be used to transmit there through power levels from about 0.5 kW to about 10 kW, from greater than or equal to 1 kW, greater than or equal to 2 kW, greater than or equal to 5 kW, greater than or equal to 8 kW, greater than or equal to 10 kW and preferable at least about 20 kW.

In transmitting power over long distances, such as down a borehole or through a cable that is at least 1 km, there are three sources of power losses in an optical fiber, Raleigh Scattering, Raman Scattering and Brillioun Scattering. The first, Raleigh Scattering is the intrinsic losses of the fiber due to the impurities in the fiber. The second, Raman Scattering can result in Stimulated Raman Scattering in a Stokes or Anti-Stokes wave off of the vibrating molecules of the fiber. Raman Scattering occurs preferentially in the forward direction and results in a wavelength shift of up to +25 nm from the original wavelength of the source. The third mechanism, Brillioun Scattering, is the scattering of the forward propagating pump off of the acoustic waves in the fiber created by the high electric fields of the original source light (pump). This third mechanism is highly problematic and may create great difficulties in transmitting high powers over long distances. The Brillioun Scattering can give rise to Stimulated Brillioun Scattering (SBS) where the pump light is preferentially scattered backwards in the fiber with a frequency shift of approximately 1 to about 20 GHz from the original source frequency. This Stimulated Brillioun effect can be sufficiently strong to backscatter substantially all of the incident pump light if given the right conditions. Therefore it is desirable to suppress this nonlinear phenomenon. There are essentially four primary variables that determine the threshold for SBS: the length of the gain medium (the fiber); the linewidth of the source laser; the natural Brillioun linewidth of the fiber the pump light is propagating in; and, the mode field diameter of the fiber. Under typical conditions and for typical fibers, the length of the fiber is inversely proportional to the power threshold, so the longer the fiber, the lower the threshold. The power threshold is defined as the power at which a high percentage of incident pump radiation will be scattered such that a positive feedback takes place whereby acoustic waves are generated by the scattering process. These acoustic waves then act as a grating to incite further SBS. Once the power threshold is passed, exponential growth of scattered light occurs and the ability to transmit higher power is greatly reduced. This exponential growth continues with an exponential reduction in power until such point whereby any additional power input will not be transmitted forward which point is defined herein as the maximum transmission power. Thus, the maximum transmission power is dependent upon the SBS threshold, but once reached, the maximum transmission power will not increase with increasing power input.

Thus, as provided herein, novel and unique means for suppressing nonlinear scattering phenomena, such as the SBS and Stimulated Raman Scattering phenomena, means for increasing power threshold, and means for increasing the maximum transmission power are set forth for use in transmitting high power laser energy over great distances for, among other things, the advancement of boreholes.

The mode field diameter needs to be as large as practical without causing undue attenuation of the propagating source laser. Large core single mode fibers are currently available with mode diameters up to 30 microns, however bending losses are typically high and propagation losses are higher than desired. Small core step index fibers, with mode field diameters of 50 microns are of interest because of the low intrinsic losses, the significantly reduced launch fluence and the decreased SBS gain because the fiber is not polarization preserving, it also has a multi-mode propagation constant and a large mode field diameter. All of these factors effectively increase the SBS power threshold. Consequently, a larger core fiber with low Raleigh Scattering losses is a potential solution for transmitting high powers over great distances, preferably where the mode field diameter is 50 microns or greater in diameter.

The next consideration is the natural Brillioun linewidth of the fiber. As the Brillioun linewidth increases, the scattering gain factor decreases. The Brillioun linewidth can be broadened by varying the temperature along the length of the fiber, modulating the strain on the fiber and inducing acoustic vibrations in the fiber. Varying the temperature along the fiber results in a change in the index of refraction of the fiber and the background (kT) vibration of the atoms in the fiber effectively broadening the Brillioun spectrum. In down borehole application the temperature along the fiber will vary naturally as a result of the geothermal energy that the fiber will be exposed to as the depths ranges expressed herein. The net result will be a suppression of the SBS gain. Applying a thermal gradient along the length of the fiber could be a means to suppress SBS by increasing the Brillioun linewidth of the fiber. For example, such means could include using a thin film heating element or variable insulation along the length of the fiber to control the actual temperature at each point along the fiber. Applied thermal gradients and temperature distributions can be, but are not limited to, linear, step-graded, and periodic functions along the length of the fiber.

Modulating the strain for the suppression of nonlinear scattering phenomena, on the fiber can be achieved, but those means are not limited to anchoring the fiber in its jacket in such a way that the fiber is strained. By stretching each segment between support elements selectively, then the Brillioun spectrum will either red shift or blue shift from the natural center frequency effectively broadening the spectrum and decreasing the gain. If the fiber is allowed to hang freely from a tensioner, then the strain will vary from the top of the hole to the bottom of the hole, effectively broadening the Brillioun gain spectrum and suppressing SBS. Means for applying strain to the fiber include, but are not limited to, twisting the fiber, stretching the fiber, applying external pressure to the fiber, and bending the fiber. Thus, for example, as discussed above, twisting the fiber can occur through the use of a creel. Moreover, twisting of the fiber may occur through use of downhole stabilizers designed to provide rotational movement. Stretching the fiber can be achieved, for example as described above, by using support elements along the length of the fiber. Downhole pressures may provide a pressure gradient along the length of the fiber thus inducing strain.

Acoustic modulation of the fiber can alter the Brillioun linewidth. By placing acoustic generators, such as piezo crystals along the length of the fiber and modulating them at a predetermined frequency, the Brillioun spectrum can be broadened effectively decreasing the SBS gain. For example, crystals, speakers, mechanical vibrators, or any other mechanism for inducing acoustic vibrations into the fiber may be used to effectively suppress the SBS gain. Additionally, acoustic radiation can be created by the escape of compressed air through predefined holes, creating a whistle effect.

The interaction of the source linewidth and the Brillioun linewidth in part defines the gain function. Varying the linewidth of the source can suppress the gain function and thus suppress nonlinear phenomena such as SBS. The source linewidth can be varied, for example, by FM modulation or closely spaced wavelength combined sources, an example of which is illustrated in FIG. 5. Thus, a fiber laser can be directly FM modulated by a number of means, one method is simply stretching the fiber with a piezo-electric element which induces an index change in the fiber medium, resulting in a change in the length of the cavity of the laser which produces a shift in the natural frequency of the fiber laser. This FM modulation scheme can achieve very broadband modulation of the fiber laser with relatively slow mechanical and electrical components. A more direct method for FM modulating these laser sources can be to pass the beam through a non-linear crystal such as Lithium Niobate, operating in a phase modulation mode, and modulate the phase at the desired frequency for suppressing the gain.

Additionally, a spectral beam combination of laser sources which may be used to suppress Stimulated Brillioun Scattering. Thus the spaced wavelength beams, the spacing as described herein, can suppress the Stimulated Brillioun Scattering through the interference in the resulting acoustic waves, which will tend to broaden the Stimulated Brillioun Spectrum and thus resulting in lower Stimulated Brillioun Gain. Additionally, by utilizing multiple colors the total maximum transmission power can be increased by limiting SBS phenomena within each color. An example of such a laser system is illustrated in FIG. 4.

Raman scattering can be suppressed by the inclusion of a wavelength-selective filter in the optical path. This filter can be a reflective, transmissive, or absorptive filter. Moreover, an optical fiber connector can include a Raman rejection filter. Additionally a Raman rejection filter could be integral to the fiber. These filters may be, but are not limited to, a bulk filter, such as a dichroic filter or a transmissive grating filter, such as a Bragg grating filter, or a reflective grating filter, such as a ruled grating. For any backward propagating Raman energy, as well as, a means to introduce pump energy to an active fiber amplifier integrated into the overall fiber path, is contemplated, which, by way of example, could include a method for integrating a rejection filter with a coupler to suppress Raman Radiation, which suppresses the Raman Gain. Further, Brillioun scattering can be suppressed by filtering as well. Faraday isolators, for example, could be integrated into the system. A Bragg Grating reflector tuned to the Brillioun Scattering frequency could also be integrated into the coupler to suppress the Brillioun radiation.

Figure 7:
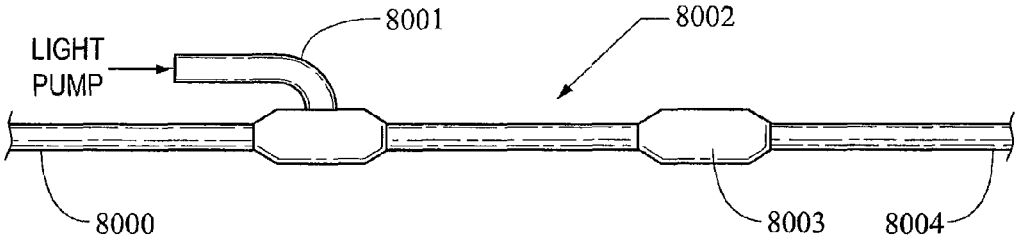
FIG. 7 is a schematic diagram of a laser fiber amplifier.

To overcome power loss in the fiber as a function of distance, active amplification of the laser signal can be used. An active fiber amplifier can provide gain along the optical fiber to offset the losses in the fiber. For example, by combining active fiber sections with passive fiber sections, where sufficient pump light is provided to the active, i.e., amplified section, the losses in the passive section will be offset. Thus, there is provided a means to integrate signal amplification into the system. In FIG. 7 there is illustrated an example of such a means having a first passive fiber section 8000 with, for example, −1 dB loss, a pump source 8001 optically associated with the fiber amplifier 8002, which may be introduced into the outer clad, to provide for example, a +1 dB gain of the propagating signal power. The fiber amplifier 8002 is optically connected to a coupler 8003, which can be free spaced or fused, which is optically connected to a passive section 8004. This configuration may be repeated numerous times, for varying lengths, power losses, and downhole conditions. Additionally, the fiber amplifier could act as the delivery fiber for the entirety of the transmission length. The pump source may be uphole, downhole, or combinations of uphole and downhole for various borehole configurations.

A further method is to use dense wavelength beam combination of multiple laser sources to create an effective linewidth that is many times the natural linewidth of the individual laser effectively suppressing the SBS gain. Here multiple lasers each operating at a predetermined wavelength and at a predetermined wavelength spacing are superimposed on each other, for example by a grating. The grating can be transmissive or reflective.

The optical fiber or fiber bundle can be encased in an environmental shield to enable it to survive at high pressures and temperatures. The cable could be similar in construction to the submarine cables that are laid across the ocean floor and maybe buoyant if the hole is filled with water. The cable may consist of one or many optical fibers in the cable, depending on the power handling capability of the fiber and the power required to achieve economic drilling rates. It being understood that in the field several km of optical fiber will have to be delivered down the borehole. The fiber cables maybe made in varying lengths such that shorter lengths are used for shallower depths so higher power levels can be delivered and consequently higher drilling rates can be achieved. This method requires the fibers to be changed out when transitioning to depths beyond the length of the fiber cable. Alternatively a series of connectors could be employed if the connectors could be made with low enough loss to allow connecting and reconnecting the fiber(s) with minimal losses.

Thus, there is provided in Tables 4 and 5 herein power transmissions for exemplary optical cable configurations.

TABLE 4

| Power in | Length of fiber(s) | Diameter of bundle | # of fibers in bundle | Power out |
|---|---|---|---|---|
| 20 kW | 5 km | 500 microns | 1 | 15 kW |
| 20 kW | 7 km | 500 microns | 1 | 13 kW |
| 20 kW | 5 km | 200 microns-1 mm | 2 to 100 | 15 kW |
| 20 kW | 7 km | 200 microns-1 mm | 2 to 100 | 13 kW |
| 20 kW | 5 km | 100-200 microns | 1 | 10 kW |
| 20 kW | 7 km | 100-200 microns | 1 | 8 kW |

TABLE 5

(with active amplification)

| Power in | Length of fiber(s) | Diameter of bundle | # of fibers in bundle | Power out |
|---|---|---|---|---|
| 20 kW | 5 km | 500 microns | 1 | 17 kW |
| 20 kW | 7 km | 500 microns | 1 | 15 kW |
| 20 kW | 5 km | 200 microns-1 mm | 2 to 100 | 20 kW |
| 20 kW | 7 km | 200 microns-1 mm | 2 to 100 | 18 kW |

TABLE 5-continued (with active amplification)

| Power in | Length of fiber(s) | Diameter of bundle | # of fibers in bundle | Power out |
|---|---|---|---|---|
| 20 kW | 5 km | 100-200 microns | 1 | 15 kW |
| 20 kW | 7 km | 100-200 microns | 1 | 13 kW |

The optical fibers are preferably placed inside the coiled tubing for advancement into and removal from the borehole. In this manner the coiled tubing would be the primary load bearing and support structure as the tubing is lowered into the well. It can readily be appreciated that in wells of great depth the tubing will be bearing a significant amount of weight because of its length. To protect and secure the optical fibers, including the optical fiber bundle contained in the, for example, ¼" stainless steel tubing, inside the coiled tubing stabilization devices are desirable. Thus, at various intervals along the length of the coiled tubing supports can be located inside the coiled tubing that fix or hold the optical fiber in place relative to the coiled tubing. These supports, however, should not interfere with, or otherwise obstruct, the flow of fluid, if fluid is being transmitted through the coiled tubing. An example of a commercially available stabilization system is the ELECTROCOIL System. These support structures, as described above, may be used to provide strain to the fiber for the suppression of nonlinear phenomena.

Although it is preferable to place the optical fibers within the tubing, the fibers may also be associated with the tubing by, for example, being run parallel to the tubing, and being affixed thereto, by being run parallel to the tubing and be slidably affixed thereto, or by being placed in a second tubing that is associated or not associated with the first tubing. In this way, it should be appreciated that various combinations of tubulars may be employed to optimize the delivery of laser energy, fluids, and other cabling and devices into the borehole. Moreover, the optical fiber may be segmented and employed with conventional strands of drilling pipe and thus be readily adapted for use with a conventional mechanical drilling rig outfitted with connectable tubular drill pipe.

Downhole Monitoring Apparatus and Methods.

During drilling operations, and in particular during deep drilling operations, e.g., depths of greater than 1 km, it may be desirable to monitor the conditions at the bottom of the borehole, as well as, monitor the conditions along and in the long distance high powered laser beam transmission means. Thus, there is further provided the use of an optical pulse, train of pulses, or continuous signal, that are continuously monitored that reflect from the distal end of the fiber and are used to determine the continuity of the fiber. Further, there is provided for the use of the fluorescence from the illuminated surface as a means to determine the continuity of the optical fiber. A high power laser will sufficiently heat the rock material to the point of emitting light. This emitted light can be monitored continuously as a means to determine the continuity of the optical fiber. This method is faster than the method of transmitting a pulse through the fiber because the light only has to propagate along the fiber in one direction. Additionally there is provided the use of a separate fiber to send a probe signal to the distal end of the armored fiber bundle at a wavelength different than the high power signal and by monitoring the return signal on the high power optical fiber, the integrity of the fiber can be determined.

These monitoring signals may transmit at wavelengths substantially different from the high power signal such that a wavelength selective filter may be placed in the beam path uphole or downhole to direct the monitoring signals into equipment for analysis. For example, this selective filter may be placed in the creel or spool described herein.

To facilitate such monitoring an Optical Spectrum Analyzer or Optical Time Domain Reflectometer or combinations thereof may be used. An AnaritsuMS9710C Optical Spectrum Analyzer having: a wavelength range of 600 nm-1.7 microns; a noise floor of 90 dBm @ 10 Hz, −40 dBm @ 1 MHz; a 70 dB dynamic range at 1 nm resolution; and a maximum sweep width: 1200 nm and an Anaritsu CMA 4500 OTDR may be used.

The efficiency of the laser's cutting action can also be determined by monitoring the ratio of emitted light to the reflected light. Materials undergoing melting, spallation, thermal dissociation, or vaporization will reflect and absorb different ratios of light. The ratio of emitted to reflected light may vary by material further allowing analysis of material type by this method. Thus, by monitoring the ratio of emitted to reflected light material type, cutting efficiency, or both may be determined. This monitoring may be performed uphole, downhole, or a combination thereof.

Moreover, for a variety of purposes such as powering downhole monitoring equipment, electrical power generation may take place in the borehole including at or near the bottom of the borehole. This power generation may take place using equipment known to those skilled in the art, including generators driven by drilling muds or other downhole fluids, means to convert optical to electrical power, and means to convert thermal to electrical power.

The Bottom Hole Assembly.

The bottom hole assembly contains the laser optics, the delivery means for the fluid and other equipment. Bottom hole assemblies are disclosed in detail in co-pending U.S. patent application Ser. No. 12/544,038, Ser. No. 12/544,094 and Ser. No. 12/543,968, filed contemporaneously herewith, the disclosure of which is incorporated herein by reference in its entirety. In general the bottom hole assembly contains the output end, also referred to as the distal end, of the long distance high power laser beam transmission means and preferably the optics for directing the laser beam to the earth or rock to be removed for advancing the borehole, or the other structure intended to be cut.

The present systems and in particular the bottom hole assembly, may include one or more optical manipulators. An optical manipulator may generally control a laser beam, such as by directing or positioning the laser beam to spall material, such as rock. In some configurations, an optical manipulator may strategically guide a laser beam to spall material, such as rock. For example, spatial distance from a borehole wall or rock may be controlled, as well as the impact angle. In some configurations, one or more steerable optical manipulators may control the direction and spatial width of the one or more laser beams by one or more reflective mirrors or crystal reflectors. In other configurations, the optical manipulator can be steered by an electro-optic switch, electroactive polymers, galvonometers, piezoelectrics, and/or rotary/linear motors. In at least one configuration, an infrared diode laser or fiber laser optical head may generally rotate about a vertical axis to increase aperture contact length. Various programmable values such as specific energy, specific power, pulse rate, duration and the like maybe implemented as a function of time. Thus, where to apply energy may be strategically determined, programmed and executed so as to enhance a rate of penetration and/or laser/rock interaction, to enhance the overall efficiency of borehole advancement, and to enhance the overall efficiency of borehole completion, including reducing the number of steps on the critical path for borehole completion. One or more algorithms may be used to control the optical manipulator.

Figure 8:
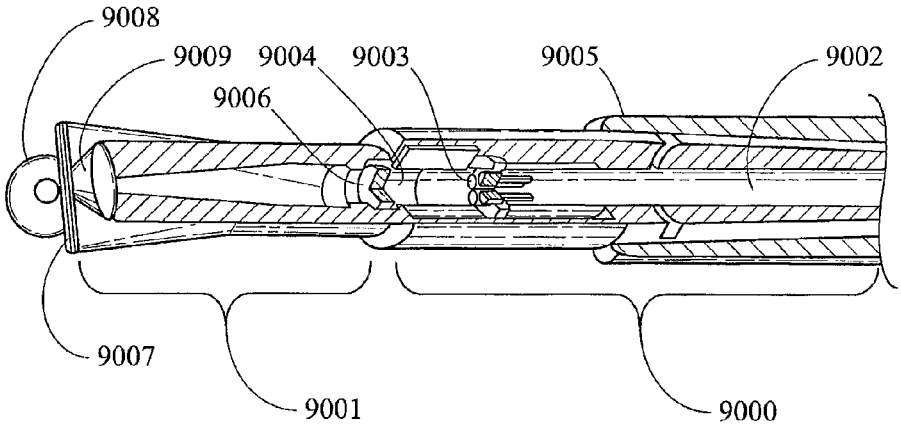
FIG. 8 is a perspective cutaway of a bottom hole assembly.

Thus, by way of example, as illustrated in FIG. 8 the bottom hole assembly comprises an upper part 9000 and a lower part 9001. The upper part 9000 may be connected to the lower end of the coiled tubing, drill pipe, or other means to lower and retrieve the bottom hole assembly from the borehole. Further, it may be connected to stabilizers, drill collars, or other types of downhole assemblies (not shown in the figure) which in turn are connected to the lower end of the coiled tubing, drill pipe, or other means to lower and retrieve the bottom hole assembly from the borehole. The upper part 9000 further contains the means 9002 that transmitted the high power energy down the borehole and the lower end 9003 of the means. In FIG. 8 this means is shown as a bundle of four optical cables. The upper part 9000 may also have air amplification nozzles 9005 that discharge a portion up to 100% of the fluid, for example $N_2$. The upper part 9000 is joined to the lower part 9001 with a sealed chamber 9004 that is transparent to the laser beam and forms a pupil plane for the beam shaping optics 9006 in the lower part 9001. The lower part 9001 may be designed to rotate and in this way for example an elliptical shaped laser beam spot can be rotated around the bottom of the borehole. The lower part 9001 has a laminar flow outlet 9007 for the fluid and two hardened rollers 9008, 9009 at its lower end, although non-laminar flows and turbulent flows may be employed.

In use, the high energy laser beam, for example greater than 10 kW, would travel down the fibers 9002, exit the ends of the fibers 9003 and travel through the sealed chamber and pupil plane 9004 into the optics 9006, where it would be shaped and focused into an elliptical spot. The laser beam would then strike the bottom of the borehole spalling, melting, thermally dissociating, and/or vaporizing the rock and earth struck and thus advance the borehole. The lower part 9001 would be rotating and this rotation would cause the elliptical laser spot to rotate around the bottom of the borehole. This rotation would also cause the rollers 9008, 9009 to physically dislodge any material that was crystallized by the laser or otherwise sufficiently fixed to not be able to be removed by the flow of the fluid alone. The cuttings would be cleared from the laser path by the laminar flow of the fluid, as well as, by the action of the rollers 9008, 9009 and the cuttings would then be carried up the borehole by the action of the fluid from the air amplifier 9005, as well as, the laminar flow opening 9007.

The Mud Return and Handling System.

Thus, in general cutting removal system may be typical of that used in an oil drilling system. These would include by way of example a shale shaker. Further, desanders and desilters and then centrifuges may be employed. The purpose of this equipment is to remove the cuttings so that the fluid can be recirculated and reused. If the fluid, i.e., circulating medium is gas, than a water misting systems may also be employed.

To further illustrate the advantages, uses, operating parameters and applications of the present invention, by way of example and without limitation, the following suggested exemplary studies are proposed.

Example 1

Test exposure times of 0.05 s, 0.1 s, 0.2 s, 0.5 s and 1 s will be used for granite and limestone. Power density will be varied by changing the beam spot diameter (circular) and elliptical area of 12.5 mm×0.5 mm with a time-average power of 0.5 kW, 1.6 kW, 3 kW, 5 kW will be used. In addition to continuous wave beam, pulsed power will also be tested for spallation zones.

| Experimental Setup | |
|---|---|
| Fiber Laser | IPG Photonics 5 kW ytterbium-doped multi-clad fiber laser |
| Dolomite/Barre Granite Rock Size | 12" × 12" × 5" or and 5" × 5" × 5" |
| Limestone | 12" × 12" × 5" or and5" × 5" × 5" |
| Beam Spot Size (or diameter) | 0.3585", 0.0625" (12.5 mm, 0.5 mm), 0.1", |
| Exposure Times | 0.05 s, 0.1 s, 0.2 s, 0.5 s, 1 s |
| Time-average Power | 0.25 kW, 0.5 kW, 1.6 kW, 3 kW, 5 kW |
| Pulse | 0.5 J/pulse to 20 J/pulse at 40 to 600 1/s |

Example 2

| The general parameters of Example 1 will be repeated using sandstone and shale. Experimental Setup | |
|---|---|
| Fiber Laser | IPG Photonics 5 kW ytterbium-doped mufti-clad fiber laser |
| Berea Gray (or Yellow) Sandstone | 12" × 12" × 5"and5" × 5" × 5" |
| Shale | 12" × 12" × 5"and 5" × 5" × 5" |
| Beam Type | CW/Collimated |
| Beam Spot Size (or diameter) | 0.0625" (12.5 mm × 0.5 mm), 0.1" |
| Power | 0.25 kW, 0.5 kW, 1.6 kW, 3 kW, 5 kW |
| Exposure Times | 1 s, 0.5 s. 0.1 s |

Example 3

The ability to chip a rectangular block of material, such as rock will be demonstrated in accordance with the systems and methods disclosed herein. The setup is presented in the table below, and the end of the block of rock will be used as a ledge. Blocks of granite, sandstone, limestone, and shale (if possible) will each be spalled at an angle at the end of the block (chipping rock around a ledge). The beam spot will then be moved consecutively to other parts of the newly created ledge from the chipped rock to break apart a top surface of the ledge to the end of the block. Chipping approximately 1"×1"×1" sized rock particles will be the goal. Applied SP and SE will be selected based on previously recorded spallation data and information gleaned from Experiments 1 and 2 presented above. ROP to chip the rock will be determined, and the ability to chip rock to desired specifications will be demonstrated.

| Experimental Setup<br>Fixed: | |
|---|---|
| Fiber Laser | IPG Photonics 5 kW ytterbium-doped multi-clad fiber laser |
| Dolomite/Barre Granite Rock Size | 12" × 12" × 12" and12" × 12" × 24" |
| Limestone | 12" × 12" × 12" and12" × 12" × 24" |
| Berea Gray (or Yellow) Sandstone | 12" × 12" × 12" and12" × 12" × 24" |
| Shale | 12" × 12" × 12"and12" × 12" × 24" |
| Beam Type | CW/CollimatedandPulsed at Spallation Zones |

-continued

| Experimental Setup Fixed: | |
|---|---|
| Specific Power | Spallation zones (920 W/cm2 at ~2.6 kJ/cc for Sandstone &4 kW/cm2 at ~0.52 kJ/cc for Limestone) |
| Beam Size | 12.5 mm × 0.5 mm |
| Exposure Times | See Experiments 1 & 2 |
| Purging | 189 l/min Nitrogen Flow |

Example 4

Multiple beam chipping will be demonstrated. Spalling overlap in material, such as rock resulting from two spaced apart laser beams will be tested. Two laser beams will be run at distances of 0.2", 0.5", 1", 1.5" away from each other, as outlined in the experimental setup below. Granite, sandstone, limestone, and shale will each be used. Rock fractures will be tested by spalling at the determined spalling zone parameters for each material. Purge gas will be accounted for. Rock fractures will overlap to chip away pieces of rock. The goal will be to yield rock chips of the desired 1"×1"×1" size. Chipping rock from two beams at a spaced distance will determine optimal particle sizes that can be chipped effectively, providing information about particle sizes to spall and ROP for optimization.

| Experimental Setup | |
|---|---|
| Fiber Laser | IPG Photonics 5 kW ytterbium-doped multi-clad fiber laser |
| Dolomite/Barre Granite Rock Size | 5" × 5" × 5" |
| Limestone | 5" × 5" × 5" |
| Berea Gray (or Yellow) Sandstone | 5" × 5" × 5" |
| Shale | 5" × 5" × 5" |
| Beam Type | CW/Collimated or Pulsed atSpallation Zones |
| Specific Power | Spallation zones (~920 W/cm2 at ~2.6 kJ/cc for Sandstone &4 kW/cm2 at ~0.52 kJ/cc for Limestone) |
| Beam Size | 12.5 mm × 0.5 mm |
| Exposure Times | See Experiments 1 & 2 |
| Purging | 1891/min Nitrogen Flow |
| Distance between two laser beams | 0.2", 0.5", 1", 1.5" |

Example 5

Spalling multiple points with multiple beams will be performed to demonstrate the ability to chip material, such as rock in a pattern. Various patterns will be evaluated on different types of rock using the parameters below. Patterns utilizing a linear spot approximately 1 cm×15.24 cm, an elliptical spot with major axis approximately 15.24 cm and minor axis approximately 1 cm, a single circular spot having a diameter of 1 cm, an array of spots having a diameter of 1 cm with the spacing between the spots being approximately equal to the spot diameter, the array having 4 spots spaced in a square, spaced along a line. The laser beam will be delivered to the rock surface in a shot sequence pattern wherein the laser is fired until spallation occurs and then the laser is directed to the next shot in the pattern and then fired until spallation occurs with this process being repeated. In the movement of the linear and elliptical patterns the spots are in effect rotated about their central axis. In the pattern comprising the array of spots the spots may be rotated about their central axis, and rotated about an axis mint as in the hands of a clock moving around a face.

| Experimental Setup | |
|---|---|
| Fiber Laser | IPG Photonics 5 kW ytterbium-doped multi-clad fiber laser |
| Dolomite/Barre Granite Rock Size | 12" × 12" × 12" and12" × 12" × 5" |
| Limestone | 12" × 12" × 12" and12" × 12" × 5" |
| Berea Gray (or Yellow) Sandstone | 12" × 12" × 12" and12" × 12" × 5" |
| Shale | 12" × 12" × 12" and12" × 12" × 5" |
| Beam Type | CW/Collimated or Pulsed at Spallation Zones |
| Specific Power | Spallation zones {~920 W/cm2 at −2.6 kJ/cc for Sandstone &4 kW/cm2 at ~0.52 kJ/cc for Limestone) |
| Beam Size | 12.5 mm × 0.5 mm |
| Exposure Times | See Experiments 1 & 2 |
| Purging | 189 l/min Nitrogen Flow |

From the foregoing examples and detailed teaching it can be seen that in general one or more laser beams may spall, vaporize, or melt the material, such as rock in a pattern using an optical manipulator. Thus, the rock may be patterned by spalling to form rock fractures surrounding a segment of the rock to chip that piece of rock. The laser beam spot size may spall, vaporize, or melt the rock at one angle when interacting with rock at high power. Further, the optical manipulator system may control two or more laser beams to converge at an angle so as to meet close to a point near a targeted piece of rock. Spallation may then form rock fractures overlapping and surrounding the target rock to chip the target rock and enable removal of larger rock pieces, such as incrementally. Thus, the laser energy may chip a piece of rock up to 1" depth and 1" width or greater. Of course, larger or smaller rock pieces may be chipped depending on factors such as the type of rock formation, and the strategic determination of the most efficient technique.

There is provided by way of examples illustrative and simplified plans of potential drilling scenarios using the laser drilling systems and apparatus of the present invention.

Drilling Plan Example 1

| | Depth | Rock type | Drilling type/Laser power down hole |
|---|---|---|---|
| Drill 17½ inch hole | Surface-3000 ft | Sand and shale | Conventional mechanical drilling |
| Run 13⅜ inch casing | Length 3000 ft | | |
| Drill 12¼ inch hole | 3000 ft-8,000 ft | basalt | 40 kW (minimum) |
| Run 9⅝ inch casing | Length 8,000 ft | | |
| Drill 8½ inch hole | 8,000 ft-11,000 ft | limestone | Conventional mechanical drilling |
| Run 7 inch casing | Length 11,000 ft | | |
| Drill 6¼ inch hole | 11,000 ft-14,000 ft | Sand stone | Conventional mechanical drilling |
| Run 5 inch liner | Length 3000 ft | | |

Drilling Plan Example 2

| | Depth | Rock type | Drilling type/Laser power down hole |
|---|---|---|---|
| Drill 17½ inch hole | Surface-500 ft | Sand and shale | Conventional mechanical drilling |
| Run 13⅜ casing | Length 500 ft | | |
| Drill 12¼ hole | 500 ft-4,000 ft | granite | 40 kW (minimum) |
| Run 9⅝ inch casing | Length 4,000 ft | | |
| Drill 8½ inch hole | 4,000 ft-11,000 ft | basalt | 20 kW (mimimum) |
| Run 7 inch casing | Length 11,000 ft | | |
| Drill 6¼ inch hole | 11,000 ft-14,000 ft | Sand stone | Conventional mechanical drilling |
| Run 5 inch liner | Length 3000 ft | | |

Moreover, one or more laser beams may form a ledge out of material, such as rock by spalling the rock in a pattern. One or more laser beams may spall rock at an angle to the ledge forming rock fractures surrounding the ledge to chip the piece of rock surrounding the ledge. Two or more beams may chip the rock to create a ledge. The laser beams can spall the rock at an angle to the ledge forming rock fractures surrounding the ledge to further chip the rock. Multiple rocks can be chipped simultaneously by more than one laser beams after one or more rock ledges are created to chip the piece of rock around the ledge or without a ledge by converging two beams near a point by spalling; further a technique known as kerfing may be employed.

In accordance with the teaching of the invention, a fiber laser or liquid crystal laser may be optically pumped in a range from 750 nm to 2100 nm wavelength by an infrared laser diode. A fiber laser or liquid crystal laser may be supported or extend from the infrared laser diode downhole connected by an optical fiber transmitting from infrared diode laser to fiber laser or liquid crystal laser at the infrared diode laser wavelength. The fiber cable may be composed of a material such as silica, PMMA/perfluirnated polymers, hollow core photonic crystals, or solid core photonic crystals that are in single-mode or multimode. Thus, the optical fiber may be encased by a coiled tubing or reside in a rigid drill-string. On the other hand, the light may be transmitted from the infrared diode range from the surface to the fiber laser or liquid crystal laser downhole. One or more infrared diode lasers may be on the surface.

A laser may be conveyed into the wellbore by a conduit made of coiled tubing or rigid drill-string. A power cable may be provided. A circulation system may also be provided. The circulation system may have a rigid or flexible tubing to send a liquid or gas downhole. A second tube may be used to raise the rock cuttings up to the surface. A pipe may send or convey gas or liquid in the conduit to another pipe, tube or conduit. The gas or liquid may create an air knife by removing material, such as rock debris from the laser head. A nozzle, such as a Laval nozzle may be included. For example, a Laval-type nozzle may be attached to the optical head to provide pressurized gas or liquid. The pressurized gas or liquid may be transmissive to the working wavelength of the infrared diode laser or fiber laser light to force drilling muds away from the laser path. Additional tubing in the conduit may send a lower temperature liquid downhole than ambient temperature at a depth to cool the laser in the conduit. One or more liquid pumps may be used to return cuttings and debris to the surface by applying pressure uphole drawing incompressible fluid to the surface.

The drilling mud in the well may be transmissive to visible, near-IR range, and mid-IR wavelengths so that the laser beam has a clear optical path to the rock without being absorbed by the drilling mud.

Further, spectroscopic sample data may be detected and analyzed. Analysis may be conducted simultaneously while drilling from the heat of the rock being emitted. Spectroscopic samples may be collected by laser-induced breakdown derivative spectroscopy. Pulsed power may be supplied to the laser-rock impingement point by the infrared diode laser. The light may be analyzed by a single wavelength detector attached to the infrared diode laser. For example, Raman-shifted light may be measured by a Raman spectrometer. Further, for example, a tunable diode laser using a few-mode fiber Bragg grating may be implemented to analyze the band of frequencies of the fluid sample by using ytterbium, thulium, neodymium, dysprosium, praseodymium, or erbium as the active medium. In some embodiments, a chemometric equation, or least mean square fit may be used to analyze the Raman spectra. Temperature, specific heat, and thermal diffusivity may be determined. In at least one embodiment, data may be analyzed by a neural network. The neural network may be updated real-time while drilling. Updating the diode laser power output from the neural network data may optimize drilling performance through rock formation type.

An apparatus to geo-navigate the well for logging may be included or associated with the drilling system. For example, a magnemometer, 3-axis accelerometer, and/or gyroscope may be provided. As discussed with respect to the laser, the geo-navigation device may be encased, such as with steel, titanium, diamond, or tungsten carbide. The geo-navigation device may be encased together with the laser or independently. In some embodiments, data from the geo-navigation device may direct the directional movement of the apparatus downhole from a digital signal processor.

A high power optical fiber bundle may, by way of example, hang from an infrared diode laser or fiber laser downhole. The fiber may generally be coupled with the diode laser to transmit power from the laser to the rock formation. In at least one embodiment, the infrared diode laser may be fiber coupled at a wavelength range between 800 nm to 1000 nm. In some embodiments, the fiber optical head may not be in contact with the borehole. The optical cable may be a hollow core photonic crystal fiber, silica fiber, or plastic optical fibers including PMMA/perfluorinated polymers that are in single or multimode. In some embodiments, the optical fiber may be encased by a coiled or rigid tubing. The optical fiber may be attached to a conduit with a first tube to apply gas or liquid to circulate the cuttings. A second tube may supply gas or liquid to, for example, a Laval nozzle jet to clear debris from the laser head. In some embodiments, the ends of the optical fibers are encased in a head composed of a steerable optical manipulator and mirrors or crystal reflector. The encasing of the head may be composed of sapphire or a related material. An optical manipulator may be provided to rotate the optical fiber head. In some embodiments, the infrared diode laser may be fully encased by steel, titanium, diamond, or tungsten carbide residing above the optical fibers in the borehole. In other embodiments, it may be partially encased.

Single or multiple fiber optical cables may be tuned to wavelengths of the near-IR, mid-IR, and far-IR received from the infrared diode laser inducement of the material, such as rock for derivative spectroscopy sampling. A second optical head powered by the infrared diode laser above the optical head drilling may case the formation liner. The second optical head may extend from the infrared diode laser with light being transmitted through a fiber optic. In some configurations, the fiber optic may be protected by coiled tubing. The infrared diode laser optical head may perforate the steel and concrete casing. In at least one embodiment, a second infrared diode laser above the first infrared diode laser may case the formation liner while drilling.

In accordance with one or more configurations, a fiber laser or infrared diode laser downhole may transmit coherent light down a hollow tube without the light coming in contact with the tube when placed downhole. The hollow tube may be composed of any material. In some configurations, the hollow tube may be composed of steel, titanium or silica. A mirror or reflective crystal may be placed at the end of the hollow tube to direct collimated light to the material, such as a rock surface being drilled. In some embodiments, the optical manipulator can be steered by an electro-optic switch, electroactive polymers, galvonometers, piezoelectrics, or rotary/linear motors. A circulation system may be used to raise cuttings. One or more liquid pumps may be used to return cuttings to the surface by applying pressure uphole, drawing incompressible fluid to the surface. In some configurations, the optical fiber may be attached to a conduit with two tubes, one to apply gas or liquid to circulate the cuttings and one to supply gas or liquid to a Laval nozzle jet to clear debris from the laser head.

In a further embodiment of the present inventions there is provided a drilling rig for making a borehole in the earth to a depth of from about 1 km to about 5 km or greater, the rig comprising an armored fiber optic delivery bundle, consisting of from 1 to a plurality of coated optical fibers, having a length that is equal to or greater than the depth of the borehole, and having a means to coil and uncoil the bundle while maintaining an optical connection with a laser source. In yet a further embodiment of the present invention there is provided the method of uncoiling the bundle and delivering the laser beam to a point in the borehole and in particular a point at or near the bottom of the borehole. There is further provided a method of advancing the borehole, to depths in excess of 1 km, 2 km, up to and including 5 km, in part by delivering the laser beam to the borehole through armored fiber optic delivery bundle.

The novel and innovative armored bundles and associated coiling and uncoiling apparatus and methods of the present invention, which bundles may be a single or plurality of fibers as set forth herein, may be used with conventional drilling rigs and apparatus for drilling, completion and related and associated operations. The apparatus and methods of the present invention may be used with drilling rigs and equipment such as in exploration and field development activities. Thus, they may be used with, by way of example and without limitation, land based rigs, mobile land based rigs, fixed tower rigs, barge rigs, drill ships, jack-up platforms, and semi-submersible rigs. They may be used in operations for advancing the well bore, finishing the well bore and work over activities, including perforating the production casing. They may further be used in window cutting and pipe cutting and in any application where the delivery of the laser beam to a location, apparatus or component that is located deep in the well bore may be beneficial or useful.

From the foregoing description, one skilled in the art can readily ascertain the essential characteristics of this invention, and without departing from the spirit and scope thereof, can make various changes and/or modifications of the invention to adapt it to various usages and conditions.

What is claimed is:

1. A high power laser workover and completion system for providing high power laser energy to a location in a wellbore in a precise and controlled manner to perform a laser workover and completion operation in the wellbore, the system comprising:

a. a high power laser source capable of providing a high power laser beam having a power of at least about 15 kW, and a beam parameter product of about less than 100 mm milliard; a chiller operably associated with the high power laser source;

b. a means for transmitting the laser beam from the high power laser source to a predetermined location in the wellbore for performing a workover and completion operation; and, c. the transmitting means optically associated with a means for suppressing nonlinear scattering phenomena arising from the transmission of the laser beam having a power of at least about 15 kW; and, d. the transmitting means optically and mechanically associated with a high power laser workover and completion bottom hole assembly;

e. whereby, the high power laser beam is delivered to the predetermined location in the wellbore with sufficient power to perform the laser workover and completion operation.

2. The high power laser workover and completion system of claim 1, wherein the laser source comprises a single laser; the transmitting means has a length of at least about 3,000 feet; and the workover and completion operation is selected from the group consisting of pipe cutting, perforating casing, plug removal, window cutting and perforating production casing.

3. The high power laser workover and completion system of claim 1, wherein the laser source comprises two lasers; the transmitting means having a length of at least about 3,000 feet; and the workover and completion operation is pipe cutting.

4. The system of claim 1, wherein the high power laser source is a low order mode source characterized by an $M^2<2$.

5. The system of claim 1, wherein the high power laser source is a low order mode source.

6. The system of claim 1, wherein a laser source from the combination of a plurality of laser sources is a low order mode source.

7. The system of claim 1, wherein the laser source is a bandwidth broadened laser source.

8. The system of claim 1, wherein the means for transmitting comprises an optical fiber and an armored casing.

9. The system of claim 8, wherein the armored casing comprises a metal tube having a diameter of about ¼", and the fiber having a core having a diameter of at least about 500 microns.

10. The system of claim 1, wherein the means for transmitting has a means for break detection.

11. The system of claim 1, wherein the means for transmitting comprises an optical fiber, the optical fiber having a core having a core diameter of at least about 100 microns, a first protective member and a second protective member, wherein the protective members are selected from the group consisting of a steel tube, a polymer coating, a polytetrafluoroethylene coating, a polyimide, an acrylate, a carbon polyamide, and a carbon coating.

12. The system of claim 1, wherein the means for transmitting comprises a single mode optical fiber.

13. The system of claim 1, wherein the means for transmitting comprises a multimode optical fiber.

14. A high power laser workover and completion system for providing high power laser energy to a location in a wellbore in a precise and controlled manner to perform a laser workover and completion operation in the wellbore, the system comprising:

a. a high power laser source capable of providing a high power laser beam having a power of at least about 10 kW, an $M^2$ of less than about 2, and a beam parameter product of about less than 100 mm millirad; the laser source operably associated with a chiller;

b. a laser beam transmission conductor for transmitting the laser beam from the high power laser source to a predetermined location in the wellbore for performing a workover and completion operation; and, c. a nonlinear scattering phenomena suppression system for suppressing nonlinear scattering arising from the transmission of the laser beam having a power of at least about 10 kW; and, d. the laser beam transmission conductor in optical and mechanical associated with a high power laser workover and completion assembly;

e. whereby, the high power laser beam is delivered to the predetermined location in the wellbore with sufficient power to perform the laser workover and completion operation.

15. The high power laser workover and completion system of claim 14, wherein the laser source comprises a single laser and the transmitting conductor has a length of at least about 3,000 feet, and the workover and completion operation is window cutting.

16. The high power laser workover and completion system of claim 14, wherein the nonlinear scattering phenomena suppression system comprises a means for spoiling the coherence of the nonlinear scattering phenomena and the means for transmitting the laser beam has a length of at least about 1,000 feet.

17. The high power laser workover and completion system of claim 14, wherein the nonlinear scattering phenomena suppression system is selected from the group consisting of a means for spoiling the coherence of the Stimulated Brillouin Scattering, a means for varying a linewidth of the laser source, a means for decreasing a Brillouin gain factor, and a means for increasing a Brillouin linewidth.

18. A high power laser workover and completion system for providing high power laser energy to a borehole to perform a workover and completion operation at a location within the borehole, the system comprising:

a. a source of high power laser energy, the laser source capable of providing a laser beam having at least about 20 kW of power;

b. a conveyance assembly having a distal end and a proximal end thereby defining a length of at least about 3,000 ft;

c. a source of a fluid for use in a laser workover and completion operation;

d. the proximal end of the conveyance assembly being in fluid communication with the source of fluid;

e. the proximal end of the conveyance assembly being in optical communication with the laser source;

f. the conveyance assembly comprising a high power laser transmission cable, the transmission cable having a distal end and a proximal end, the proximal end being in optical communication with the laser source, and the distal end being in optical communication with a downhole assembly, whereby the laser beam is transmitted by the cable from the proximal end to the distal end of the cable and to the downhole assembly for delivery of the laser beam energy to a location in the borehole to perform a workover and completion operation;

g. a means for suppressing nonlinear scattering phenomena from the laser beam in associations with at least one of elements a., b., e., or f.; and, h. the power of the laser energy at the downhole assembly adjacent to the location in the borehole to perform the workover and completion operation being at least about 5 kW.

19. The high power laser workover and completion system of claim 18, wherein the workover and completion operation is selected from the group consisting of pipe cutting, perforating casing, plug removal, window cutting and perforating production casing.

20. The high power laser workover and completion system of claim 18, wherein the high power laser source comprises a combination of a plurality of laser sources, wherein each laser source of the combination is capable of providing a high power laser beam characterized by a linewidth; wherein the means for suppressing comprises a combination of the laser beams from the plurality of laser sources, and a combined laser beam characterized by an effective linewidth greater than the linewidth of a laser beam from a laser source from the plurality of laser sources; and wherein the combined beam is characterized by having a power of at least about 40 kW.

21. The high power laser workover and completion system of claim 18, wherein the means for suppressing comprises a Faraday isolator.

22. The high power laser workover and completion system of claim 18, wherein the means for suppressing comprises a Bragg Grating reflector.

23. The high power laser workover and completion high power laser workover and completion system of claim 18, wherein a laser source comprises a solid-state laser.

24. A high power laser workover and completion system for providing high power laser energy over a long distance to a location in a borehole to perform a workover and completion operation, the system comprising:

a. a high powered laser source, capable of providing a high power combined laser beam, the high power laser source comprising a combination of a plurality of laser sources, wherein each laser source of the combination is capable of providing a high power laser beam characterized by a power of at least about 1 kW and a linewidth;

b. a means for suppressing nonlinear scattering phenomena arising from transmission of the high power laser beam, comprising the high power combined laser beam characterized by an effective linewidth greater than the linewidth of a laser beam from a laser source from the plurality of laser sources; and, c. a means for transmitting the laser beam from the high power laser source to a location in the borehole to perform a workover and completion operation;

d. whereby, the high power combined laser beam is delivered to the location within the borehole for performing the workover and completion operation and, whereby the combined laser beam has a power of at least about 15 kW.

25. The high power laser workover and completion system of claim 24, wherein the transmitting means has a length of at least about 5,000 feet; and the workover and completion operation is selected from the group consisting of pipe cutting, perforating casing, plug removal, window cutting and perforating product.

* * * * *